US012508485B1

(12) United States Patent
Pan et al.

(10) Patent No.: US 12,508,485 B1
(45) Date of Patent: Dec. 30, 2025

(54) BASKETBALL TRAINING SYSTEM

(71) Applicant: Airborne Athletics, Inc., Bloomington, MN (US)

(72) Inventors: Adam T. Pan, Elko New Market, MN (US); Douglas Brad Campbell, Loretto, MN (US); Kevin Knutson, Bloomington, MN (US); Eric Drommerhausen, Bloomington, MN (US); Justin Royer, Maricopa, AZ (US)

(73) Assignee: Airborne Athletics, Inc., Bloomington, MN (US)

( * ) Notice: Subject to any disclaimer, the term of this patent is extended or adjusted under 35 U.S.C. 154(b) by 0 days.

(21) Appl. No.: 18/765,003

(22) Filed: Jul. 5, 2024

Related U.S. Application Data

(63) Continuation of application No. 17/970,191, filed on Oct. 20, 2022.

(60) Provisional application No. 63/257,795, filed on Oct. 20, 2021.

(51) Int. Cl.

| | |
|---|---|
| ***A63B 69/00*** | (2006.01) |
| ***A63B 24/00*** | (2006.01) |
| ***A63B 69/40*** | (2006.01) |
| ***A63B 71/02*** | (2006.01) |
| ***A63B 71/06*** | (2006.01) |

(52) U.S. Cl.
CPC ..... *A63B 69/0071* (2013.01); *A63B 24/0062* (2013.01); *A63B 69/407* (2013.01); *A63B 71/03* (2020.08); *A63B 71/0605* (2013.01); *A63B 71/0622* (2013.01); *A63B 2024/0068* (2013.01); *A63B 2024/0081* (2013.01); *A63B 2071/065* (2013.01)

(58) Field of Classification Search
CPC ..... A63B 69/0071; A63B 24/0062; A63B 69/407; A63B 71/03; A63B 71/0605; A63B 71/0622; A63B 2024/0068; A63B 2024/0081; A63B 2071/065
See application file for complete search history.

(56) References Cited

U.S. PATENT DOCUMENTS

| | | | |
|---|---|---|---|
| 1,223,386 | A | 4/1917 | Handelan |
| 2,908,266 | A | 10/1959 | Cooper |
| 3,776,550 | A | 12/1973 | McNabb |
| 3,802,703 | A | 4/1974 | Van Tassel |
| 3,878,828 | A | 4/1975 | Francesco |
| 4,168,695 | A | 9/1979 | Haller et al. |

(Continued)

FOREIGN PATENT DOCUMENTS

WO WO 1995/032033 11/1995

OTHER PUBLICATIONS

[No Author Listed] [online], "Dr. Dish Basketball Shooting Machine and Team Trainer," Apr. 19, 2010, <https://www.youtube.com/watch?v =-0c0o0cRVZU>, p. 1 (time 0:00-1:19) [Video Submission].

(Continued)

*Primary Examiner* — Dmitry Suhol
*Assistant Examiner* — Carl V Larsen
(74) *Attorney, Agent, or Firm* — Fish & Richardson P.C.

(57) ABSTRACT

A basketball training system can include a basketball training machine and additional features such as a user interface, a controller, and programming for using the basketball training machine.

15 Claims, 28 Drawing Sheets

(56) References Cited

U.S. PATENT DOCUMENTS 4,262,648 A 4/1981 Wegener et al.
4,471,746 A 9/1984 Ando
4,517,953 A 5/1985 Osaka et al.
4,579,340 A 4/1986 Jenkins et al.
4,667,957 A 5/1987 Joseph
4,678,189 A 7/1987 Koss
4,714,248 A 12/1987 Koss
4,882,676 A 11/1989 Van De Kop et al.
4,913,431 A 4/1990 Jakobs
4,915,384 A 4/1990 Bear
4,915,387 A 4/1990 Baxstrom
4,936,577 A 6/1990 Kington et al.
4,940,231 A 7/1990 Ehler
4,955,605 A 9/1990 Goldfarb
5,016,875 A 5/1991 Joseph
5,125,651 A 6/1992 Keeling et al.
5,183,253 A 2/1993 Grimaldi et al.
5,312,099 A 5/1994 Oliver, Sr.
5,365,427 A 11/1994 Soignet et al.
5,393,049 A 2/1995 Nelson
5,409,211 A 4/1995 Adamek
5,417,196 A 5/1995 Morrison et al.
5,464,208 A 11/1995 Pierce
5,540,428 A 7/1996 Joseph
5,601,284 A 2/1997 Blackwell et al.
5,676,120 A 10/1997 Joseph
5,681,230 A 10/1997 Krings
5,692,978 A 12/1997 Hummel
5,746,668 A 5/1998 Ochs
5,771,018 A 6/1998 Kennedy
5,776,018 A 7/1998 Simpson et al.
5,813,926 A 9/1998 Vance
5,816,953 A 10/1998 Cleveland
5,842,699 A 12/1998 Mirando et al.
5,929,851 A 7/1999 Donnelly
5,937,143 A 8/1999 Watanabe et al.
5,980,399 A 11/1999 Campbell et al.
6,167,328 A 12/2000 Takaoka et al.
6,224,503 B1 5/2001 Joseph
6,241,628 B1 6/2001 Jenkins et al.
6,280,352 B1 8/2001 Coffeen et al.
6,302,811 B1 10/2001 Topham
6,389,368 B1 5/2002 Hampton
6,390,940 B1 5/2002 Naulls et al.
6,458,049 B2 10/2002 Bush
6,546,924 B2 4/2003 Battersby et al.
6,605,010 B1 8/2003 Rydza
6,659,893 B1 12/2003 Campbell et al.
6,707,487 B1 3/2004 Aman et al.
6,918,591 B2 7/2005 D'amico et al.
7,056,237 B2 6/2006 Slavey et al.
7,066,845 B2 6/2006 Joseph
7,082,938 B2 8/2006 Wilmot
7,094,164 B2 8/2006 Marty et al.
7,288,034 B2 10/2007 Woodard et al.
7,620,466 B2 11/2009 Neale et al.
7,641,574 B2 1/2010 Steen
7,766,770 B2 8/2010 Cucjen et al.
7,927,237 B2 4/2011 Jenkins et al.
7,942,784 B1 5/2011 Hyde et al.
7,945,349 B2 5/2011 Svensson et al.
7,970,492 B2 6/2011 Matsushima
8,012,046 B2 9/2011 Campbell et al.
8,123,634 B1 2/2012 Lovett
8,128,517 B2 3/2012 Blair
8,147,356 B2 4/2012 Campbell et al.
8,206,246 B2 6/2012 Joseph et al.
8,301,277 B2 10/2012 Jones
8,540,560 B2 9/2013 Crowley et al.
8,579,632 B2 11/2013 Crowley
8,617,008 B2 12/2013 Marty et al.
8,727,784 B1 5/2014 Wolf
8,845,460 B1 9/2014 Feldstein
8,845,461 B2 9/2014 Duke
8,852,030 B2 10/2014 Campbell et al.
8,911,308 B2 12/2014 Daniels
9,010,309 B2 4/2015 Lewis et al.
9,017,188 B2 4/2015 Joseph et al.
D739,488 S 9/2015 Campbell et al.
9,199,150 B2 12/2015 Wackerly
9,254,432 B2 2/2016 Ianni et al.
9,275,470 B1 3/2016 Forkosh et al.
9,393,485 B2 7/2016 Sullivan
9,444,306 B2 9/2016 Bradfield
9,452,339 B1 9/2016 Shah et al.
9,474,953 B1 10/2016 Duke
9,569,005 B2 2/2017 Ahmed et al.
9,600,716 B2 3/2017 Skjaerseth et al.
9,656,140 B2 5/2017 Thurman et al.
9,656,142 B2 5/2017 Thurman et al.
9,656,143 B2 5/2017 Thurman et al.
9,687,713 B1 6/2017 Duke
9,724,584 B1 8/2017 Campbell et al.
9,789,392 B1 * 10/2017 Lotzer ..... A63F 13/428
9,808,696 B2 11/2017 Campbell et al.
9,844,704 B2 12/2017 Thurman et al.
9,849,361 B2 12/2017 Coza et al.
9,852,333 B2 12/2017 Lochmann
9,855,481 B2 1/2018 Tuxen et al.
9,901,801 B2 2/2018 Thurman et al.
9,914,035 B2 * 3/2018 Campbell ..... A63B 71/022
9,975,026 B2 * 5/2018 Campbell ..... A63B 69/40
10,004,949 B2 * 6/2018 Brothers ..... G06V 40/28
10,010,778 B2 7/2018 Marty et al.
10,109,061 B2 10/2018 Bose et al.
10,151,831 B2 12/2018 Johnson
10,159,884 B2 12/2018 Thurman et al.
10,159,888 B2 12/2018 Ianni et al.
10,192,360 B2 1/2019 Osawa et al.
10,252,133 B2 * 4/2019 Campbell ..... A63B 47/002
10,315,093 B2 6/2019 Tuxen et al.
10,338,209 B2 7/2019 Johnson
10,338,212 B2 7/2019 Kim et al.
10,343,015 B2 7/2019 Marty et al.
10,360,685 B2 7/2019 Marty et al.
10,379,214 B2 8/2019 Tuxen
10,421,003 B2 9/2019 Leech
10,471,325 B2 11/2019 Marty et al.
10,471,328 B2 11/2019 Tuxen et al.
10,473,778 B2 11/2019 Tuxen
10,489,656 B2 11/2019 Lee et al.
10,500,464 B2 12/2019 Gordon et al.
10,503,965 B2 12/2019 Smith
10,507,369 B2 12/2019 Gordon et al.
10,518,153 B2 12/2019 Joseph et al.
10,537,780 B2 1/2020 Joseph et al.
10,561,916 B1 * 2/2020 Campbell ..... A63B 69/40
10,596,416 B2 3/2020 Forsgren
10,596,436 B1 3/2020 Campbell et al.
10,600,334 B1 3/2020 Zhang et al.
10,605,910 B2 3/2020 Du Toit et al.
10,639,531 B1 5/2020 Mccarter
10,643,492 B2 5/2020 Lee et al.
10,653,337 B2 5/2020 Markison et al.
10,670,706 B2 6/2020 Schwager et al.
10,688,362 B1 * 6/2020 Sangalang ..... A63B 71/0622
10,746,512 B2 8/2020 Howe
10,765,925 B2 9/2020 Coza et al.
10,772,511 B2 9/2020 Sahin et al.
10,775,492 B2 9/2020 Johnson
10,796,448 B2 10/2020 Lee et al.
10,799,759 B2 10/2020 Hixenbaugh et al.
10,828,552 B2 11/2020 Tsai
10,850,179 B2 12/2020 Tuxen et al.
10,861,200 B1 12/2020 Graham
10,885,637 B2 1/2021 Casamona et al.
10,898,757 B1 1/2021 Johansson et al.
10,930,172 B2 2/2021 Zhang et al.
10,940,382 B2 3/2021 Leech
10,962,635 B2 3/2021 Tuxen
10,987,567 B2 4/2021 Cherryhomes et al.
10,989,791 B2 4/2021 Tuxen et al.
10,994,182 B1 5/2021 Campbell et al.
11,016,188 B2 5/2021 Johnson

(56) References Cited

U.S. PATENT DOCUMENTS 11,045,705 B2 6/2021 Zhang
11,083,953 B2 8/2021 Hermandorfer
11,086,005 B2 8/2021 Tuxen
11,086,008 B2 8/2021 Du Toit et al.
11,097,176 B1 8/2021 Campbell et al.
11,103,763 B2 8/2021 Anton et al.
11,130,019 B2 9/2021 Yerli
11,135,495 B2 10/2021 Tuxen et al.
11,135,500 B1 10/2021 Campbell et al.
11,141,642 B2 10/2021 Horne
11,141,645 B2 10/2021 Anton
11,143,754 B2 10/2021 Tuxen
11,154,761 B2 10/2021 Gordon et al.
11,202,951 B1 * 12/2021 Augustin ..... A63B 71/04
11,207,582 B2 12/2021 Lewis et al.
11,210,855 B2 * 12/2021 Kim ..... G06T 7/33
11,227,150 B2 1/2022 Holohan
11,247,108 B2 2/2022 Vollbrecht et al.
11,247,109 B1 2/2022 Campbell et al.
11,285,367 B2 3/2022 Tuxen
11,291,902 B2 4/2022 Tuxen et al.
11,305,174 B2 4/2022 Spivak et al.
11,305,176 B2 4/2022 Moravchik et al.
11,311,789 B2 4/2022 Deleon et al.
11,351,436 B2 6/2022 Hendrix et al.
11,364,426 B2 6/2022 Brown
11,364,428 B2 6/2022 Oh et al.
11,380,100 B2 7/2022 Lee et al.
11,400,355 B1 8/2022 Joseph
11,400,356 B2 8/2022 Leech
11,413,514 B2 * 8/2022 Marty ..... A63B 24/0021
11,446,546 B2 9/2022 Tuxen et al.
11,452,911 B2 9/2022 Tuxen et al.
11,484,760 B2 11/2022 Anton et al.
11,491,382 B2 11/2022 Gordon et al.
11,491,383 B1 11/2022 Campbell et al.
11,497,963 B2 11/2022 Hixenbaugh et al.
11,504,581 B2 11/2022 Beach et al.
11,504,582 B2 11/2022 Johansson et al.
11,577,139 B1 2/2023 Campbell et al.
11,577,146 B1 * 2/2023 Joseph ..... A63B 71/0616
11,583,729 B2 2/2023 Beach et al.
11,590,397 B2 2/2023 Joseph et al.
11,594,029 B2 2/2023 Lee et al.
11,612,799 B1 3/2023 Wang et al.
11,615,540 B2 3/2023 Jayaram et al.
11,619,708 B2 4/2023 Søndergaard et al.
11,638,854 B2 * 5/2023 Zhang ..... A63B 69/0071
700/91
11,642,047 B2 5/2023 Zhang et al.
11,657,906 B2 5/2023 Lewis et al.
11,673,029 B2 6/2023 Tuxen et al.
11,697,046 B2 7/2023 Forsgren
11,701,567 B2 7/2023 Tsai
11,712,610 B1 8/2023 Joseph et al.
11,745,225 B1 9/2023 Amarant et al.
11,747,461 B2 9/2023 Asghar et al.
11,752,417 B2 9/2023 Leech
11,771,954 B2 10/2023 Lee et al.
11,779,809 B1 10/2023 Stroud
11,779,824 B2 10/2023 Spont
11,813,510 B1 11/2023 Campbell et al.
11,828,867 B2 11/2023 Tuxen et al.
11,836,929 B2 12/2023 Marty et al.
11,839,805 B2 12/2023 Young et al.
11,844,990 B2 12/2023 Deleon et al.
11,850,498 B2 12/2023 Okur et al.
11,857,862 B1 1/2024 Lombardi et al.
11,883,716 B2 1/2024 Johansson et al.
11,892,537 B1 2/2024 Fazzini et al.
11,896,884 B2 2/2024 Marty et al.
11,921,190 B2 3/2024 Tuxen
11,931,636 B2 3/2024 Tabuchi et al.
11,938,375 B2 3/2024 Tuxen et al.
11,941,916 B2 3/2024 Lee et al.
11,946,997 B2 4/2024 Tuxen et al.
11,947,002 B2 4/2024 Wang et al.
11,951,373 B2 4/2024 Spivak et al.
11,986,698 B2 5/2024 Tuxen et al.
11,986,699 B1 5/2024 Walker et al.
11,992,728 B2 5/2024 Hixenbaugh et al.
11,998,800 B1 6/2024 Stroud
11,998,820 B2 6/2024 Gordon et al.
11,998,829 B2 6/2024 Lovell et al.
12,017,134 B2 6/2024 Tsai
12,029,960 B1 * 7/2024 Joseph ..... G06F 3/04842
12,048,997 B2 7/2024 Mooney
12,076,632 B1 9/2024 Joseph
12,102,902 B2 10/2024 Wang et al.
12,115,428 B1 10/2024 Anton et al.
12,134,009 B1 11/2024 Joseph
12,161,925 B2 12/2024 Anton et al.
12,172,064 B2 12/2024 Joseph
12,194,357 B1 1/2025 Campbell et al.
2001/0052472 A1 12/2001 Ikeda et al.
2002/0016236 A1 2/2002 Stearns et al.
2002/0072681 A1 6/2002 Schnali
2002/0147404 A1 10/2002 Kato et al.
2003/0073518 A1 4/2003 Marty et al.
2003/0224337 A1 12/2003 Shum et al.
2004/0092840 A1 5/2004 Nakada
2005/0085320 A1 4/2005 Joseph et al.
2005/0115548 A1 6/2005 Wilson
2005/0172943 A1 8/2005 Cucjen et al.
2005/0187036 A1 8/2005 Ziola et al.
2005/0209051 A1 9/2005 Santomassimo et al.
2005/0215870 A1 9/2005 Rademaker
2006/0057549 A1 3/2006 Prinzel, III et al.
2006/0118096 A1 6/2006 Cucjen et al.
2006/0138809 A1 6/2006 Joseph
2006/0160639 A1 7/2006 Klein
2006/0236993 A1 10/2006 Cucjen et al.
2007/0026974 A1 2/2007 Marty et al.
2007/0208544 A1 9/2007 Kulach et al.
2007/0225120 A1 9/2007 Schenk
2007/0265138 A1 11/2007 Ashby
2008/0015061 A1 1/2008 Klein
2008/0171620 A1 7/2008 Feldmeier
2008/0200287 A1 8/2008 Marty et al.
2008/0254866 A1 10/2008 Young et al.
2008/0261726 A1 10/2008 Chipperfleld
2008/0312010 A1 12/2008 Marty et al.
2009/0047645 A1 2/2009 Dibenedetto et al.
2009/0137347 A1 5/2009 Jenkins et al.
2009/0191988 A1 7/2009 Klein
2009/0270743 A1 10/2009 Dugan et al.
2009/0325739 A1 12/2009 Gold
2010/0026809 A1 * 2/2010 Curry ..... H04N 23/698
348/157
2010/0259412 A1 10/2010 Pagonakis
2010/0261557 A1 10/2010 Joseph et al.
2010/0292033 A1 11/2010 Sarver
2011/0084925 A1 4/2011 Baik et al.
2011/0205111 A1 8/2011 Balardeta et al.
2011/0250939 A1 10/2011 Hobler
2011/0275045 A1 * 11/2011 Bhupathi ..... G09B 19/003
434/247
2012/0004055 A1 * 1/2012 Balasubramanyan .....
A63B 47/002
473/459
2012/0015778 A1 1/2012 Lee et al.
2012/0142454 A1 6/2012 Campbell et al.
2012/0309551 A1 12/2012 Holzhacker
2012/0322587 A1 12/2012 Duke
2013/0005512 A1 1/2013 Joseph et al.
2013/0104869 A1 5/2013 Lewis et al.
2013/0104870 A1 5/2013 Rizzo et al.
2013/0157786 A1 6/2013 Joseph et al.
2013/0272393 A1 10/2013 Kirenko et al.
2014/0031703 A1 1/2014 Rayner et al.
2014/0045166 A1 2/2014 Coleman
2014/0081436 A1 3/2014 Crowley et al.
2014/0195019 A1 7/2014 Thurman et al.
2014/0195021 A1 7/2014 Thurman et al.

(56) References Cited

U.S. PATENT DOCUMENTS

2014/0200692 A1 7/2014 Thurman et al.
2014/0222177 A1* 8/2014 Thurman ..... A63B 41/02 700/92
2014/0244012 A1 8/2014 Doherty et al.
2014/0305420 A1 10/2014 Deese
2014/0336796 A1 11/2014 Agnew
2014/0340329 A1 11/2014 Chen
2014/0371885 A1 12/2014 Ianni et al.
2015/0114377 A1 4/2015 Yoo
2015/0131845 A1 5/2015 Forouhar et al.
2015/0196805 A1* 7/2015 Koduri ..... A63B 24/0087 482/6
2015/0201134 A1 7/2015 Carr et al.
2015/0238819 A1 8/2015 Volkerink et al.
2015/0265897 A1 9/2015 Gordon et al.
2015/0306455 A1 10/2015 DeCarlo
2015/0352425 A1 12/2015 Lewis et al.
2016/0001136 A1* 1/2016 King ..... A63B 41/00 320/108
2016/0001158 A1* 1/2016 Tawwater ..... A63B 24/0003 463/3
2016/0098941 A1 4/2016 Kerluke
2016/0217325 A1* 7/2016 Bose ..... G11B 27/17
2016/0250540 A1 9/2016 Joseph et al.
2016/0279498 A1* 9/2016 Gordon ..... A63B 71/0619
2016/0310814 A1 10/2016 Joseph et al.
2016/0314620 A1 10/2016 Reilly et al.
2016/0325166 A1 11/2016 Wallace
2016/0325168 A1* 11/2016 Campbell ..... A63B 69/408
2016/0332054 A1 11/2016 Smith
2017/0095716 A1* 4/2017 Lewis ..... A63B 69/40
2017/0095717 A1* 4/2017 Simonov ..... A63B 69/0053
2017/0144030 A1* 5/2017 King ..... A63B 69/00
2017/0232298 A1* 8/2017 Joseph ..... A63B 69/40 473/433
2017/0252625 A1 9/2017 Campbell et al.
2017/0252626 A1 9/2017 Campbell et al.
2017/0304705 A1* 10/2017 Hermandorfer ... A63B 69/0002
2017/0340943 A1* 11/2017 Pierotti ..... A63B 24/0087
2017/0354845 A1 12/2017 Williams et al.
2018/0085630 A1* 3/2018 Capell ..... G16H 20/30
2018/0139425 A1 5/2018 Mutter et al.
2018/0154212 A1 6/2018 Park et al.
2018/0236338 A1 8/2018 Campbell et al.
2018/0290019 A1 10/2018 Rahimi et al.
2019/0118036 A1 4/2019 Molyneux et al.
2020/0009443 A1* 1/2020 Moravchik ..... G06V 20/64
2020/0047049 A1 2/2020 Ahmed
2020/0114243 A1 4/2020 Janssen
2020/0179755 A1 6/2020 Ristas
2020/0193863 A1 6/2020 Smith
2020/0346095 A1 11/2020 Kubota et al.
2021/0008433 A1 1/2021 Bush
2021/0052961 A1 2/2021 Brody
2021/0064880 A1 3/2021 Zhang et al.
2021/0082473 A1* 3/2021 Masuda ..... G06T 13/40
2021/0093919 A1* 4/2021 Lyke ..... G16H 50/20
2021/0128977 A1 5/2021 Picker
2021/0178244 A1* 6/2021 Okur ..... A63B 24/0006
2021/0286423 A1 9/2021 Correia
2021/0370152 A1* 12/2021 Gordon ..... A63B 71/0669
2022/0080260 A1* 3/2022 Zhang ..... A63B 24/0006
2022/0212077 A1* 7/2022 Anton ..... A63B 69/0071
2023/0110640 A1 4/2023 Kweon et al.
2023/0119793 A1 4/2023 Joseph
2023/0191221 A1 6/2023 Anton et al.
2023/0196770 A1 6/2023 Anton et al.
2023/0206513 A1* 6/2023 Pyles ..... G09G 3/3406 345/592
2023/0302344 A1* 9/2023 Ruppert ..... A63B 71/0622
2025/0186857 A1 6/2025 Titus et al.

OTHER PUBLICATIONS

[No Author Listed] [online], "Incredible 8000 Series Gun Basketball Shooting Machine," Sep. 27, 2010, <https://www.youtube.com/watch?v=eOUTA_k8eW4>, 1 page [Video Submission].
[No Author Listed], "Airborne Athletics, Inc.," Brochure for iMake and Dr. Dish, Airborne Athletics, Inc., Created before 2012, 1 page.
[No Author Listed], "Dr. Dish Owner's Manual," Owner's Manual, Airborne Athletics, Inc., Oct. 2005, 31 pages.
[No Author Listed], "Sniper Program Instructions Help with F1," Program instructions, Sniper, Created Feb. 10, 1995, 18 pages.
[No Author Listed], "Sniper . . . The Ultimate Basketball Trainer," Brochure, Sniper, Created before Oct. 1995, 4 pages.
[No Author Listed], "The All New 8000 Series Gun," Brochure, Shoot-A-Way, Created before Oct. 12, 2011, 12 pages.
[Not Author Listed], "The Shoot Away: The Perfect Shooting Aid," Brochure, Airborne Athletics, Created before Dec. 2, 2011, 1 page.
Reich et al., "A spatial analysis of basketball shot chart data," The American Statistician, Feb. 2006, 60(1):3-12.

* cited by examiner

BASKETBALL TRAINING SYSTEM

CROSS-REFERENCE TO RELATED APPLICATION(S)

This application is a continuation of U.S. patent application Ser. No. 17/970,191, filed Oct. 20, 2022, entitled "BASKETBALL TRAINING SYSTEM", which claims priority to U.S. Provisional Application No. 63/257,795 filed on Oct. 20, 2021, entitled "BASKETBALL TRAINING SYSTEM," the contents of which are both hereby incorporated by reference in their entireties.

BACKGROUND

This disclosure relates generally to sports training, and in particular to basketball return systems with a user interface.

Training in sports involves the development of skills as well as physical conditioning. The game of basketball requires physical strength and conditioning, and also requires special skills. Successful development of those skills requires repetition during practice.

Although it is a team sport, basketball presents opportunities for an individual player to practice and improve his or her game without the need for other players to be present. A player can develop ball handling skills and shooting skills through individual practice.

Basketball players develop their shooting skills by shooting the basketball from various locations on the court. If a second player is not present to rebound, the shooter must rebound his or her own shots. The rebounding process can waste time that could otherwise be used in taking more shots. Over the past several decades, a number of ball collecting devices have been developed to collect basketballs shot at the basketball goal (i.e. the backboard and the attached hoop). The ball collecting devices generally include netting and a frame for supporting the netting around the basketball goal. The ball collecting devices are often used with a ball delivery device, which directs the ball back to the player.

Motorized ball delivery devices can return basketballs to a shooter at various locations on a basketball court. The ball delivery device can have programs that determine which direction to return balls to the player, how many times to return the ball, etc.

Successful shooting of a basketball can be affected by a number of factors, including a player's form or technique in shooting. In some cases, poor form or technique may have less effect when the player is taking uncontested shots from similar distances, but may limit the player's ability to score in game conditions when the player is guarded by another player and often must attempt shots from varying positions on the court having varying distances from the basketball goal.

As players advance in skill and experience, they are often confronted with the realization that the speed of the game gets "faster," and that he or she will need to consistently score under increasing pressure and from various positions on the court. Continuing to practice under conditions that do not effectively simulate the level of movement required of the shooter and the variety of shot locations frequently encountered in game conditions can result in some improvement in the player's shooting, but may ultimately limit the player's success as the player rises through the levels of play from, e.g., junior varsity to varsity, from high school varsity to college, and from college to professional basketball.

SUMMARY

In one example, a basketball training system includes a computer and a ball delivery machine. The computer executes a workout module that manages operation of a graphical user interface that presents a graphical representation of at least a portion of a basketball court and receives user inputs that define a workout program that includes selected ball delivery locations relative to the graphical representation. The ball delivery machine is configured to receive the workout program, and deliver basketballs to the selected ball delivery locations.

In another example, a method includes executing, by a computer, a workout module that manages operation of a graphical user interface that presents a graphical representation of at least a portion of a basketball court. The method further includes receiving, at the graphical user interface, user inputs that define a workout program that includes selected ball delivery locations relative to the graphical representation, and delivering the workout program to a ball delivery machine having a ball collector and a mechanical ball returner for receiving balls from the ball collector and returning balls to a player. The method further includes delivering, by the ball delivery machine, basketballs to the selected ball delivery locations according to the workout program.

In another example, a basketball training system includes a basketball delivery machine, a graphical user interface; and a computer. The computer is configured to manage operation of the graphical user interface to receive user inputs to create a drill; and generate an animated preview of the drill based on the user inputs; display the animated preview of the drill on the graphical user interface; and deliver basketballs to the selected ball delivery locations according to the drill. The basketball delivery machine can be communicatively coupled with the computer to receive the workout program from the computer. The animated preview can include one or more pass locations on the basketball court. The shot location can blink a number of times that corresponds to the number of passes delivered to the pass location. The animated preview can include a number of shots per pass location. The animated preview can include a pass location order that shows the sequence of pass locations.

In some examples, the animated preview includes videos of the selected drill that illustrate one or more shot locations, an order of the shot locations, and a number of shots per shot location. The videos can illustrate a representation of the basketball delivery machine, and the representation of the basketball delivery machine moves to illustrate the direction the basketball delivery machine faces for each shot location. The basketball delivery machine can be configured to communicate with the computer to access the graphical user interface and to provide the user inputs received at a user interface of the basketball delivery machine to the server computer. The user interface of the basketball delivery machine displays the animations of the selected drill before the basketball delivery machine delivers basketballs to the selected delivery locations.

In another example, a method including managing, by a computer, a graphical user interface, receiving, at the graphical user interface, user inputs that select a drill that includes selected ball delivery locations, delivering the drill to a basketball delivery machine having a ball collector and a mechanical ball returner connected to the ball collector for receiving balls from the ball collector and returning balls to a player, generating an animated preview of the drill based on the user inputs, displaying the animated preview of the selected drill on the graphical user interface; and delivering, by the basketball delivery machine, basketballs to the selected ball delivery locations according to the drill.

In another example, a system including a basketball delivery machine, one or more processors, and a computer-readable storage medium coupled to the one or more processors having instructions stored thereon which, when executed by the one or more processors, cause the one or more processors to perform operations. The operations including receiving user inputs for programming a drill, generating a drill preview based on the user inputs for programming the drill, outputting the drill preview to a display, and controlling the basketball delivery machine to execute the drill. The drill preview can be displayed prior to the basketball delivery machine executing the drill. The drill preview can be displayed while the basketball delivery machine executing the drill. Between shots of the drill executed by the basketball delivery machine, the drill preview can illustrate where a user should be for a current shot and where a user should be for a next shot. The drill preview can include animations that demonstrate the drill. The drill preview can include a plurality of icons that move with respect to a representation of a portion of a basketball court. The drill preview can be generated based on meta data from the user inputs for programming the drill. The drill preview can include an animated avatar of the user. The drill preview can be presented from a view looking down on a portion of a basketball court. The drill preview can be presented from a perspective of the user executing the drill. The drill preview can be created as a function of definitions assigned to the drill. The display can be a smart glasses system and wherein the drill preview is outputted on the smart glasses system. The operations can include selecting a non-shooting move animation from a library of non-shooting moves based upon the drill programmed by user inputs, and outputting the non-shooting move animation as part of the drill preview. The drill preview can illustrate passes from the basketball delivery machine to multiple locations. The drill preview can illustrate a pass from the basketball delivery machine to a first location and illustrates movement from the first location to a second location.

In another example, a basketball training system includes a basketball delivery machine having a ball collector and a mechanical ball thrower connected to the ball collector, the basketball delivery machine in data communication with and controlled by a mobile computing device. The ball delivery machine configured to execute a drill to throw basketballs to a user, receive user inputs in real time during the drill from a user interface of the mobile computing device, and deliver basketballs during the drill based at least in part according to the user inputs received in real time during the drill. The user interface can include a moveable control element that slides along a control bar in response to a user input, and the position of the moveable control element on the control bar controls the rotation of the basketball delivery machine to face in a direction that corresponds to the position of the moveable control element. The basketball delivery machine can rotate in real time to face in the direction that corresponds to the position of the moveable control element.

The graphical user interface can present a graphical representation of the basketball delivery machine in the portion of the basketball court, and the graphical representation of the basketball delivery machine rotates in real time to face in the direction that corresponds to the position of the moveable control element. In response to a user input at the pass button, the basketball delivery machine can deliver a basketball in the direction that corresponds to the position of the moveable control element. The moveable control element can slide along a control arc in response to a user input, and the position of the moveable control element on the control arc controls the rotation of the basketball delivery machine to face in a direction that corresponds to the position of the moveable control element. The basketball delivery machine has a shots made sensor that tracks a number of shots that pass through a hoop, and the graphical user interface presents the number of shots made, a number of shots taken, and a field goal percentage. The mobile computing device can be communicably coupled to the basketball delivery machine and geographically separated from the basketball delivery machine. The graphical user interface includes a tempo selection area, the tempo selection area includes a display of a selected tempo, a tempo increase button that increases the tempo of the basketball delivery machine in response to a user input, and a tempo decrease button that decreases the tempo in response to a user input. The drill can be a preprogrammed drill with a plurality of preprogrammed ball delivery locations, wherein the basketball delivery machine is configured to deliver a basketball to a different ball delivery location that is different than the preprogrammed ball delivery location during the drill in response to receiving the user inputs in real time during the drill. The drill can be a preprogrammed drill and wherein the basketball delivery machine is configured change the preprogrammed drill during the drill in response to receiving the user inputs in real time during the drill In another example, a method includes executing a drill to throw balls to a user; receiving user inputs in real time during the drill from a user interface of a mobile device; delivering basketballs during the drill based at least in part according to the user inputs received in real time during the drill.

In another example, a basketball training system includes a basketball delivery machine, a graphical user interface, a computer configured to: manage operation of the graphical user interface to receive user inputs that select at least one or more drill templates that includes ball delivery locations. A basketball delivery machine configured to receive the selected drill template, and deliver basketballs to the selected ball delivery locations. The selected drill template can include preselected ball delivery locations and the graphical user interface receives user inputs that modify the preselected delivery locations to create a custom drill that includes selected ball delivery locations. The basketball delivery machine is configured to receive the custom drill, and deliver basketballs to the selected ball delivery locations.

The basketball delivery machine can be communicatively coupled with the server computer to receive the drill templates from the server computer. The basketball delivery machine is configured to communicate with the server computer to access the graphical user interface and to provide the user inputs received at a user interface of the basketball delivery machine to the server computer. The user interface is configured to receive user inputs relative to the portion of the basketball court that define selected shot locations of the drill that are separate from the selected ball delivery locations. The drill templates comprise a plurality of drill templates, each of the plurality of drill templates including selected ball delivery locations relative to a graphical representation of the portion of the basketball court, and the workout module associates each of a plurality of user accounts with one or more of the plurality of drill templates. The first drill template is associated with a first user account of the plurality of user accounts, the user interface receives user input to access the first user account and select the first drill template associated with the first user account. The user interface can present a selectable custom drill template that receives user inputs that create a custom drill on a blank template that is free of preselected ball delivery locations. The basketball delivery machine is configured to receive the custom drill deliver basketballs to the selected ball delivery locations according to the custom drill. The user interface can present selectable categories, each selectable category including one or more drills.

In another example, a system includes a basketball delivery machine, one or more processors, and a computer-readable storage medium coupled to the one or more processors having instructions stored thereon which, when executed by the one or more processors, cause the one or more processors to perform operations including present a drill template on a user interface, receiving user inputs for customizing the drill template, generating a drill based on the drill template and the user inputs for customizing the drill template, and outputting the drill to the basketball delivery machine to execute the drill. The operations can include presenting a plurality of available drill templates on the user interface, and receiving a selection for the drill template out of the plurality of available drill templates, selecting the drill template out of a plurality of available drill templates as a function of historical user performance. The historical user performance can include sensed shooting percentage. The historical user performance includes identifying one or more drills previously performed.

The operations can include receiving an identification of a recommended drill template; and selecting the drill template out of a plurality of available drill templates as a function of the identification of the recommended drill template. The drill template can be a shooting drill template having a plurality of pre-identified pass locations and wherein the pre-identified pass locations can be changed. The drill template can include at least one non-shooting exercises. The drill template can be a non-shooting drill template that includes no shooting exercises. The operations can include selecting the drill template out of a plurality of available drill templates as a function of voting from a plurality of users, selecting the drill template out of a plurality of available drill templates as a function of time of year, and/or selecting the drill template out of a plurality of available drill templates as a function of voting from a plurality of users. The operations can include present a second drill template on the user interface, receiving user inputs for customizing the second drill template, generating a second drill based on the drill template and the user inputs for customizing the second drill template, and combining the drill and the second drill into a workout.

In another example, a basketball training system includes a computing device comprising one or more processors and computer memory storing instructions that, when executed by the processors, cause the processors to perform operations. The operations include storing performance measures for each of a plurality of users, receiving a request for a requested drill for a particular user, generate a drill for the particular user based on the user based on performance metrics for the user, the drill specifying at least an activity and at least a first parameter that defines a property of the activity. A basketball delivery machine configured to execute the drill for the particular user according to the first parameter, including delivering the basketball for the user in accordance with the drill and measuring the performance of the particular user. The operations further include receiving a report of the performance of the particular user, modifying the performance metrics for the user based on the received report, receiving a second request for a requested drill for the particular user after the performance metrics for the user have been modified, generating a second drill for the particular user based on the modified performance metrics for the user, the drill specifying at least the one activity and at least a second parameter that differs from the first parameter in relation to the difference between the performance metrics and the modified performance metrics. The basketball delivery machine is further configured to execute the second drill for the particular user according to the second parameter such that the second drill has been modified by use of the second parameter to account for change in the skill level of the particular user.

The operations can include classifying each of the plurality of users into one of a plurality of skill groups, generating the first parameter based on the particular user being classified into a first skill group, modifying the performance metrics for the user based on the received report by reclassifying the particular user into a second skill group, and generating the second parameter based on the particular user being classified into the second skill group. The first parameter can be a shot percentage, and the measuring of the performance of the particular user is a record that records a record of the user meeting or failing to meet the shot percentage in the drill. The first parameter can be a number of shots to be taken in the drill and the second parameter is a second number of shots to be taken in the drill that is different than the first number of shots. The ball delivery machine can be configured to deliver the ball a number of times in the drill according based on the parameter used when executing the drill.

In another example, a basketball delivery machine including one or more processors, and a computer-readable storage medium coupled to the one or more processors having instructions stored thereon which, when executed by the one or more processors, cause the one or more processors to perform operations including executing a drill on the basketball delivery machine, evaluating performance of a user performing the drill, and outputting a recommendation based on evaluating the performance of the user. The basketball delivery machine has a shots made sensor that tracks a number of shots that pass through a hoop, and the graphical user interface presents the number of shots made, a number of shots taken, and a field goal percentage. The performance of the one or more users is evaluated based on the number of shots made, the number of shots taken, and the field goal percentage. The performance of the one or more users is evaluated in relation to a threshold of shots made, a threshold of shots taken, and a threshold of field goal percentage. An additional drill is recommended when the performance of the one or more users is below the threshold of field goal percentage, the additional drill having a similar difficulty level to the recommended drill. A more difficult drill is recommended when the performance of the one or more users is above the threshold of field goal percentage.

In another example, a system includes a basketball delivery machine, one or more processors, and a computer-readable storage medium coupled to the one or more processors having instructions stored thereon which, when executed by the one or more processors, cause the one or more processors to perform operations including evaluating performance of a user performing a first drill on the basketball delivery machine, determining a recommended drill as a function of evaluating the performance of the user performing the first drill, and outputting a signal corresponding to the recommended drill.

The operations can include displaying an indication of the recommended drill based upon the signal and/or executing the recommended drill based upon the signal. The performance of the user can be evaluated as a function of sensed data as sensed by one or more sensors during the first drill. The performance of the one or more users can be evaluated in relation to a threshold of shots made, a threshold of shots taken, and a threshold of field goal percentage. The operations can recommend an additional drill when the performance of the one or more users is below the threshold of field goal percentage, the additional drill having a similar difficulty level to the recommended drill. The operations can recommend a more difficult drill when the performance of the one or more users is above the threshold of field goal percentage.

In another example, a basketball training system includes a basketball delivery machine configured to execute a drill, record a video during execution of the drill, and display at least a portion of the video after the drill. The video can include the shooting attempts of a user throughout the drill. The basketball delivery machine further configured to record user performance metrics during execution of the drill. The portion of the video includes the shooting attempts of the user throughout the drill at an increased speed. The performance metrics include a tracked list of shots made and shots missed, and the portion of the video includes an indication while showing each shot attempt whether the shot attempt was a make or a miss.

In another example, a basketball training system includes a basketball delivery machine configured to execute a drill, record a series of pictures of a user during execution of the drill, and display at least a portion of the series of pictures after the drill. The series of pictures includes the shooting attempts of a user throughout the drill. The basketball delivery machine further configured to record user performance metrics during execution of the drill. The portion of the series of pictures includes the shooting attempts of the user throughout the drill. The performance metrics include a tracked list of shots made and shots missed, and the portion of the series of pictures includes an indication while showing each shot attempt whether the shot attempt was a make or a miss.

In another example, a basketball training system includes a basketball delivery machine configured to execute a drill, record user performance metrics during execution of the drill, evaluate the user performance metrics after completion of the drill, and display at least a portion of the user performance metrics after the drill. The user performance metrics include shooting attempts of a user throughout the drill. The user performance metrics include shooting form data for each shot attempt. The performance metrics include a tracked list of shots made and shots missed, and the portion of the user performance metrics includes an indication while showing each shot attempt whether the shot attempt was a make or a miss.

In another example, a method includes delivering, by a basketball delivery machine, basketballs according to a drill, modifying the drill to generate a modified drill based on user inputs received at a graphical user interface while the ball delivery machine is delivering basketballs according to the drill, communicating the modified drill to the ball delivery machine while the basketball delivery machine is still executing the drill, and delivering, by the basketball delivery machine, basketballs according to the modified drill. The user inputs modify at least one of the ball delivery locations of the drill. The user inputs modify an order of the ball delivery locations of the drill. The user inputs modify a tempo of the drill. The modifying the drill can pause the drill. The drill can continue while the modifying occurs until the modified drill is communicated to the ball delivery machine. The drill can be a preprogrammed drill with a plurality of preprogrammed ball delivery locations, wherein the basketball delivery machine is configured to deliver a basketball to a different ball delivery location that is different than the preprogrammed ball delivery location during the drill in response to receiving the user inputs in real time during the drill. The drill can be a preprogrammed drill and wherein the basketball delivery machine is configured change the preprogrammed drill during the drill in response to receiving the user inputs in real time during the drill.

In another example, a system includes a basketball delivery machine, one or more processors, and a computer-readable storage medium coupled to the one or more processors having instructions stored thereon which, when executed by the one or more processors, cause the one or more processors to perform operations that include executing a drill by the basketball delivery machine, and while the basketball delivery machine is executing the drill, modifying the drill based upon user inputs and executing a modified version of the drill. The user inputs can modify at least one of the ball delivery locations of the drill. The user inputs can modify an order of the ball delivery locations of the drill. The user inputs can modify a tempo of the drill. The modifying the drill can pause the drill. The drill can continue while the modifying occurs until the modified drill is communicated to the ball delivery machine. The drill can be a preprogrammed drill with a plurality of preprogrammed ball delivery locations, wherein the basketball delivery machine is configured to deliver a basketball to a different ball delivery location that is different than the preprogrammed ball delivery location during the drill in response to receiving the user inputs in real time during the drill. The drill can be a preprogrammed drill and wherein the basketball delivery machine is configured change the preprogrammed drill during the drill in response to receiving the user inputs in real time during the drill.

In another example, a system includes a plurality of basketball delivery machines, one or more processors, and a computer-readable storage medium coupled to the one or more processors having instructions stored thereon which, when executed by the one or more processors, cause the one or more processors to perform operations that include control operation of each of the plurality of basketball delivery machines in real time. The operations can further include controlling each of the plurality of basketball delivery machines to perform the same drill at the same time. Each of the plurality of basketball delivery machines can be controlled to throw basketballs to a plurality of locations. The operations further include delivering audio and video to each of the plurality of basketball delivery machines in real time. The plurality of basketball delivery machines can be incapable of executing drills without control from a master controller. The master controller can include the one or more processors and the computer-readable storage medium. Each of the plurality of basketball delivery machines can include a controller capable of controlling an individual one of the basketball delivery machines in response to a master controller and also controlling the individual one of the basketball delivery machines independent of control from the master controller.

In another example, a system includes a first basketball delivery machine having a user interface, a plurality of basketball delivery machines, one or more processors, and a computer-readable storage medium coupled to the one or more processors having instructions stored thereon which, when executed by the one or more processors, cause the one or more processors to perform operations including control operation of the plurality of basketball delivery machines as a function of inputs received on the user interface of the first basketball delivery machine. The first basketball delivery machine is configured to operate in an instructor mode while the plurality of the other delivery machines operate in a participant mode, wherein the instructor mode includes operations to send, to basketball delivery machines operating in participant mode, instructions to perform actions to mimic actions of the first basketball delivery machine.

In another example, a system includes a first basketball delivery machine having a user interface, a plurality of basketball delivery machines, one or more processors, and a computer-readable storage medium coupled to the one or more processors having instructions stored thereon which, when executed by the one or more processors, cause the one or more processors to perform operations including receive, at the first basketball delivery machine, statistics sensed by each the plurality of basketball delivery machines performing drills, and displaying, on the user interface of the first basketball delivery machine, the statistics, wherein the statistics are displayed on the user interface of the first basketball delivery machine during the drills.

In another example, a system includes one or more processors and a computer-readable storage medium coupled to the one or more processors having instructions stored thereon which, when executed by the one or more processors, cause the one or more processors to perform operations including control operation of each of a plurality of basketball delivery machines in real time. The operations can include controlling each of the plurality of basketball delivery machines to perform the same drill at the same time. Each of the plurality of basketball delivery machines can be controlled to throw basketballs to a plurality of locations. The operations can include delivering audio and video to each of the plurality of basketball delivery machines in real time. The plurality of basketball delivery machines can be incapable of executing drills without control from a master controller. The master controller can include the one or more processors and the computer-readable storage medium. Each of the plurality of basketball delivery machines can include a controller capable of controlling an individual one of the basketball delivery machines in response to a master controller and also controlling the individual one of the basketball delivery machines independent of control from the master controller.

In another example, a system includes a basketball delivery machine, one or more processors, and a computer-readable storage medium coupled to the one or more processors having instructions stored thereon which, when executed by the one or more processors, cause the one or more processors to perform operations including presenting a user interface having statistics presented on a portion of an image of a basketball court, generating a drill based on user inputs received while presenting the user interface having statistics presented on the portion of the image of the basketball court, and controlling the basketball delivery machine to execute the drill.

In another example, a system includes a basketball delivery machine, one or more processors, and a computer-readable storage medium coupled to the one or more processors having instructions stored thereon which, when executed by the one or more processors, cause the one or more processors to perform operations including presenting a user interface having a slider user input feature, generating a drill based on user inputs received via the slider user input feature, and controlling the basketball delivery machine to execute the drill. The user interface can include an icon representing the basketball delivery machine, wherein the icon rotates in response to sliding the slider input feature. The user interface can include an arrow representing a direction to throw a basketball, wherein the arrow rotates in response to sliding the slider input feature. The user interface can include a first button for identifying a two point shot and a second button for identifying a three point shot. A pass location can be identified as a function of a position of the slider input feature and selection of one of the first or second buttons. A pass location can be identified as a function of a position of the slider input feature. The user interface can include a graphical representation of a portion of a basketball court. The slider input feature can be shaped as a straight line. The slider input feature cam be shaped as an arcuate line, where the user interface further includes a graphical representation of a three point line that is different than the arcuate line. The slider input feature can be visually presented with a virtual knob in a virtual track and configured in the user interface to follow a user's finger when the user places their finger over the virtual knob and moves their finger along the virtual track.

In another example, a system includes a basketball delivery machine, one or more processors, and a computer-readable storage medium coupled to the one or more processors having instructions stored thereon which, when executed by the one or more processors, cause the one or more processors to perform operations including presenting a user interface having a plurality of delivery location buttons that are positioned outside of a representative basketball court, generating a drill based on user inputs received via the delivery location buttons, and controlling the basketball delivery machine to execute the drill. The plurality of delivery location buttons can be user-selectable and add the selected ball delivery locations to the drill based on the user-input. The plurality of delivery location buttons can include at least one of a right baseline button, a right elbow button, a free throw button, a left elbow button, and a left baseline button. The plurality of delivery location buttons can be user-selectable buttons that are not positioned at the ball delivery locations on the representative basketball court.

In another example, a system includes a basketball delivery machine, one or more processors, and a computer-readable storage medium coupled to the one or more processors having instructions stored thereon which, when executed by the one or more processors, cause the one or more processors to perform operations including: presenting a user interface having a moveable ball delivery input feature, generating a drill based on user inputs received via the ball delivery input feature, and controlling the basketball delivery machine to execute the drill. A user can select and move the moveable ball delivery input feature to define ball delivery locations on a representative basketball court. Presenting a moveable shot input feature on the user interface, a user can select and move the moveable shot input feature to define shot locations on a representative basketball court. The shot locations can be different than the ball delivery locations. The operations can include presenting a representation of a portion of a basketball court, and displaying the movable ball delivery input feature at a location not on the representation of the portion of the basketball court. The movable ball delivery input feature can be configured to be dragged from the location not on the representation of the portion of the basketball court to a pass location that is on the representation of the portion of the basketball court to define where the basketball delivery machine is to pass a basketball during the drill. The operations can include presenting a representation of a portion of a basketball court, and displaying the movable shot input feature at a location not on the representation of the portion of the basketball court. The movable shot input feature is configured to be dragged from a location not on the representation of the portion of the basketball court to a shot location that is on the representation of the portion of the basketball court to define where a shot is to happen during the drill.

In another example, a system includes a basketball delivery machine, one or more processors, and a computer-readable storage medium coupled to the one or more processors having instructions stored thereon which, when executed by the one or more processors, cause the one or more processors to perform operations including presenting a user interface having a speech recognition input feature, generating a drill based on user inputs received via the speech recognition input feature, and controlling the basketball delivery machine to execute the drill. The speech recognition input feature is selectable and, when selected, the system receives voice commands from a user that select one or more shot locations. The shot locations can be selected by the user saying a number associated with a location on a representative basketball court that is displayed on the user interface. The selected shot locations can be illustrated on the user interface after the user selects the locations.

DETAILED DESCRIPTION

Figure 1:
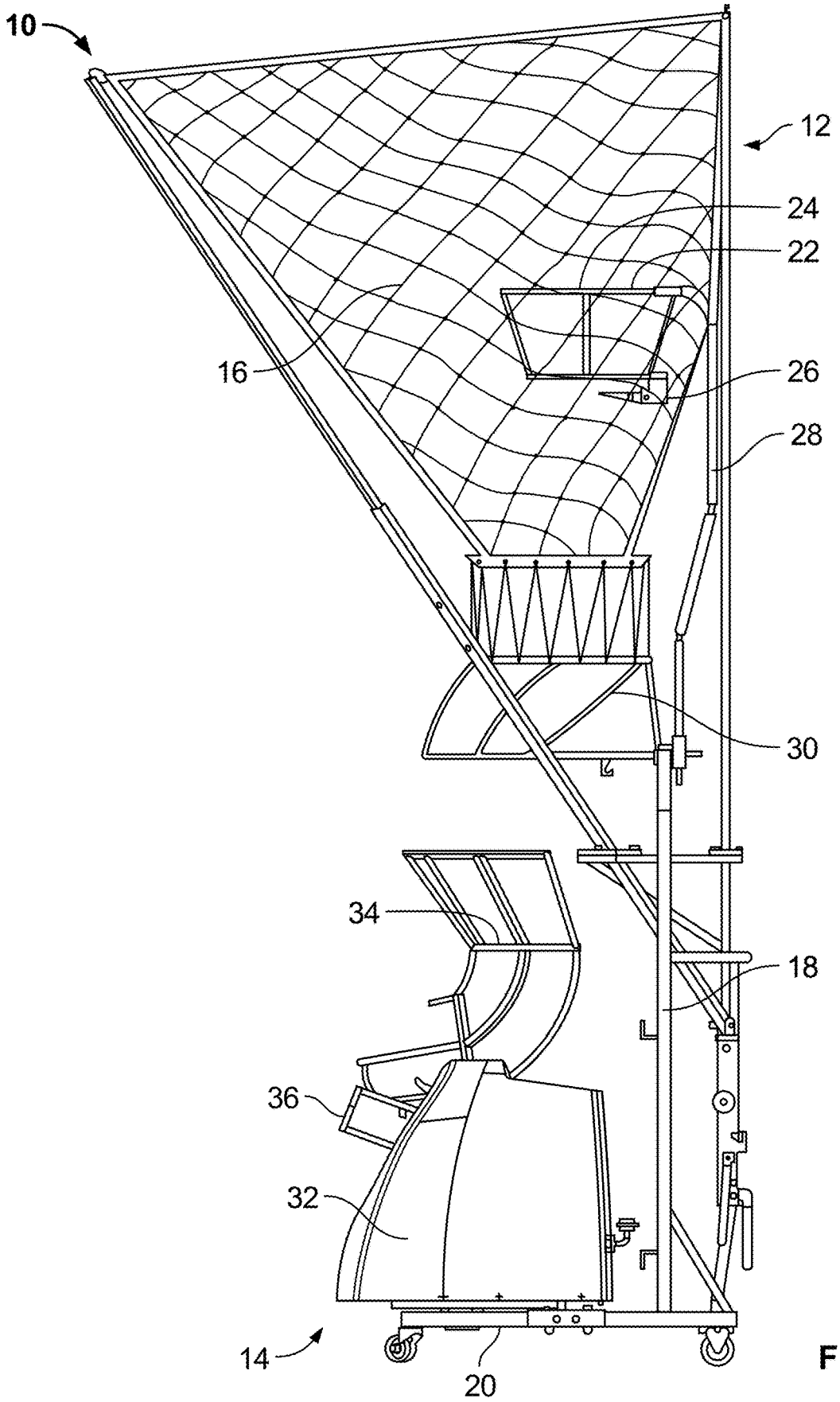
FIG. 1 is a side view of a basketball training machine that includes a ball collection system and a ball delivery system that delivers basketballs to selected ball delivery locations included in a workout program defined via a graphical user interface.

FIG. 1 shows a side view of basketball training machine 10. Basketball training machine 10 includes two main systems, ball collection system 12 and ball delivery system 14. Further description of basketball training machine 10 can be found in patent application Ser. No. 15/148,596, filed on May 6, 2016 and entitled BASKETBALL TRAINING SYSTEM.

Ball collection system 12 includes net 16, net frame 18, base 20, shots made counter 22 (which, in this embodiment, includes made shots funnel 24, shots made sensor 26, and counter support frame 28), and upper ball feeder 30. When machine 10 is used for shooting practice, net 16 is positioned in front of a basketball backboard (not shown) so that the basketball hoop and net (not shown) are immediately above shots made counter 22. The size of net 16 is large enough so that missed shots (which do not go through the basketball hoop and net and through shots made counter 22) will still be collected by net 16 and funneled down to upper ball feeder 30.

Ball delivery system 14 includes ball delivery machine 32, main ball feeder 34, and ball ready holder 36. The inlet of main ball feeder 34 is positioned immediately below the outlet of upper ball feeder 30. Ball delivery machine 32 is pivotally mounted on base 20. Ball delivery machine 32 is pivotable about an axis that is aligned with the inlet of main ball feeder 34 and the outlet of upper ball feeder 30. Balls drop out of upper ball feeder 30 into main ball feeder 34. Balls are delivered one at a time from main ball feeder 34 into ball ready holder 36 at the front of ball delivery machine 32. Launch arm 38 (shown in FIG. 2) launches the basketball out of holder 36 to a location on the floor where the player catches the ball and shoots. The location on the floor where the ball is delivered can be changed by pivoting machine 32 with respect to base 20.

As is further described below, ball delivery system 14 is responsive to a graphical user interface that receives user input to define a workout program that includes selected ball delivery locations desired by a user. The graphical user interface presents graphical control elements that enable user interaction to define the workout program. The graphical user interface can be managed by a server device, communicatively coupled with ball delivery system 14 or a separate computing device, to receive the workout program including machine workout instructions executed by ball delivery system 14 and player workout instructions presented to the user. In some examples, the graphical user interface presents a visual representation of at least a portion of a basketball court that is free of indicia representing predetermined ball delivery locations on the basketball court, such as visual markings, buttons, lights, or other physical or graphically-rendered indications of predetermined ball delivery (or shot) locations. In such examples, the graphical user interface enables a greater range of ball delivery locations and player movement that can help to simulate game-like scenarios and increase an effectiveness of training.

The graphical user interface is configured to receive inputs (e.g., gesture input at a touch-sensitive and/or presence-sensitive device, input from a mouse, keyboard, voice command, or other input) relative to the visual representation of the basketball court that identify the selected ball delivery locations. A control system (shown in FIG. 4) of ball delivery system 14 provides control commands to ball delivery machine 32 to cause ball delivery machine 32 to launch basketballs in directions based upon the selected ball delivery locations. In certain examples, the control system provides control commands to ball delivery machine 32 to cause ball delivery machine 32 to launch basketballs at a ball delivery speed that is determined (e.g., automatically determined by the control system) based on a distance between ball delivery machine 32 and the selected ball delivery location. The control system, in some examples, provides control commands to ball delivery machine 32 to cause ball delivery machine 32 to adjust a trajectory of the delivered balls as they exit ball delivery machine 32 to enable effective ball delivery to locations at both shorter and longer distances from ball delivery machine 32, to enable varying types of passes (e.g., bounce passes, chest passes, lob passes, or other types of passes), and/or to accommodate for player height. As such, ball delivery system 14, responsive to the graphical user interface, enables a user (e.g., a player, coach, administrator, training expert, or other user) to define a workout program via the graphical user interface that is communicated to ball delivery machine 32 for execution and, in certain examples, enables selection of desired ball delivery locations that are not limited by indications of predetermined ball delivery locations. In this way, ball delivery system 14 enables the generation of workout programs by differing users via one or more computing devices that are communicatively coupled with a server device that manages operation of the graphical user interface. While described herein with respect to basketball training machine 10, it should be understood that aspects of basketball training machine 10 can be applied to other ball sports as well. For instance, basketball training machine 10 can deliver volleyballs, soccer balls, or other types of balls for training purposes for such other sports. As such, basketball training machine 10 can be considered, in some examples, as a ball sports training machine.

Figure 2:
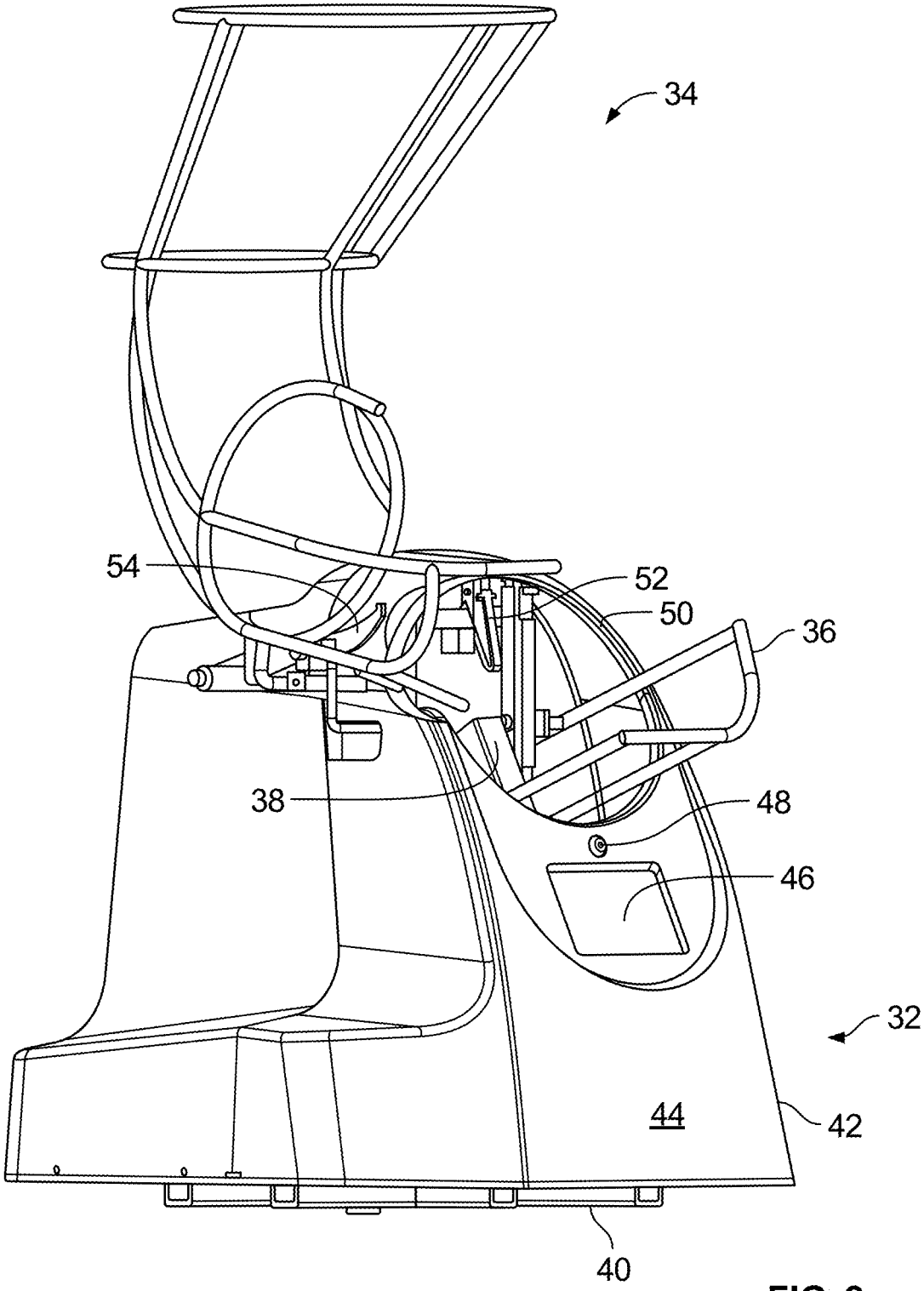
FIG. 2 is a front perspective view of the ball delivery system of FIG. 1.

FIG. 2 is a perspective view of ball delivery system 14 from the front and left of ball delivery machine 32. In this view, ball collection system 12 is not shown. Ball delivery system 14 includes ball delivery machine 32, to which main ball feeder 34 and ball ready holder 36 are mounted. Ball delivery machine 32 includes launch arm 38, bottom platform 40 (which is pivotably mounted to base 20 of ball collection system 12), and outer shell 42 (which encloses the ball launching mechanism and controls that operate machine 32). Front face 44 of outer shell 42 includes electronic front display 46, pre-launch warning light 48 and front opening 50. Also shown in FIG. 2 are ball ready lever 52 and toggle arm 54.

Balls that are collected by ball collection system 12 enter the upper end of main ball feeder 34 and are directed downward and forward to toggle arm 54, which stops further ball movement. When toggle arm 54 is actuated, it pivots to release a single ball to travel further downward and forward into ball ready holder 36. As shown in FIG. 2, ball ready holder 36 slopes downward and rearward through opening 50 into ball delivery machine 32. As the ball rolls down ball ready holder 36 toward launch arm 38, it contacts ball ready lever 52. When ball ready lever 52 is depressed by a ball in ball ready holder 36, it provides a ball ready input signal to the control system of ball delivery machine 32. The ball ready input signal received by the control system causes the control system to initiate a motor driven cycle in which launch arm 38 is engaged and pulled backward while a tension spring is extended. As the cycle continues, launch arm 38 is released and the spring force drives launch arm 38 forward to hit the ball and launch it forward out of ball delivery machine 32 and ball ready holder 36.

Rotation of ball delivery machine 32 relative to base 20 is driven by a gear motor responsive to commands from the control system of ball delivery machine 32 that causes bottom platform 40 to rotate relative to base 20 to cause ball delivery machine 32 to deliver balls, in sequence, to selected ball delivery locations. A direction of rotational movement of bottom platform 40 relative to base 20 is determined and managed by the control system based on an angular distance between sequentially-consecutive ball delivery locations.

In certain examples, one or more portions of ball delivery machine 32 can rotate along a vertical axis of ball delivery machine 32 (i.e., tilt) to adjust a vertical trajectory (i.e., exit angle) of balls delivered out of ball delivery machine 32 and ball ready holder 36. For instance, launching mechanisms of ball delivery machine 32 (e.g., including launch arm 38 and ball ready holder 36) can be pivotally mounted to tilt within ball delivery machine 32 relative to the vertical axis of ball delivery machine 32. Trajectories of delivered balls can be controlled (e.g., via tilt commands from a control system) to account for a distance between ball delivery machine 32 and a selected ball delivery location. For instance, a higher trajectory having a larger arc (e.g., a larger vertical angle of exit trajectory with respect to a horizontal axis extending along base 40) can be determined (and ball delivery machine 32 vertically rotated to provide such trajectory) for longer distances between ball delivery machine 32 and a selected ball delivery location. Similarly, a lower trajectory having a smaller arc (e.g., a smaller vertical angle of exit trajectory with respect to the horizontal axis extending along base 40) can be determined for shorter distances between ball delivery machine 32 and a selected ball delivery location. The trajectory can be determined based on both the ball delivery speed and a selected ball delivery height. As such, ball delivery machine 32 can control ball delivery speed in conjunction with the trajectory of ball delivery to deliver balls to account for varying distances between different selected ball delivery locations and a position of ball delivery machine 32.

In certain examples, a trajectory (i.e., exit angle) of balls launched from ball delivery machine 32 can be determined (or user selected) to account for user height. For instance, a higher trajectory having a larger exit angle with respect to the horizontal axis extending along base 40 (or the ground) can be selected to deliver balls to, e.g., taller users to enable such users to catch the ball at an elevation that is between the user's waist and the user's head. Similarly, a lower trajectory having a smaller exit angle with respect to the horizontal axis can be selected to delivery balls to, e.g., shorter users to enable such users to catch the ball at an elevation that is between the shorter user's waist and head. In certain examples, the trajectory of balls launched from ball delivery machine 32 can be determined (or user selected) to provide a type of pass, such as a bounce pass configured to bounce the ball prior to reaching the ball delivery location, a lob pass configured to have a large arcing trajectory toward the ball delivery location, or other types of passes. Indications of user selected height and/or type of pass can be received at a user interface operatively connected to the controller, as is further described below.

Accordingly, ball delivery machine 32 can be controlled (e.g., by a control system) to pivot both horizontally to deliver balls to a plurality of selected ball delivery locations and vertically (i.e., tilt) to adjust the trajectory of the delivered balls. As such, ball delivery machine 32 can be automatically controlled to enable training of game-like scenarios where a user may receive passes at varying locations and distances on the court as well as varying types of passes (e.g., chest passes, bounce passes, lob passes, or other types of passes) and passes having varying delivery speeds and delivery elevations. Ball delivery machine 32, therefore, can help to better simulate such game-like scenarios than a ball delivery machine that is limited to, e.g., fixed trajectories and ball delivery speeds at predetermined ball delivery locations, such as at locations spaced around the three-point line.

Figure 3:
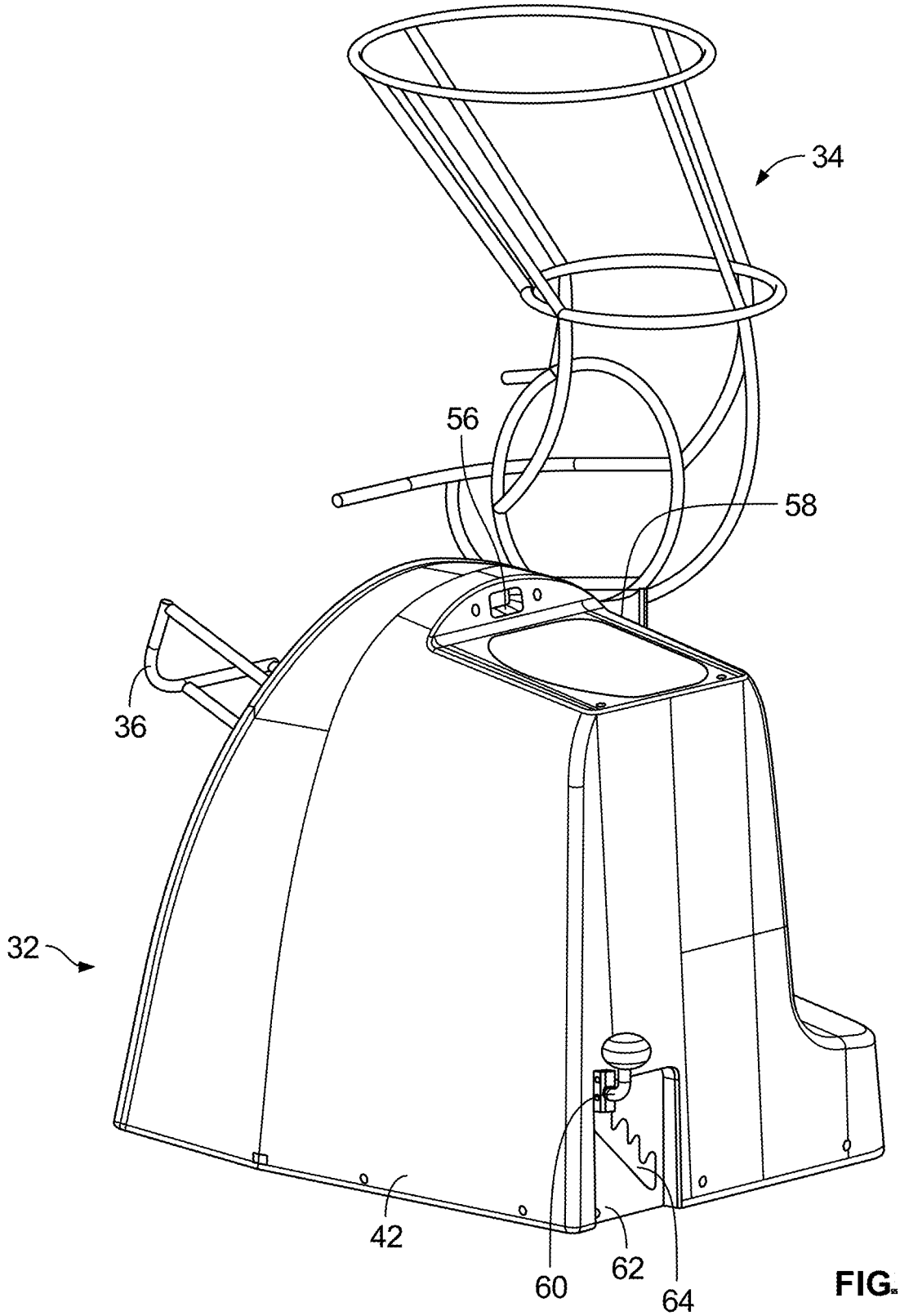
FIG. 3 is a rear perspective view of the ball delivery system of FIG. 1.

FIG. 3 is a perspective view of ball delivery system 14 from the rear and right of ball delivery machine 32. At the top of shell 42 are Universal Serial Bus (USB) port 56 and console 58, which allow a user to input information and select operating modes of ball delivery machine 32, and to receive outputs including data collected by machine as well as menus, instructions, and prompts. In some examples, ball delivery machine 32 may not include console 58 and/or USB port 56. Rather, in such examples, ball delivery machine 32 may receive and output information via a communication device (e.g., one or more wired and/or wireless transceivers) operatively coupled to one or more remote computing devices, such as mobile phones (including smartphones), personal digital assistants (PDAs), tablet computers, laptop computers, desktop computers, server systems, mainframes, or other remote computing devices.

As illustrated in FIG. 3, at the rear of ball delivery machine 32 are ball distance adjustment knob 60 and ball distance pre-select plate 62. Knob 60 and plate 62 are used, in some examples, to change the spring tension or preload on the spring that drives launch arm 38. The greater the preload, the further the distance the ball will be driven by launch arm 38 when it is released. In the embodiment shown in FIG. 3, plate 62 contains notched track 64, which includes five notches at which the tension rod connected to adjustment knob 60 can be positioned. The notched track 64 can be vertical or diagonal. The lower the position of knob 60, the greater the preload and the farther the ball will be launched.

In some examples, a delivery speed of balls driven by launch arm 38 (i.e., a speed at which launch arm 38 propels balls out of ball delivery machine 32) is set by a ball delivery speed adjustment actuator (shown in FIG. 4) controlled by the control system of ball delivery machine 32. For example, the ball delivery speed adjustment actuator can adjust a tension of the spring (or other tensioning element) that drives launch arm 38 forward to hit the ball and launch it forward out of ball delivery machine 32. In certain examples, the ball delivery speed adjustment actuator adjusts a drawback distance by which launch arm 38 is pulled backward to modify the spring tension utilized to propel launch arm 38 forward to hit the ball. In other examples, launch arm 38 is not propelled forward by a tensioning element, but rather is motor driven to propel launch arm 38 forward at a speed corresponding to a determined ball delivery speed.

The ball delivery speed can be determined by the control system based on a distance between ball delivery machine 32 and a ball delivery location. For example, the control system can determine a physical distance between ball delivery machine 32 and one or more selected ball delivery locations based on a relative distance between graphically-rendered locations of ball delivery machine 32 and the one or more selected ball delivery locations on a visual representation of at least a portion of a basketball court, as is further described below. The control system can determine the ball delivery speed based on (e.g., proportional to) the determined physical distances.

In some examples, the control system can modify the ball delivery speed for each selected ball delivery location. In other examples, the control system can determine the ball delivery speed for groups of selected ball delivery locations within threshold distances from ball delivery machine 32. In yet other examples, the control system can determine a single ball delivery speed based on an average of the distances between ball delivery machine 32 and each of the ball delivery locations, a maximum of the distances, a minimum of the distances, or other aggregations of the distances between ball delivery machine 32 and the selected ball delivery locations. In some examples, the control system may not modify the ball delivery speed. Rather, in such examples, the ball delivery speed may be manually adjusted via ball distance adjustment knob 60 (and ball distance pre-select plate 62).

Figure 4:
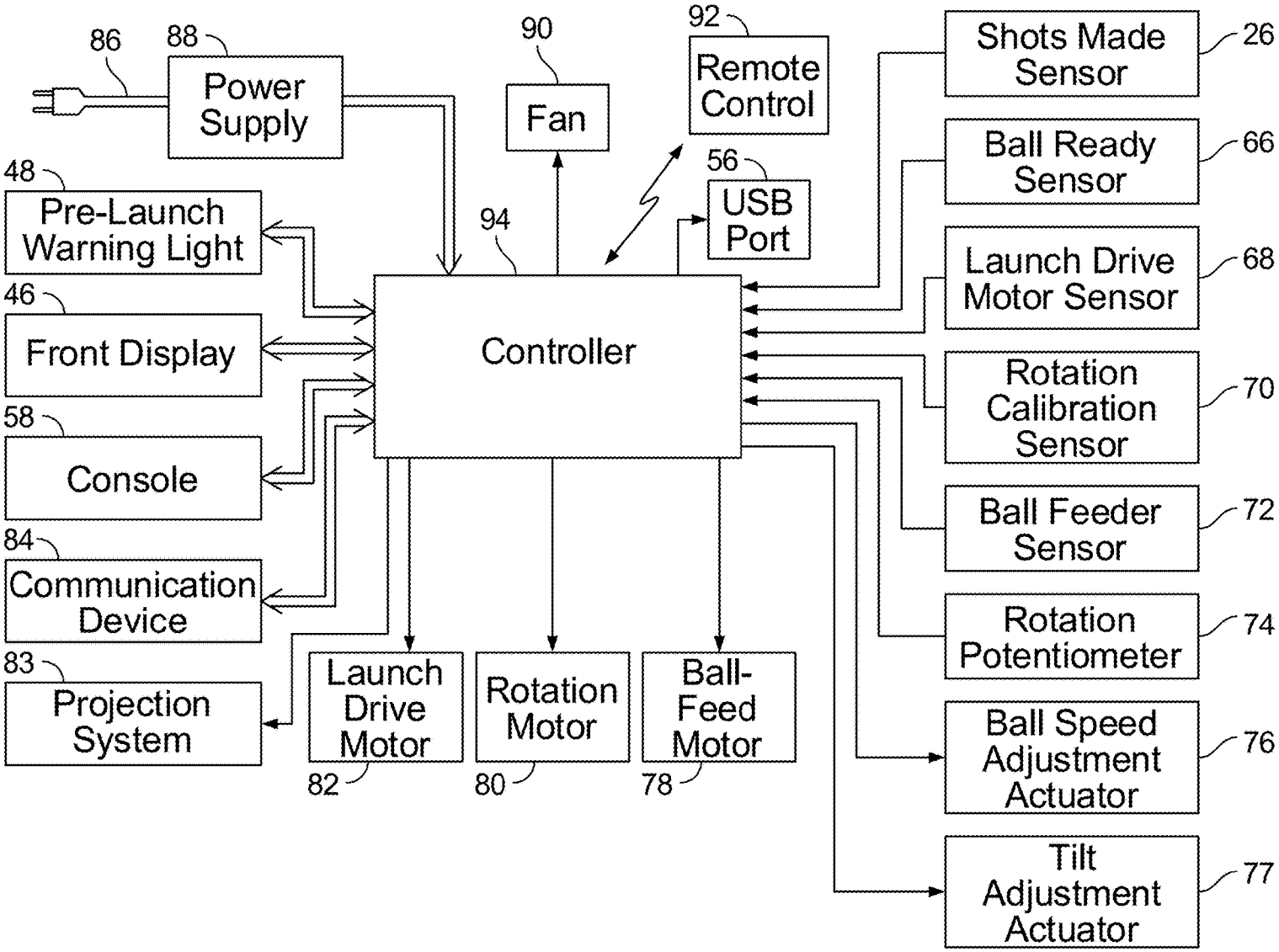
FIG. 4 is a block diagram of the control system of the ball delivery system.

FIG. 4 is a block diagram of the control system of the ball delivery system 14. Shown in FIG. 4 are shots made sensor 26, front display 46, pre-launch warning light 48, USB port 56, console 58, ball ready sensor 66, launch drive motor sensor 68, rotation calibration sensor 70, ball feed sensor 72, rotation potentiometer 74, ball speed adjustment actuator 76, tilt adjustment actuator 77, ball feeder toggle motor 78, rotation motor 80, launch drive motor 82, projection system 83, communication device 84, AC cable 86, power supply 88, fan 90, remote control 92, and controller 94.

Controller 94 is a processor-based controller that coordinates the operation of components of the control system. Controller 94 includes one or more processors and computer-readable memory encoded with instructions that, when executed by the one or more processors, cause controller 94 to operate in accordance with techniques described herein. Examples of one or more processors of controller 94 can include any one or more of a microprocessor, a controller, a digital signal processor (DSP), an application specific integrated circuit (ASIC), a field-programmable gate array (FPGA), or other equivalent discrete or integrated logic circuitry.

Computer-readable memory of controller 94 can be configured to store information within controller 94 during operation. Computer-readable memory of controller 94, in some examples, is described as computer-readable storage media. In some examples, a computer-readable storage medium can include a non-transitory medium. The term "non-transitory" can indicate that the storage medium is not embodied in a carrier wave or a propagated signal. In certain examples, a non-transitory storage medium can store data that can, over time, change (e.g., in RAM or cache). In some examples, the computer-readable memory is a temporary memory, meaning that a primary purpose of the computer-readable memory is not long-term storage. Computer-readable memory, in some examples, includes volatile memory that does not maintain stored contents when electrical power to controller 94 is removed. Examples of volatile memories can include random access memories (RAM), dynamic random access memories (DRAM), static random access memories (SRAM), and other forms of volatile memories. In some examples, computer-readable memory of controller 94 is used to store program instructions for execution by the one or more processors of controller 94. For instance, computer-readable memory of controller 94, in some examples, is used by software or applications running on controller 94 to temporarily store information during program execution.

Computer-readable memory of controller 94, in some examples, also includes one or more computer-readable storage media that can be configured to store larger amounts of information than volatile memory. In some examples, computer-readable memory of controller 94 includes non-volatile storage elements. Examples of such non-volatile storage elements can include magnetic hard discs, optical discs, floppy discs, flash memories, or forms of electrically programmable memories (EPROM) or electrically erasable and programmable (EEPROM) memories.

Sensors 26, 66, 68, and 72 are used by controller 94 in coordinating and controller the operation of motors 78, 80, 82, as well as ball speed adjustment actuator 76 and tilt adjustment actuator 77. Calibration sensors 70 are used by controller 94 during setup to provide calibration of the signal from potentiometer 74, which is used to determine the rotational position of ball delivery machine 32.

Controller 94 utilizes communication device(s) 84 to communicate with external devices via one or more wired or wireless communication networks, or both. Communication device(s) 84 can include any one or more communication devices, such as network interface cards (e.g., Ethernet cards), optical transceivers, radio frequency transceivers, Bluetooth transceivers, 3G or 4G transceivers, and WiFi radio computing devices.

In operation, controller 94 communicates with, e.g., a remote computing device to receive a workout program including indications of positions of selected ball delivery locations, ball delivery timing (e.g., tempo) information, a number of balls delivered per location, a type of pass (e.g., chest pass, bounce pass, lob pass, or other type of pass), a selected ball delivery height, and position information of ball delivery machine 32 relative to a visual representation of at least a portion of a basketball court presented by a graphical user interface executed by, e.g., a remote server device. As is further described below, controller 94 controls operation of components of the control system, such as ball speed adjustment actuator 76, tilt adjustment actuator 77, ball feeder toggle motor 78, rotation motor 80, and launch drive motor 82 to deliver balls to the selected ball delivery locations according to the received information. In certain examples, controller 94 controls operation of projection system 83 to project optical indications on the basketball court. For example, projection system 83 can include one or more light sources (e.g., LEDs, halogen or incandescent light bulbs, or other light sources) configured to be angularly controlled to emit visible light at locations and/or patterns on the basketball court. The one or more light sources can be colored light sources (or controllable to emit a determined light color). Controller 94 can control operation of projection system 83 to project optical indications, such as colored or uncolored light spots on the basketball court to visually indicate, e.g., one or more of a next selected ball delivery location, a next user shot location, or other indications, as is further described below.

As such, controller 94 controls operation of components of the control system of ball delivery machine 32 to deliver balls to selected ball delivery locations according to, e.g., user instructions received via a graphical user interface that presents a visual representation of at least a portion of a basketball court.

Figure 5:
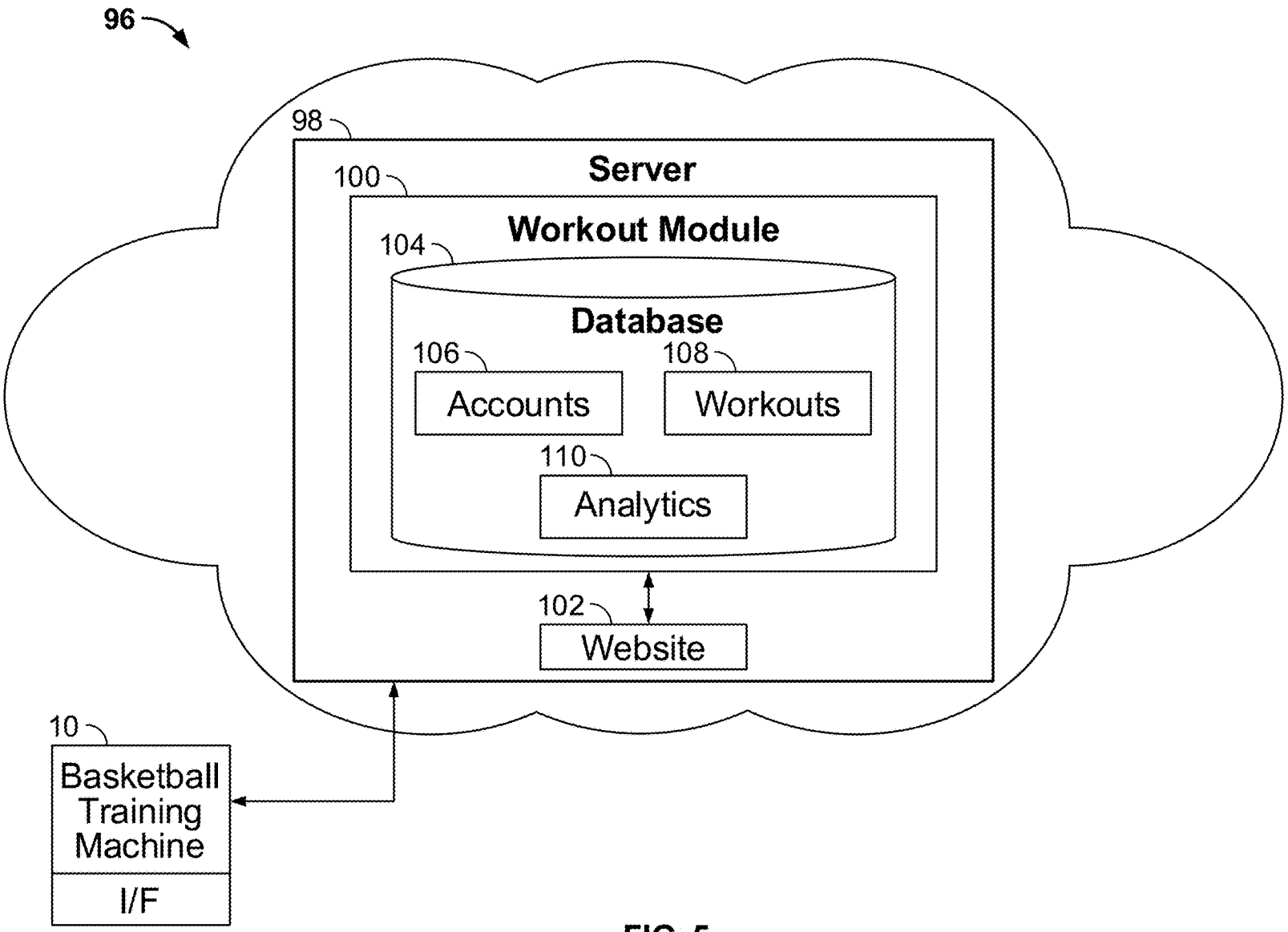
FIG. 5 is a block diagram of a basketball training system that includes a basketball training machine communicatively coupled with a server that executes a workout module to generate a workout program executed by the basketball training machine.

FIG. 5 is a block diagram of basketball training system 96 that includes basketball training machine 10 communicatively coupled with server 98 that executes workout module 100 to generate a workout program executed by basketball training machine 10. As illustrated in FIG. 5, server 98 includes workout module 100 and website 102. Workout module 100 includes database 104, which includes accounts 106, workouts 108, and analytics 110.

Server 98, as illustrated in FIG. 5, can be a cloud-based or otherwise remote server computer including one or more processors and computer-readable memory encoded with instructions that, when executed by the one or more processors, cause server 98 to execute workout module 100 and website 102 according to techniques described herein. Examples of server 98 include, but are not limited to, mainframe computers, desktop computers, laptop computers, or other computing devices capable of implementing workout module 100 and managing operation of (e.g., serving of) website 102. In some examples, rather than a single server device, server 98 may be implemented as a server system including a plurality of interconnected server computers that distribute functionality attributed herein to server 98 among the multiple server computers. For instance, in certain examples, server 98 can be implemented as a server system including a first server computer that executes workout module 100 and a second server computer that executes (e.g., serves) website 102. Similarly, while database 104 is illustrated as included in workout module 100 of server 98, database 104 can include any one or more databases that may be local to server 98 or distributed among any one or more server devices operatively connected to server 98.

Database 104 can be a relational database, hierarchical database, multidimensional database, or other type of database capable of storing information in an organized manner for later retrieval by, e.g., workout module 100 and/or website 102. Database 104, as illustrated in FIG. 5, includes accounts 106. Accounts 106 represents account information stored within database 104 and associated with one or more user accounts managed by, e.g., an administrative entity of server 98 (e.g., a manufacturer of basketball training machine 10, a workout programs supplier, or other administrative entity). Accounts 106 includes identity information associated with each of a plurality of user accounts. Identity information includes a unique identifier of the user account (e.g., a user name, user identification number, or other unique identifier), a user passcode (e.g., password, numerical passcode, or alphanumeric passcode including both textual and numerical characters), or other information uniquely associating a user with a corresponding account stored in accounts 106. Accounts 106, in certain examples, includes account parameters for each of the plurality of accounts. Examples of such account parameters include a user skill level, such as middle school player skill level, high school player skill level, collegiate player skill level, professional player skill level, or other skill levels.

In certain examples, accounts 106 associates any one or more of the plurality of accounts with one or more account groups. Account groups are groupings of individual accounts that may be commonly associated via e.g., a team, a school, a peer group, or other common association. For instance, account groups can include team accounts, school accounts, trainer group accounts, coach group accounts, or other group accounts. Accounts 106 can associate individual user accounts with any one or more account groups. For instance, accounts 106 can simultaneously associate a particular user account with one of a plurality of school account groups, one of a plurality of team account groups, and one of a plurality of skill level account groups. Account groups of accounts 106 can be hierarchical in nature, such that account groups can be associated with one or more higher level parent (or other ancestral) account groups and/or one or more child (or other descendant) accounts (or account groups). For instance, each team account group can be hierarchically related as a child account group of a school account group that represents the parent account group to the team account group. Similarly, member accounts (or account groups) of the team account group can be considered child accounts (or account groups) of the team account, and therefore hierarchically related to each of the ancestral team account group and school account groups. As such, user accounts and account groups can be affiliated via ancestral and descendant relationships to provide a hierarchical relationship of user accounts and/or account groups.

Workouts 108 store workout programs that include machine workout instructions that are executed by basketball training machine 10 to deliver basketballs to selected ball delivery locations as well as player workout instructions that represent player activity (e.g., player movement, skill development activities such as dribbling or other ball handling maneuvers, exercise activities such as pushups or sit-ups, or other player activity). Workouts 108 are associated with attributes, such as a workout skill level, workout intensity level, workout time, workout type (e.g., offensive skills development, long range shooting development, short range shooting development, free throw shooting development, agility development, strength development, ball handling development, physical conditioning development, or other workout type), or other attributes. Attributes of workout programs included in workouts 108 can indicate whether a particular workout program (or grouping of workout programs included in, e.g., a workout library) is user-modifiable. For instance, a workout program can be specified (e.g., during creation) as non-modifiable. Non-modifiable workout programs can be executed by players at basketball training machine 10 but not modified by the player prior to execution, thereby providing a common workout program that can be executed (without modification) by multiple players associated with multiple user accounts to enable benchmarking or other comparisons of player skill and/or conditioning, as is further described below.

Workout programs stored at workouts 108 can be associated with any one or more accounts and/or account groups stored in database 104 at accounts 106. For instance, a particular workout program can be associated with (e.g., assigned to) an account group corresponding to a team, and therefore also associated with each individual user account that is a member of the team account group through the hierarchical relationship between the parent team account group and the child user accounts. Workout programs stored at workouts 108 can be associated with a single account of accounts 106 or multiple accounts of accounts 106. As such, workout programs can be generated and stored at workouts 108 of database 104 and utilized by a single user account or shared between multiple user accounts or account groups.

Analytics 110 of database 104 store analytics data (e.g., statistics) associated with any one or more accounts stored at accounts 106 and/or workout programs stored at workouts 108. Examples of analytics data include shooting percentage data, a number of attempted shots, a usage time of basketball training machine 10, user heart rate data during any one or more workout programs (e.g., sensed by a heart rate monitor or other physical monitoring device worn by a player during a workout program), shooting percentage relative to heart rate, movement, position on the basketball court, or other analytics data. Analytics data stored at analytics 110 of database 104 can be associated with a workout program, such that each user account that executes a particular workout program contributes to shared analytics corresponding to the executed workout program. In general, analytics 110 can store any statistical or other analytical data that corresponds to user accounts, user account groups (e.g., team account groups), and workout programs to enable comparison of performance between user accounts, between user accounts and benchmark performance criteria, between time-separated performances of a single user account (or account group), or other comparisons. As such, analytics data stored at analytics 110 can enable a coach, player, or other user to track performance of a single player or group of players over time, to compare performances between players or groups of players, and to track progress of skill development and conditioning of players or groups of players.

As illustrated in FIG. 5, server 98 executes website 102, though in other examples website 102 can be executed by a separate computing device, such as a dedicated web server device. Website 102 is communicatively coupled with workout module 100 to provide a user interface that enables user interaction with workout module 100 to create and select workout programs and view analytics data stored at database 104, as is further described below.

Basketball training machine 10 is communicatively coupled with server 98 to access website 102 via any one or more wired or wireless communication networks, such as a cellular communication network, local area network (LAN), wide area network (WAN) such as the Internet, wireless LAN (WLAN), or other type of communication network. Basketball training machine 10, as illustrated in FIG. 5, includes an interface (illustrated as I/F), such as console 58, a touchscreen interface, a keyboard and/or mouse interface, or other type of interface to enable user interaction with website 102 to create a workout program and/or select a workout program stored at workouts 108 for execution by basketball training machine 10.

In operation, a user accesses website 102 via the interface of basketball training machine 10 to select a workout program stored at workouts 108 and/or create a new workout program via the interface provided by website 102 and managed by workout module 100. Server 98 transmits the selected or created workout program to basketball training machine 10. The workout program includes both machine workout instructions for execution by basketball training machine 10 and player workout instructions representing player activity during workout program. Basketball training machine 10 executes the machine workout instructions by delivering basketballs to identified ball delivery locations at a selected tempo (i.e., relative timing) and tracking made and missed shots via shots made sensor 26. Basketball training machine 10 presents the player instructions for review prior to execution of the workout program and, in certain examples, presents the player instructions during execution of the workout program via a display, speakers, or other output device. Results of the workout program corresponding to made and missed shots, duration of one or more portions of the workout program, or other analytics data can be transmitted by basketball training machine 10 to workout module 100 of server 98 via website 102 (e.g., automatically transmitted or transmitted in response to user input to upload the results to server 98). Accordingly, system 96 enables a user to select one or more workout programs stored at workouts 108 of database 104, create a new workout program that can optionally be stored in workouts 108, and execute the workout program to enable effective training for the player.

Figure 6:
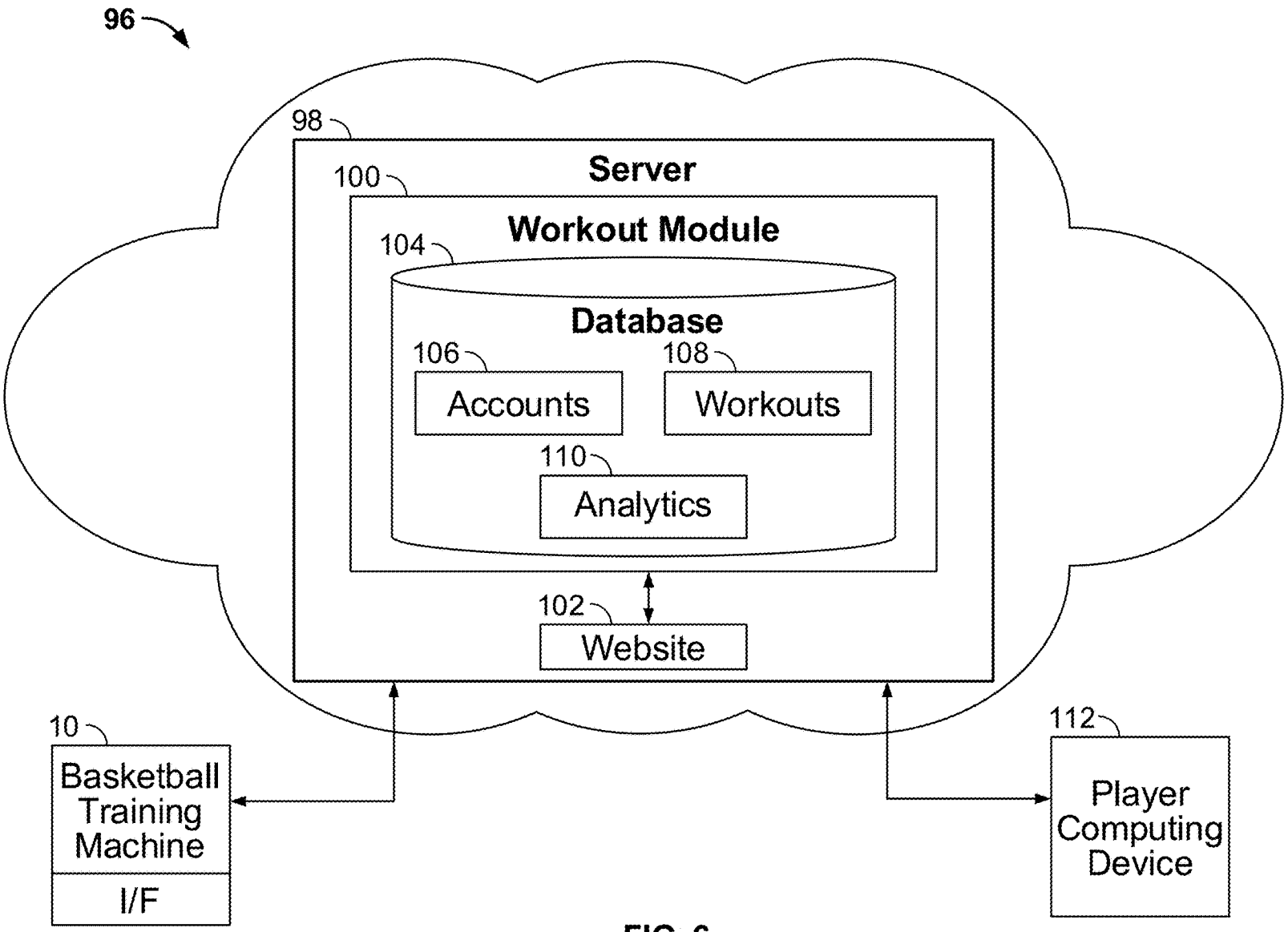
FIG. 6 is a block diagram of another embodiment of the basketball training system including the basketball training machine and a player computing device, each communicatively coupled with the server.

FIG. 6 is a block diagram of another embodiment of basketball training system 96 including basketball training machine 10 and player computing device 112, each communicatively coupled with server 98. That is, in the example of FIG. 6, basketball training system 96 also includes player computing device 112 that is communicatively coupled with server 98 via one or more wired or wireless communication networks, or both. Examples of player computing device 112 include tablet computers, mobile phones (including smartphones), laptop computers, wearable devices such as smartwatches, or other computing devices that can communicate with server 98 to interface with workout module 100. For instance, player computing device 112 can interface with workout module 100 by accessing website 102 via, e.g., the Internet. In some examples, player computing device 112 executes a software application (often referred to as an app) that establishes a communicative connection with server 98 via website 102 or other separate communicative connection and presents a graphical user interface to enable user interaction with workout module 100 to select a workout program stored at workouts 108 of database 104 and/or create a workout program for execution by basketball training machine 10. Though basketball training machine 10 is illustrated in the example of FIG. 6 as including an interface (I/F), basketball training machine 10 need not include a user interface in all examples. For instance, as in the example of FIG. 6, player computing device 112 can serve as the user interface enabling interaction of the player with server 98 and basketball training machine 10.

In operation, a player utilizes player computing device 112 (e.g., a smartphone) to execute an application (e.g., an app) that interfaces with workout module 100 or to access website 102 via a web browser that presents a graphical user interface managed by workout module 100. The graphical user interface presents a login screen that enables the player to provide account login information, such as username and passcode. Workout module 100 accesses the account stored in accounts 106 associated with the login information (or enables the player to create a new account) and presents the user with graphical control elements to either select a workout program stored at workouts 108 of database 104 or create a new workout program, as is further described below.

In response to receiving a selection via player computing device 112 of a stored workout program or creation of a new workout program, server 98 transmits the selected or created workout program including the machine workout instructions and the player workout instructions to basketball training machine 10 via, e.g., website 102 or a separate communicative connection between server 98 and basketball training machine 10. Basketball training machine 10 executes the workout program and generates analytics data in the form of workout results (e.g., made and missed shots, workout timing, or other results) and transmits the results to server 98. Server 98 transmits the results to player computing device 112 which presents the results to the player via a display or other output device of player computing device 112. In some examples, workout module 100 can automatically store the workout results at analytics 110 of database 104 and associate the results with the corresponding user account in accounts 106. In other examples, workout module 100 can store the workout results only in response to received user input via the graphical user interface provided at player computing device 112 to store (e.g., upload) the results to server 98. Accordingly, player computing device 112 can provide a graphical user interface and communication connection that enables user interaction with basketball training machine 10 via server 98. In addition, player computing device 112 can enable player interaction with server 98 to upload results, view and/or create workout programs, or otherwise interact with server 98 whenever player computing device 112 has a communicative connection with server 98 (e.g., via an Internet connection), thereby enabling player interaction from locations that may be remote from basketball training machine 10.

Figure 7:
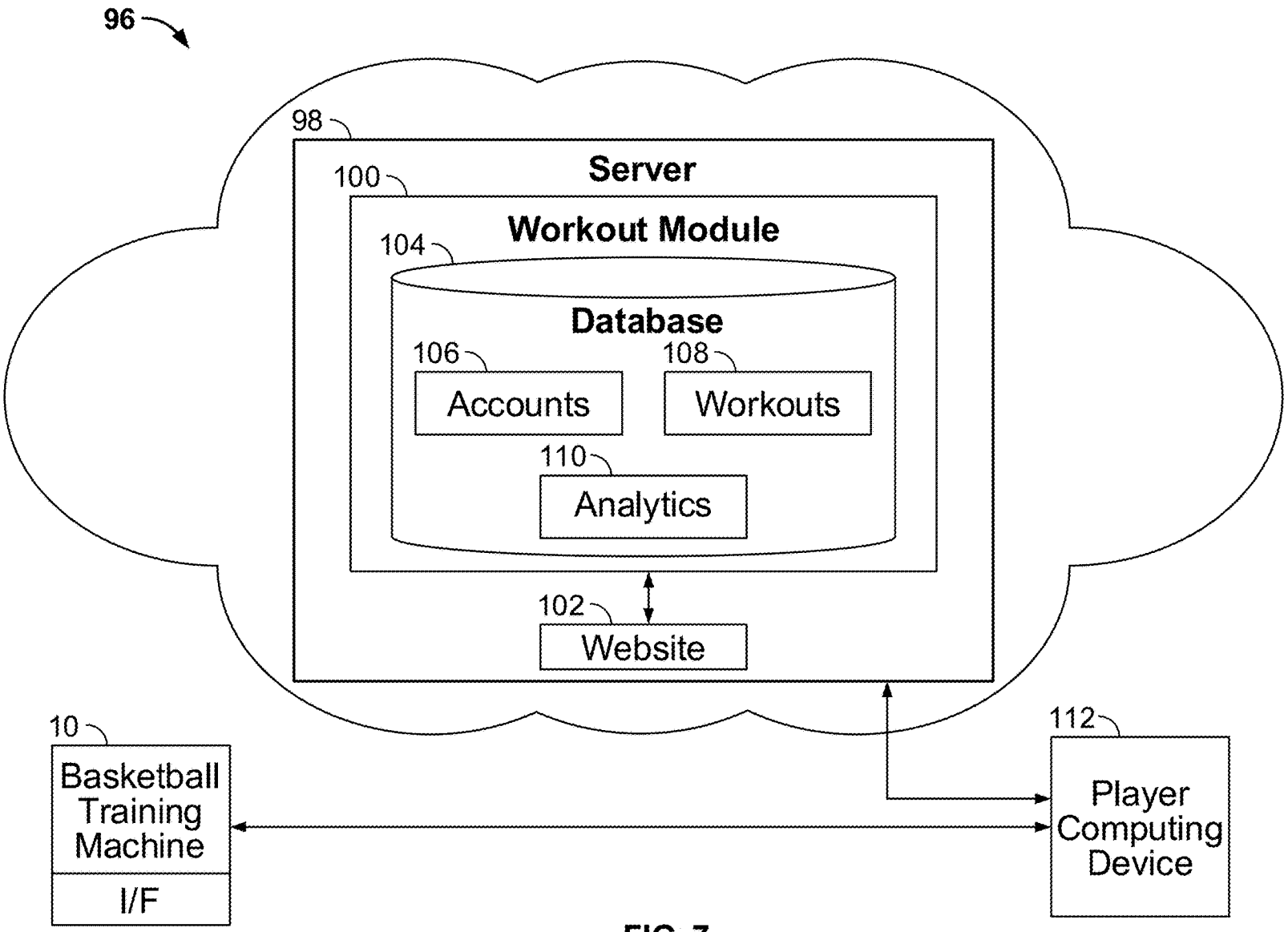
FIG. 7 is a block diagram of another embodiment of the basketball training system including the player computing device communicatively coupled with the server and the basketball training machine communicatively coupled with the player computing device.

FIG. 7 is a block diagram of another embodiment of basketball training system 96 including player computing device 112 communicatively coupled with server 98 and basketball training machine 10 communicatively coupled with player computing device 112. That is, in the example of FIG. 7, basketball training machine 10 is not directly connected to server 98, but rather is directly connected to player computing device 112 via a wired and/or wireless network connection. For instance, player computing device 112 can connect with basketball training machine 10 via a wireless Bluetooth connection, LAN connection, WLAN connection, or other communicative connection.

In the example of FIG. 7, player computing device 112 enables user interaction with server 98 to select a workout program and/or create a new workout program via, e.g., website 102 that is managed by and interfaces with workout module 100. In operation, server 98 transmits the selected or created workout program including the machine workout instructions and player workout instructions to player computing device 112. Player computing device 112 transmits the workout program to basketball training machine 10 via the communicative connection between player computing device 112 and basketball training machine 10. Basketball training machine 10 executes the workout program and transmits results to player computing device 112. Player computing device 112, in this example, transmits the results (automatically or in response to user input to upload the results) to server 98, which stores the results at database 104. As such, player computing device 112 can provide both a user interface and communicative connection to enable user interaction with basketball training machine 10 as well as a communicative connection between basketball training machine 10 and server 98. In this way, basketball training machine 10 need not have a communicative connection with server 98 to receive and execute workout programs stored at or created via workout module 100. As such, player computing device 112 can provide the communicative connection enabling interaction between basketball training machine 10 and server 98 in examples where basketball training machine 10 is either not Internet enabled or does not have access to a wireless network capable of interfacing with server 98.

Figure 8:
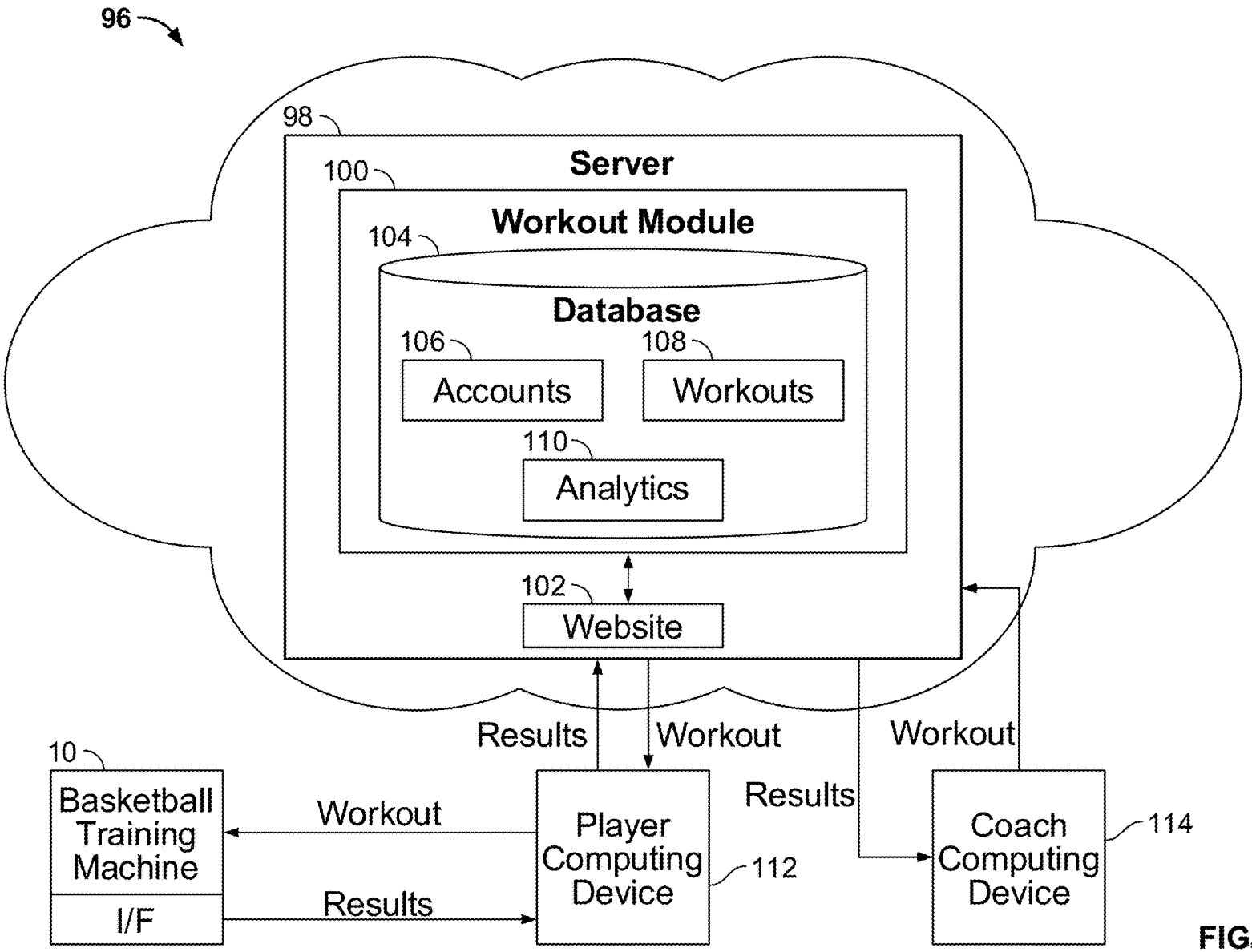
FIG. 8 is a block diagram of another embodiment of the basketball training system including the player computing device and a coach computing device each communicatively coupled with the server, and the basketball training machine communicatively coupled with the player computing device.

FIG. 8 is a block diagram of another embodiment of basketball training system 96 including player computing device 112 and coach computing device 114 each communicatively coupled with server 98, and basketball training machine 10 communicatively coupled with player computing device 112. That is, in the example of FIG. 8, basketball training system 96 also includes coach computing device 114 that is communicatively coupled with server 98 via one or more wired or wireless communication networks. Examples of coach computing device 114 include laptop computers, desktop computers, tablet computers, mobile phones (e.g., smartphones), or other computing devices that can communicate with server 98 to interface with workout module 100. In general, coach computing device 114 provides an additional interface with server 98 to create, select, and/or modify workout programs via workout module 100.

In operation, a coach (or other user) accesses website 102 via coach computing device 114, which may be located remotely from basketball training machine 10 (e.g., in a coach's office or other remote location) to create a workout program via the user interface presented by website 102 and managed by workout module 100. In some examples, coach computing device 114 can assign a created or stored workout program to one or more accounts and/or account groups stored at accounts 106 of database 104. In certain examples, coach computing device 114 can modify a stored workout program prior to assigning the workout program to one or more accounts within database 104.

As illustrated in FIG. 8, coach computing device 114 accesses server 98 via website 102 managed by workout module 100 to create a new workout program, access (and, in some examples, modify) a workout program stored at workouts 108, and assign the workout program to one or more accounts. Player computing device 112, accessing server 98 via, e.g., an app or website 102, receives a notification that a workout program has been created for (or assigned to) an account to which a player is logged in via player computing device 112. In response, player computing device 112 downloads the workout program from server 98 (e.g., via the app or website 102) automatically or in response to player input via received via player computing device 112 to download the workout program. Player computing device 112 transmits the workout program to basketball training machine 10, including both machine workout instructions and player workout instructions, via a wired or wireless connection between player computing device 112 and basketball training machine 10. In other examples, such as when basketball training machine 10 is communicatively coupled with server 98 (e.g., via Internet connection), basketball training machine 10 can receive the workout program via the communicative connection with server 98. Basketball training machine 10 executes the workout program, and transmits the workout results (e.g., made shots, missed shots, workout timing information, or other analytics data) to player computing device 112, which uploads the results to server 98 (e.g., automatically or in response to user input to upload the results). Server 98 stores the workout results at analytics 110 of database 104 and associates the workout results with the user account in accounts 106 to which the player logged in via player computing device 112. Server 98 further transmits the workout results to coach computing device 114 (e.g., automatically or in response to user input to retrieve the results from coach computing device 114, such as via website 102).

Coach computing device 114 can access and/or modify goals and practice plans, managed by workout module 100 and stored at database 104 and associated with one or more of accounts 106. For example, workout module 100 can present graphical control elements via, e.g., website 102 to enable a coach or other user to create and assign goals to one or more of accounts 106. Examples of goals include number of attempted shots goals, number of made shots goals, total training time goals, shooting percentage goals, or other goals. Practice plans can include one or more workout programs assigned to the one or more of accounts 106 that can be designed to help a player achieve a desired level of performance, such as one or more goals associated with a player account.

In some examples, coach computing device 114 can access and modify scheduling corresponding to a time schedule of the use of basketball training machine 10 associated with one or more of accounts 106. For instance, workout module 100 can present graphical control elements, such as graphical calendaring control elements, via website 102 to enable a coach or other user to schedule workout times during which a corresponding account is designated for use of basketball training machine 10. Accordingly, scheduling controls managed by workout module 100 can enable the coach or other user (e.g., player) to assign workout times to one or more accounts (or account groups) to enable effective scheduling and use of basketball training machine 10 which may be utilized by multiple players associated with multiple accounts. In some examples, the coach or other user can assign a workout time to an account within accounts 106. In response, workout module 100 can transmit a notification to the corresponding account (e.g., via a notification on an app executing on player computing device 112) indicating the scheduled workout time. In certain examples, a player or other user can reserve a workout time via, e.g., player computing device 112. In response, calendaring controls managed by workout module 100 can associate the reserved time with the corresponding account and can indicate to other accessing accounts that the time is reserved.

Accordingly, basketball training system 96 including coach computing device 114 that interfaces with workout module 100 via, e.g., website 102, enables coach (or other third party) interaction with workout module 100 to create new workout programs, access and/or modify stored workout programs, assign workout programs, goals, and/or workout programs to individual and/or group accounts, schedule use of basketball training machine 10 among multiple accounts, and track progress of the corresponding players via coach computing device 114. Such remote access via coach computing device 114 can enable the coach or other user to, e.g., setup workout routines for a team or tailored to individual players at times and locations that may be more convenient than during a practice session at a basketball facility where basketball training machine 10 is located. Moreover, the coach or other user can access and review training results corresponding to the workout programs at any time or location that the coach or other user can access server 98 via a communicative connection between coach computing device 114 and server 98, such as during non-practice hours. As such, basketball training system 96 that enables remote access to server 98 via coach computing device 114 provides greater flexibility for coaches or other users to generate workout programs and review workout results than other systems that may require colocation of the coach or other user with basketball training machine 10 to access such workout program generation and review operations.

Figure 9:
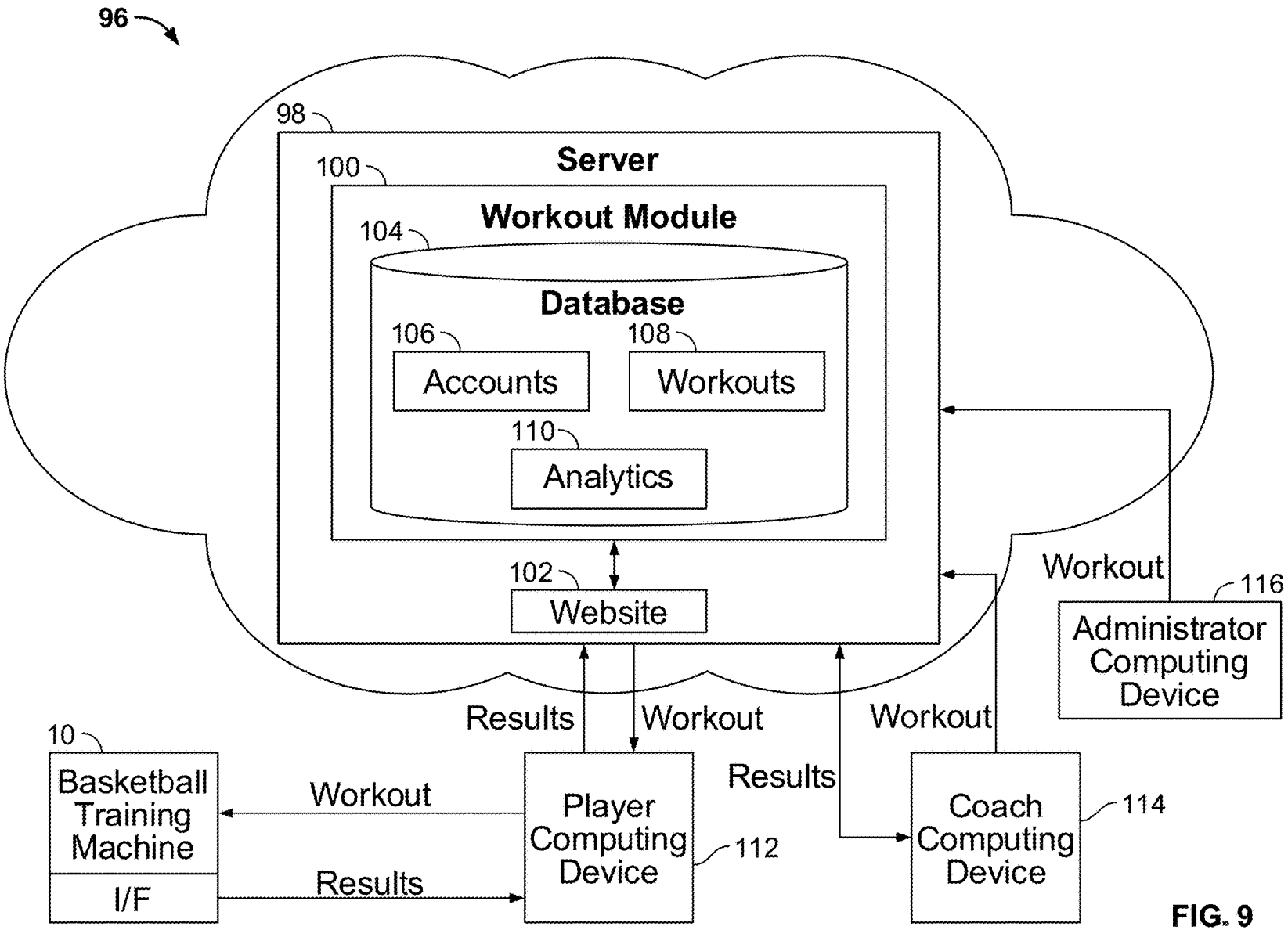
FIG. 9 is a block diagram of another embodiment of the basketball training system including the player computing device, the coach computing device, and an administrator computing device each communicatively coupled with the server, and the basketball training machine communicatively coupled with the player computing device.

FIG. 9 is a block diagram of another embodiment of basketball training system 96 including player computing device 112, coach computing device 114, and administrator computing device 116 each communicatively coupled with server 98, and basketball training machine 10 communicatively coupled with player computing device 112. That is, in the example of FIG. 9, basketball training system 96 also includes administrator computing device 116 that is communicatively coupled with server 98 via one or more wired or wireless communication networks. Examples of administrator computing device 116 include desktop computers, laptop computers, tablet computers, mobile phones (including smartphones), or other computing devices that can communicate with server 98 to interface with workout module 100. Administrator computing device 116 can be, e.g., a device that is located at or otherwise managed by an administrative entity of server 98, such as a manufacturer of basketball training machine 10 or other administrative entity.

As illustrated in FIG. 9, administrator computing device 116 accesses server 98 via, e.g., website 102, to create, store, and/or modify workout programs stored at workouts 108 of database 104. For instance, administrator computing device 116 can be utilized by an administrative entity to create workout programs that are stored at workouts 108 and assigned to any one or more accounts or account groups stored at accounts 106 of database 104. For example, administrator computing device 116 can access website 102 to create a library (or libraries) of workout programs that can be accessed by coach computing device 114 to select workout programs and assign the selected workout programs to user accounts that are downloaded by player computing device 112 for execution by basketball training machine 10.

In some examples, administrator computing device 116 can designate any one or more workout programs as non-modifiable. Non-modifiable workout programs can be selected by coach computing device 114 and/or player computing device 112 for execution by basketball training machine 10, but are not modifiable via non-administrator accounts. Administrator accounts are those accounts that are associated with an administrative entity that accesses server 98 via, e.g., administrator computing device 116. Such non-modifiable workout programs can be executed by multiple players and/or coaches to compare workout performance among the multiple players. Accordingly, an administrator or other entity accessing server 98 via an administrator account (e.g., via administrator computing device 116) can provide common workout programs that can be selected (e.g., by coaches) and performed by multiple players, the results of which serve as an objective measure of the players' abilities to perform the workout programs. In this way, the common workout programs can help a coach in selecting players for game-time performance and in helping coaches to guide players to improve performance.

In certain examples, the non-modifiable workout programs can include benchmark criteria, such as benchmark shot performance criteria (e.g., a number of made shots, a number of shots taken in a given time duration, a percentage of made shots, or other benchmark shot performance criteria). In some examples, the benchmark criteria can correspond to performance of the non-modifiable workout program by a particular player, such as a particular professional player. In such examples, players (e.g., high school players) executing the workout program can compare their workout results to those of the benchmark player (e.g., professional player), thereby providing a reference for comparison and a performance goal to achieve.

As described above, those workout programs not designated as non-modifiable can be modified via, e.g., coach computing device 114 and/or player computing device 112. For instance, database 104 can store a library of modifiable workout programs at workouts 108. A coach or other user accessing workouts 108 via coach computing device 114 or a player accessing workouts 108 via player computing device 112 can select one of the workout programs and modify any one or more aspects of the workout program prior to transmitting the workout program to basketball training machine 10 for execution.

Accordingly, basketball training system 96 can enable an administrator or other entity to provide workout programs that can be selected by coaches and/or players for execution by basketball training machine 10. The workout programs can be modifiable or non-modifiable to enable both modifiable templates of workout programs as well as non-modifiable workout programs that can be used for benchmarking or other comparisons of player performance.

Figure 10:
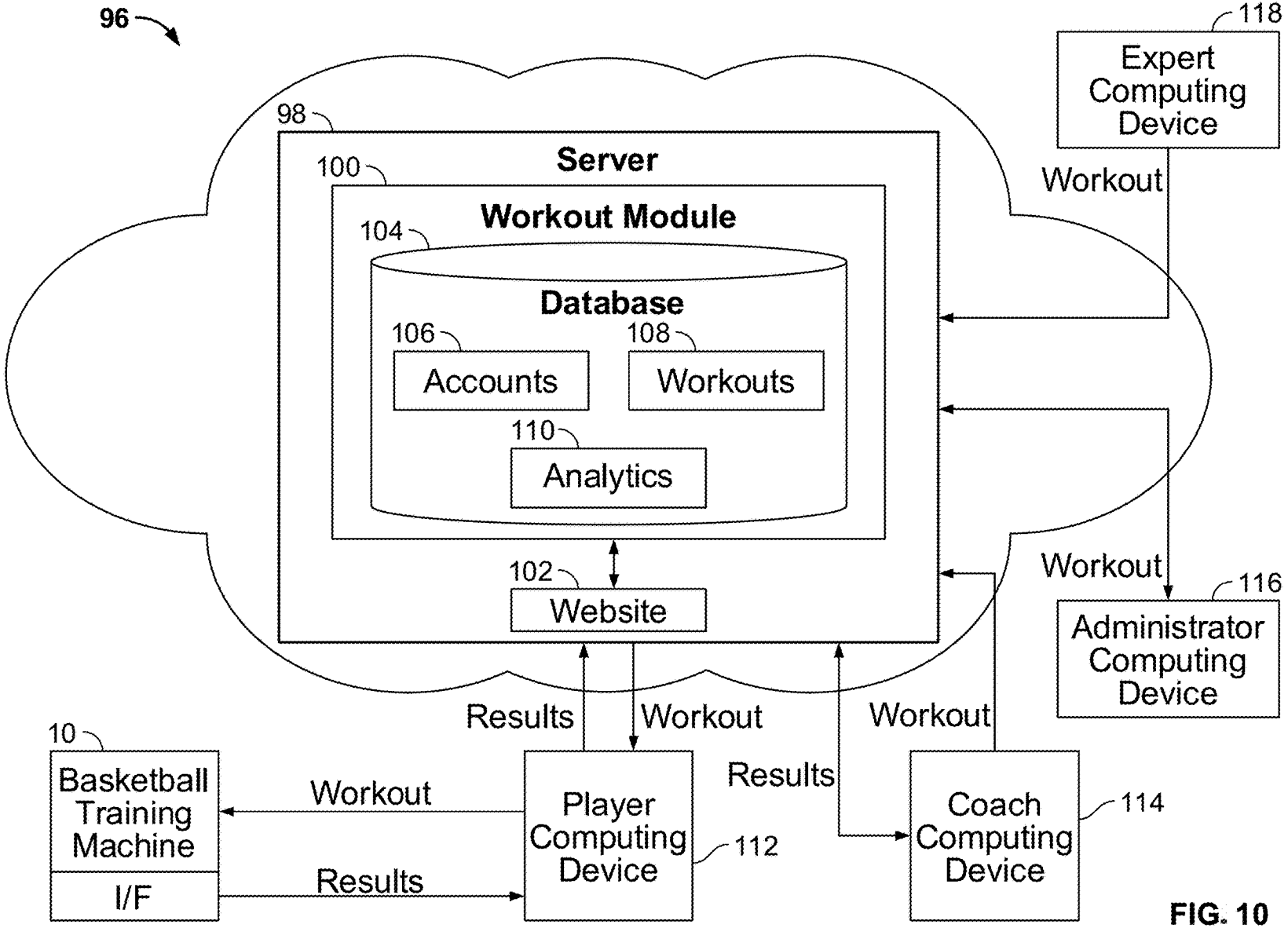
FIG. 10 is a block diagram of another embodiment of the basketball training system including the player computing device, the coach computing device, the administrator computing device, and an expert computing device each communicatively coupled with the server, and the basketball training machine communicatively coupled with the player computing device.
Figure 11:
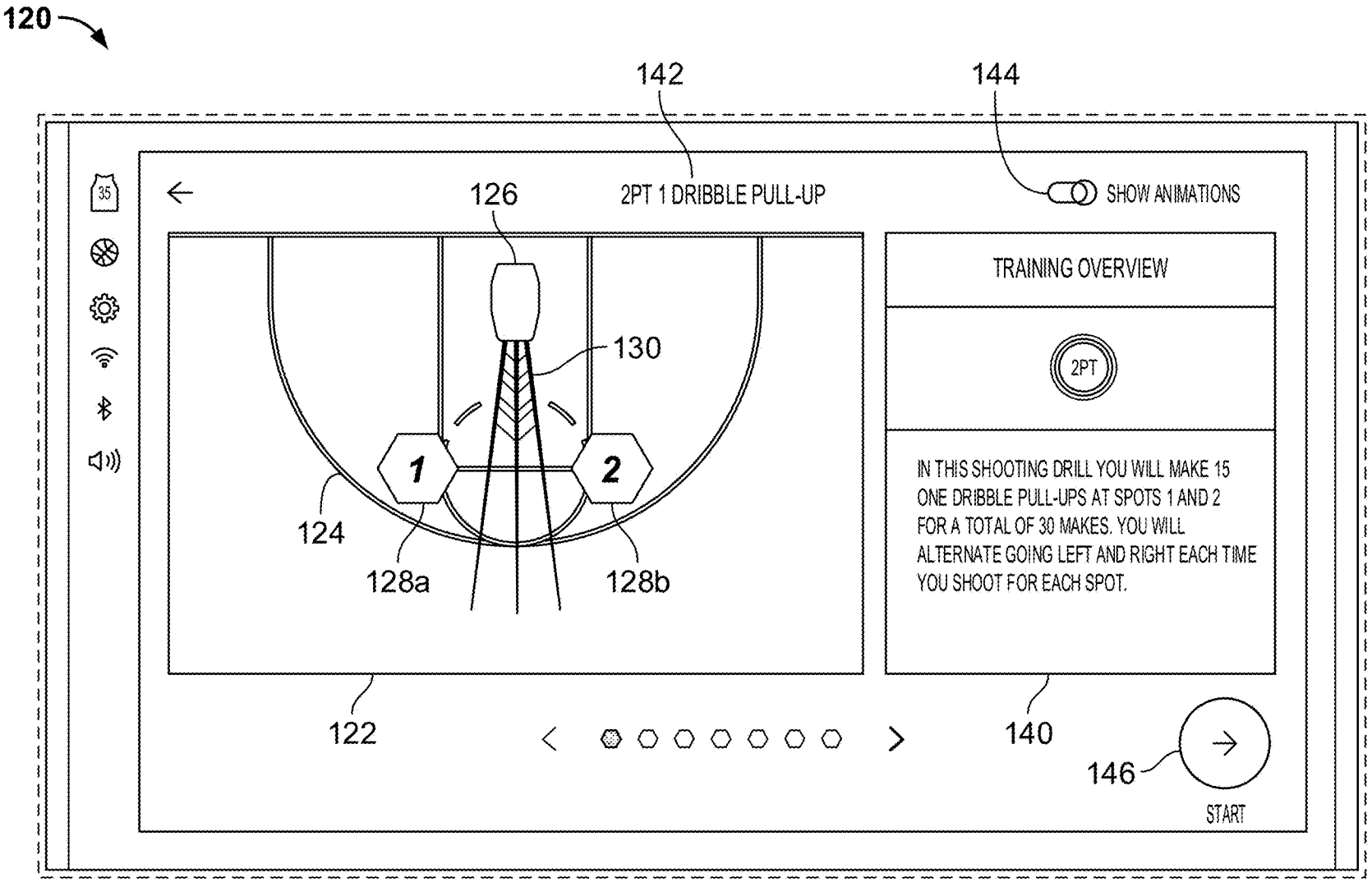
FIGS. 11-32 are screenshots of a graphical user interface managed by a workout module executed by the server.
Figure 12:
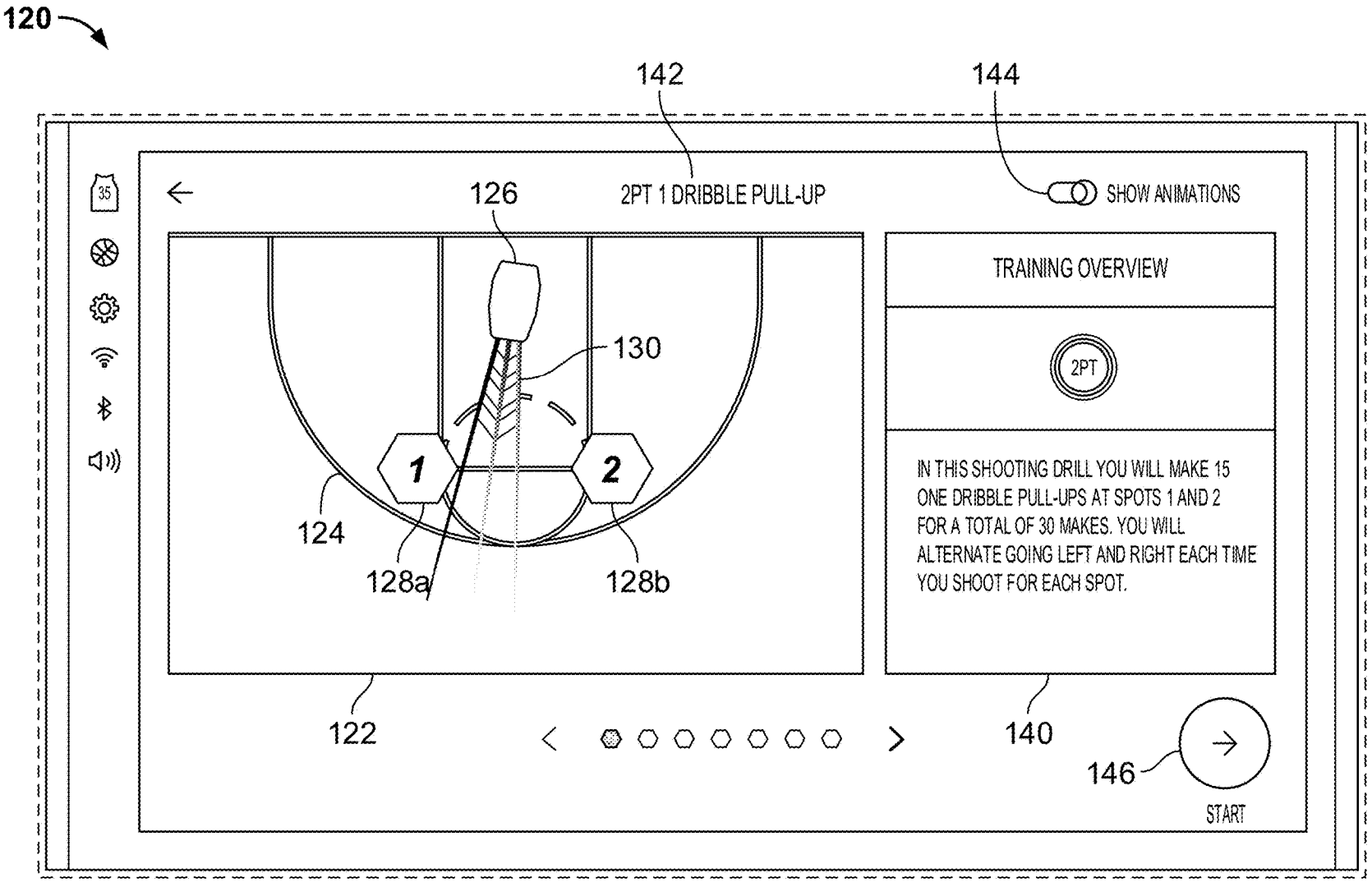

FIG. 10 is a block diagram of another embodiment of basketball training system 96 including player computing device 112, coach computing device 114, administrator computing device 116, and expert computing device 118 each communicatively coupled with server 98, and basketball training machine 10 communicatively coupled with player computing device 112. That is, in the example of FIG. 10, basketball training system 96 also includes expert computing device 118 that is communicatively coupled with server 98 via one or more wired or wireless communication networks. Examples of expert computing device 118 include desktop computers, laptop computers, tablet computers, mobile phones such as smartphones, or other computing devices that can communicate with server 98 to interface with workout module 100.

In the example of FIG. 10, expert computing device 118 can be utilized by a sports training entity (e.g., trainer) or other basketball training expert to provide workout programs that are stored at workouts 108 of database 104. As an example, a training expert, such as a professional or collegiate level basketball coach, a sports trainer, or other expert can access server 98 via website 102 managed by workout module 100 to generate workout programs (e.g., a workout library) corresponding to, e.g., various workout regimens specifically targeted to increase a player's performance in one or more aspects of the game of basketball. Workout programs generated by the expert (e.g., via expert computing device 118) can be accessed and reviewed by an administrator via administrator computing device 116. The administrator can assign any one or more of the workout programs (and, in some examples, rejecting certain workout programs) to any one or more accounts, account groups, or workout libraries stored at database 104. Coach computing device 114, in one example, accesses a library of expert workout programs and assigns one or more of the expert workout programs to corresponding accounts stored at accounts 106 of database 104. A player associated with one of the accounts receives a notification from workout module 100 that a new workout program (i.e., the expert workout program in this example) has been assigned to that player and downloads the workout program via player computing device 112. Player computing device 112 transmits the workout program to basketball training machine 10 (or, in some examples, basketball training machine 10 downloads the workout program direction from server 98). Basketball training machine 10 executes the expert workout program and transmits results to player computing device 112. Player computing device 112 transmits the results, automatically or in response to user input to upload the results, to server 98. A coach or other user can access the results stored at analytics 110 of database 104 via website 102 accessed from, e.g., coach computing device 114. Accordingly, system 96 can enable basketball training experts to provide workout programs that can be vetted by an administrator and selected for use by a coach and/or player with basketball training machine 10. Results of the executed workout program can be stored at database 104 and viewed (and analyzed) by the player and/or coach. As such, system 96 enables coaches and/or players to access workout programs designed for execution on basketball training machine 10 by basketball training experts that may not be directly affiliated with the player, coach, or team, but rather may provide such workout programs as a service (e.g., paid or otherwise) to individuals and groups associated with (e.g., having access to) server 98.

A basketball training system implementing techniques described herein can therefore enable players, coaches, teams, or other entities to generate workout programs for execution by basketball training machine 10 using a graphical user interface managed by workout module 100 and presented via website 102 or other graphical interface. The workout programs can be stored at server 98 (or other computing device accessible by server 98) to enable later retrieval and possible sharing of workout programs among multiple user accounts. The user accounts can be associated with any one or more user groups, thereby facilitating such sharing of workout programs among affiliated users. Workout results, stored by database 104 as analytics 110 and associated with any one or more accounts 106 and/or workouts 108, can be retrieved by any computing device communicatively coupled with server 98 and having access to a corresponding one of accounts 106. In this way, analytics data corresponding to workout results can be reviewed, shared, and analyzed by coaches, players, or other users to facilitate the efficient and effective training of players. The ability of workout module 100 to automatically modify workout programs in response to graphical control elements that select a corresponding skill level or duration of the workout program enables users (e.g., players, coaches, or other users) to efficiently utilize training time for active training with basketball training machine 10, rather than spending such time modifying workout programs to fit the timing constraints or skill level of the player. Moreover, libraries of workout programs generated by an administrator or training expert can enable the coach and/or player to select stored workout programs designed by training experts to draw from their expertise without having direct affiliation (e.g., time spent with) the particular training expert. Accordingly, system 96 implementing workout module 100 to generate workout programs for execution by basketball training machine 10 can significantly enhance the effectiveness and efficiency of the training experience using basketball training machine 10.

Animated Drill Previews

FIGS. 11-15 are screenshots of graphical user interface 120 presented by, e.g., front display 46 and/or website 102 and managed by workout module 100. As described above, front face 44 of outer shell 42 includes electronic front display 46, pre-launch warning light 48 and front opening 50. The front display 46 can display the user interfaces described below, including user interface 120 and user interfaces 220, 320, 420, 520, 620. The front display 46 can be one of the displays that the user interface is displayed on, and the user interface may be displayed in additional locations and/or may be separately displayed while the front display 46 is used otherwise. The user interfaces can be displayed on the front of the ball delivery machine 32, the back of the ball delivery machine 32, or either side of the ball delivery machine 32. The user interfaces can be displayed above or below the opening 50 in the ball delivery machine 32.

In some aspects, the ball delivery system 34 includes more than one display. For example, the ball delivery system can include two or more displays. A first display may be implemented and used for programming drills as described herein in reference to user interfaces 120, 220, 320, 420, 520, 620. The first display can be the front display 46, or the first display can be another display separate from the front display 46. For example, A second display may be implemented and used for displaying instructions to a user/player who is performing a drill and/or workout with ball delivery system 34. The second display can be the front display 46 or another display (e.g. user mobile device, mounted screen, or other display visible to the user), where the second display can illustrate instructions, drill previews, drill feedback, drill prescriptions and/or assessments, next shot locations, among other drill information to inform the user of what the ball delivery system 34 is going to do next.

For purposes of clarity and ease of discussion, the screenshots of FIGS. 11-15 are described below within the context of basketball training system 96 of FIGS. 5-10. The user interfaces described herein can be implemented into the basketball training system 96 using at least one or more processors and a computer-readable storage medium coupled to the one or more processors having instructions that, when executed by the one or more processors, cause the one or more processors to perform operations. The operations can manage the user interfaces described herein, which can include receiving user inputs, generating drills, outputting drills, and controlling the basketball delivery machine according to the drill and user inputs.

As illustrated in FIGS. 11-15, graphical user interface 120 includes a drill preview area 122 that includes a graphical representation of a portion of a basketball court 124, a representative ball delivery machine 126 and one or more ball delivery locations 128 (e.g. ball delivery locations 128*a*, 128*b*). The drill preview area 122 displays animations that illustrate a selected drill (i.e. selected from a drill menu screen), where the animations illustrate the movement and/or rotation of the representative ball delivery machine 126 between ball delivery locations 128 (e.g. 128*a*, 128*b*), and pass indicators at the ball delivery locations 128 (e.g. 128, 128*b*) that illustrate a pass being sent to the each ball delivery location 128. The animations can be videos, a series of pictures, GIFS, or any other suitable animation that can preview a workout drill. FIGS. 11-15 illustrate the progression of an exemplary animation of a two-point one dribble pull-up drill in drill preview area 122.

Animated delivery machine 126 includes a pass direction zone 130 that extends from a throwing end of the animated delivery machine 126 to illustrate the direction a pass would be thrown by the animated delivery machine 126 based on the direction the animated delivery machine 126 is facing. The pass direction zone 130 includes three lines that extend to illustrate an area that the pass would be delivered, the two outer lines extend away from the animated delivery machine 126 at equal non-parallel angles and the center line is normal to the animated delivery machine and extends between the two outer lines. The pass direction zone 130 rotates with the animated delivery machine 126 to illustrate the projected pass delivery area based on the rotational position of the animated delivery machine 126.

Graphical user interface 120 includes one or more ball delivery locations 128 (e.g. ball delivery locations 128*a*, 128*b*) positioned at locations on the representative basketball court 124. Ball delivery locations 128*a*, 128*b* graphically represent candidate ball delivery locations to which ball delivery machine 10 will deliver basketballs during execution of the workout program. Each of ball delivery locations 128*a*, 128*b* including a number corresponding a sequential order of ball delivery to the ball delivery locations. That is, ball delivery location 128*a* illustrates the numeral 1 corresponding to a first order of ball delivery, and ball delivery location 128*b* illustrates the numeral 2 corresponding to a second order of ball delivery.

Figure 13:
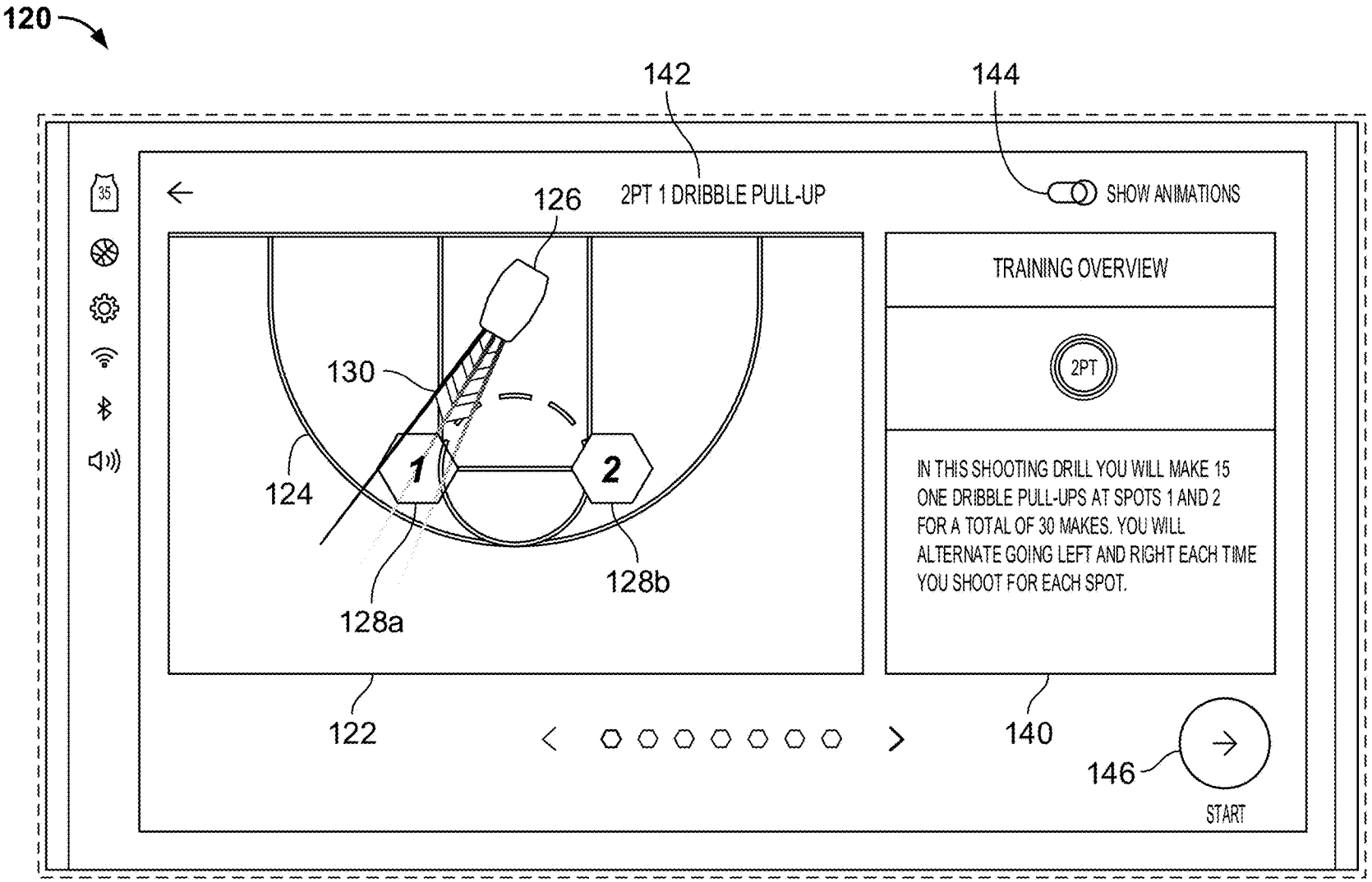

Ball delivery locations 128 include pass indicators that illustrate that a pass is delivered to the ball delivery locations 128 in the sequential order. For example, the ball delivery locations 128 can blink, light up, fill in, or otherwise animate to indicate that a pass from animated delivery machine 126 is being delivered to ball delivery location 128 along pass direction zone 130. FIG. 13 illustrates an example pass indicator, where the pass direction zone 130 is aligned with ball delivery location 128*a* and ball delivery location 128*a* blinks to indicate that the animated delivery machine 126 is passing a ball through pass direction zone 130.

Figure 14:
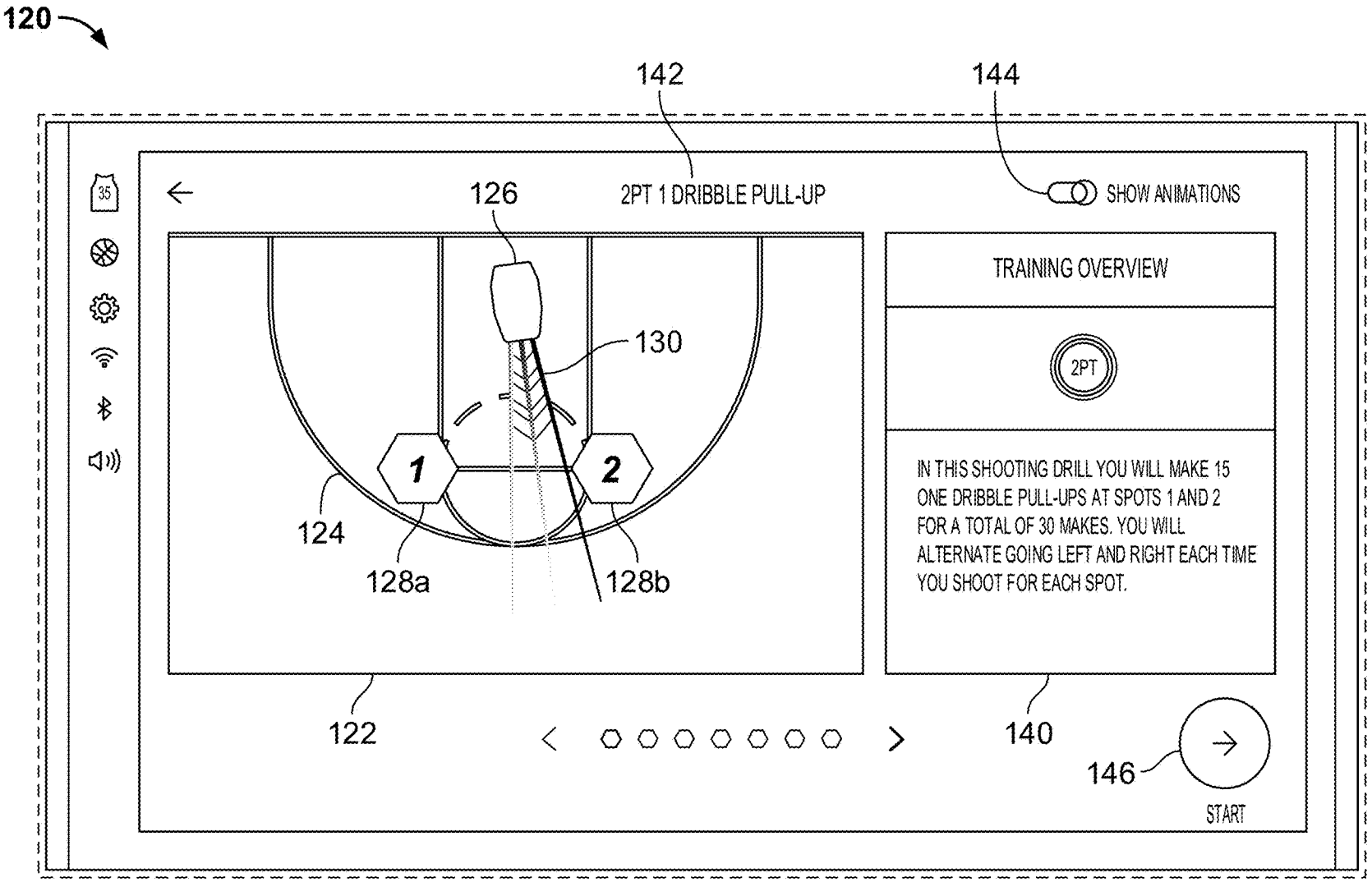

As shown in FIG. 14, the drill preview animation can continue, where the pass direction zone 130 rotates away from ball delivery location 128*a* and is no longer aligned with ball delivery location 128*a*. The pass indicator at ball delivery location 128*a* can turn off to illustrate the pass is complete.

Figure 15:
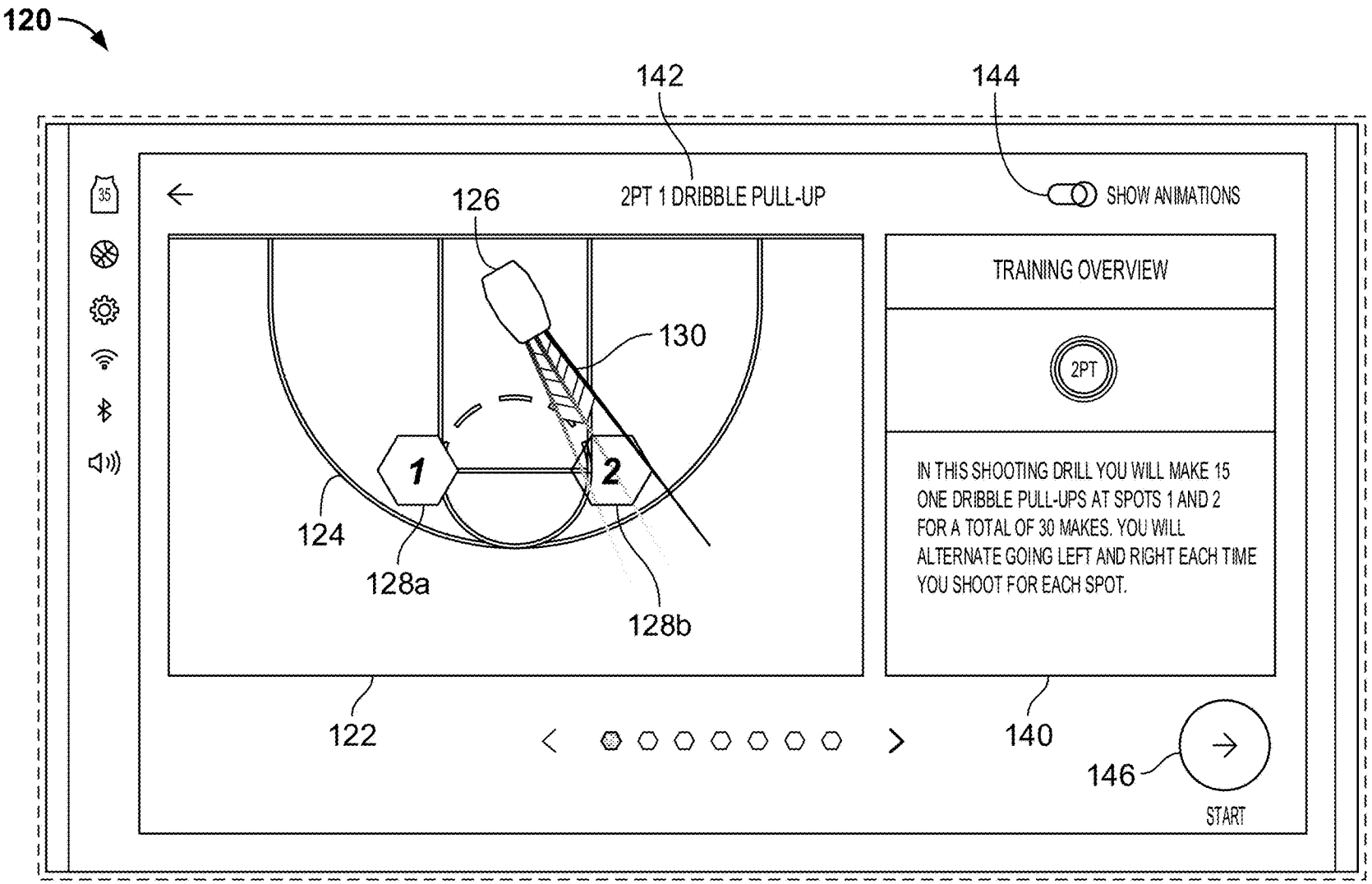

As shown in FIG. 15, the drill preview animation can continue, where the pass direction zone 130 is aligned with ball delivery location 128*b* and ball delivery location 128*b* blinks to indicate that the animated delivery machine 126 is passing a ball through pass direction zone 130.

User interface 120 includes a training overview area 140 that includes instructions associated with the drill animated in the drill preview area 122. Training overview area 140 includes a readable description of the selected drill, the selected drill is also indicated in the drill label 142 which is positioned above the drill preview area 122.

User interface 120 includes a show animations button 144 that can be toggled on and off, where in the on position the user interface will automatically preview the selected drill by displaying the animations in the drill preview area 122 as shown in FIGS. 11-15. In the off position, the show animations button 144 can prevent the animations from automatically previewing in the drill preview area 122. While the off position of the show animations button 144 can prevent the automatic previewing of the drill in the drill preview area, toggling the show animations button 144 into the on position can start the animations of the drill previews. The user interface 120 can include a play button that appears when the show animations button 144 is in the off position that can be selectable to show the drill preview while the show animations button 144 is in the off position.

User interface 120 includes a start button 146 that is selectable by a user to begin the drill on basketball training system 96.

The user interface 120 can be implemented by a system (e.g. basketball training system 96) that includes a basketball delivery machine, one or more processors, and a computer-readable medium coupled to the one or more processors having instructions stored thereon which, when executed by the one or more processors, cause the one or more processors to perform operations comprising receiving user inputs for programming a drill; generating a drill preview based on the user inputs for programming the drill; outputting the drill preview to a display; and controlling the basketball delivery machine to execute the drill.

In some aspects, the preview can be displayed prior to the basketball delivery machine is executing the drill. The drill preview can be displayed while the basketball delivery machine is executing the drill. The drill preview can illustrate where a user should be for a current shot and where a user should be for a next shot between shots of the drill executed by the basketball delivery machine.

In some aspects, the drill preview includes animations that demonstrate the drill. The drill preview includes a plurality of icons that move with respect to a representation of a portion of a basketball court. The drill preview is generated based on meta data from the user inputs for programming the drill. The drill preview includes an animated avatar of the user. The operations can include selecting a non-shooting move animation from a library of non-shooting moves based upon the drill programmed by user inputs, and outputting the non-shooting move animation as part of the drill preview. The drill preview illustrates passes from the basketball delivery machine to multiple locations. The drill preview illustrates a pass from the basketball delivery machine to a first location and illustrates movement from the first location to a second location.

While the user interfaces shown here are of a 'top down' view of a basketball court, other interfaces may show other views. For example, an interface may show a 'first person' view of the basketball court. For example, the first-persona interface may show an animation of a view from the perspective of the location at which the player will be receiving the ball, moving, taking a shot, etc. This first-person interface may be rendered on a stationary screen (e.g., of a desktop computer) or on a screen with movement-detection (e.g., on a phone or augmented-reality display headset, or via smart glasses). By showing the first-person interface, the viewer of the interface may be presented with a view of the drill that is more natural or intuitive to understand. While many experienced players may be able to quickly interpret the top down view, new athletes may have a comparatively harder time understanding the drill in the top down interface and may be aided by the first person interface.

In some cases, when the first person interface is rendered on a screen with motion detection, the point of view of the first-person interface changes in line with the change in location and orientation of the screen. For example, the first-person interface may begin rendering a drill's animation. Then, as the animation is being played, movements of the screen can be provided as input to the renderer of the drill animation, and the point of view from which the animation is rendered can be moved to match the movement of the screen. In such a way, the screen can provide an augmented reality view of the drill to the user, where the user's phone or head-worn display can visually act as a "view window" into the 3D animation.

In some cases, the interfaces include elements (e.g., buttons) allowing the user to specify a command to switch between top-down and first-person. For example, a drill may be initially shown in a top-down interface to introduce the drill to the user, allow the user to edit the drill, etc. Then, the user may press a button to change to a first-person interface that shows the selected, and possibly edited, drill to the user. In some implementations, the first-person interface can allow for editing of the drill. For example, a user may be able to click-and-drag a marker on the floor of the first-person animation to edit the drill. In some implementations, the first-person interface does not permit editing of the drill. For example, the trainer may not want the player to edit a drill, and in such a configuration the first-person view would not allow editing of the drill.

The animation for the first-person interface may in some cases be pre-rendered. The animation for the first-person interface may in some cases be rendered on-the-fly. For example, when a drill is created and finalized (e.g., when a user presses a save button), an animation and rendering process may be initiated. In this animation and rendering process, a 3D geometric environment is created in the processor and memory (but possibly not displayed at this time). The environment is populated with shapes for a hoop, a ball, and/or any other items to be shown in the animation such as a travel path or waypoint marker. A virtual camera is defined based on the location and orientation which the player should be in through the course of the drill, and the environment can be animated according to the logic of the drill (e.g., moving a ball to a destination along a parabola to mimic the flight-path of a real ball in a real environment). This animation may then be rendered to produce a video that includes sequence of 2D images from the perspective of the virtual camera in the 3D environment. This video may then be stored at rest in computer memory until a later time in which it is needed to be played in a first-person interface.

However, in addition to or in the alternative the pre-rendering described here, an on-the-fly rendering may be performed. For example, when using a motion tracked screen (e.g., phone), the 3D environment and movement of objects in the environment may be pre-generated, but the actual rendering may take place as the user is viewing the first-person interface. In such a scenario, the location and orientation of the virtual camera may be set to track the real-world location and orientation of the screen. In such a way, a dynamic first-person interface may be provided that tracks the real-world location and orientation of a screen, even when that location and orientation is not known. In still another configuration, a dynamic first-person interface may be provided in which a user moves the camera with a joystick, touch-screen gesture, mouse movement, or other input with an input device. Here too, the rendering may be performed as the input is being received, providing the user with an interface that they may be familiar with from video games and other computer applications.

As previously mentioned, various objects can be shown in the first-person interface. In some cases, these objects are analogs to real-world objects that are part of the drill. For example, a virtual ball can be generated, animated, and rendered in an environment with court markers such as a free-throw line, a three-point line, key, etc. In addition or in the alternative, virtual objects with no real-world analog may be generated, animated, and rendered. For example, waypoints indicating where a player should catch a ball, move to, and shoot from may be used. These can take the visual form, for example, of illuminated spots on the court, wire-frame boxes in space, arrows, or animated players. Further, visual guides such as an ideal shooting arc can be shown before or after a shot, recordings of previous drills can be shown with full or partial opacity so that the view can see how others have performed the drill, etc.

In one or both of the top-down and first-person view, elements of the drill are shown to a viewer in various configurations. For example, personalized settings may be created for each user, and those settings may be used to creating the interface. In one example, one player may save settings indicating a preference for a top-down view of a drill using an animated ball while another player may save settings indicating a preference for a first-person view with an animated players. When the first player views drill information, the system can access that player's profile data and determine to render the top-down view with the animated ball, in response, the drill is rendered to the first player as a top-down view with an animated ball. In this system, when displaying to the second player, the system can access the second players profile data and determine to render the first-person view of the same drill using an animated player. In this way, the same drill is presented to different players in different ways based on preferences associated with the players.

For drills with interactions between two or more players, visual elements may be used to show the actions that should be taken by each player. Consider a drill in which a passing player receives the ball from the machine, passes the ball to a shooting player, and the shooting player takes a shot. This drill may also have instructions for the players to move on the court with or without the ball, perform athletic movements (e.g., provide a pick to the other player), or take other steps. In such a case, the dill may be shown with static or animated elements showing the actions required for both players. This display can be configured to show both information to both players simultaneously—for example a top-down view can show an animated ball and two animated players working together to perform the drill. In some cases, the drill may be showed to each player sequentially. For example, in a first-person view, the view of a first player is shown and then after this the view of the second player may be shown.

In some cases, the basketball training machine can execute drills that are uploaded from a drill playbook (e.g. an offensive and/or defensive playbook) that includes one or more drills that train players how to play within a basketball system as chosen and/or designed by a coach or a trainer. The drill playbook may be uploaded and converted from drill sketches recorded in computer memory that include data specifying player locations, player movement paths, shot locations, pass locations, etc. into executable drill instructions for the basketball training machine. The basketball training machine can collect and track the shot location (s) based on programmed drill and associated movement within the drill. For example, a shot location may differ from a pass location or a ball delivery location. The basketball training machine can display relevant metrics for each drill, the relevant metrics may be consistent or may change based on the user, and the relevant metrics can include at least a number of made shots, a number of missed shots, a field goal percentage, biometric feedback (e.g. heart rate, distance traveled, peak speed, jump height, calories burned, etc.), and form feedback (e.g. an image and/or video overlay of the shots taken by the user during the drill with an indication of a make or miss along with an indication of proper or improper form).

In some aspects, the drill preview is created as a function of definitions assigned to the drill. For example, a user may input text in the form of definitions describing a drill. The system can be configured to process the input text from the user and perform an analysis of the input text from the user. The analysis can include identification of words or phrases in the user input text that correspond to programmed drills and/or drill elements that can be used to create a visual animation based on the input text.

In some cases, the basketball training machine can work in conjunction with a client device (e.g., a mobile phone) to capture and provide video of a newly created drill. For example, a trainer may design a new drill that the trainer wishes to have one or more players perform. The trainer can design the drill using the interface of the basketball training machine. Upon completion, the basketball training machine can send a message, over a data network, to the phone of the trainer (e.g., using profile information associated with the trainer to select identify a recipient address for the message). An application running on the phone can receive the message and launch a notification. When the trainer brings up and selects the notification, the application can prompt the trainer to record execution of the drill. The trainer can then use their phone to record themselves or a player performing the drill from one or more points of view. Upon completion, the phone can send, to the basketball training machine, the recorded video or videos. As will be appreciated, this system can also use one or more cloud services to mediate this operation. For example, a cloud service may store the trainer's profile data, may serve and stream the video to the basketball training machine, etc. Once finished, any player wishing to start the drill can then access the videos created by the trainer. In such a way, this technology can advantageously allow for the customization of drills with instructions specified by the drill creator and provided to drill users with whatever details the trainer feels are important to include in the instructions. This provides an advantage over, for example, other systems with more rigid and pre-defined drill explanation systems which may not be able to cope with new and changing requirements from a cutting edge trainer working on new drills that were not considered by the creators of the basketball training machine.

Live Mode and Edit Drills on the Fly

FIGS. 16-23 are screenshots of a graphical user interface 220 presented by, e.g., website 102 and managed by workout module 100, the graphical user interface 220 operating in a live mode. For purposes of clarity and ease of discussion, the screenshots of FIGS. 16-23 are described below within the context of basketball training system 96 of FIGS. 5-10, though they may be used in other contexts. The user interfaces described herein can be implemented into the basketball training system 96 using at least one or more processors and a computer-readable storage medium coupled to the one or more processors having instructions that, when executed by the one or more processors, cause the one or more processors to perform operations. The operations can manage the user interfaces described herein, which can include receiving user inputs, generating drills, outputting drills, and controlling the basketball delivery machine according to the drill and user inputs.

Live mode via user interface 220 allows a user (e.g. coach, player, admin) to control a ball delivery machine (e.g. basketball training machine 10) remotely via a mobile computing device (e.g. player computing device 112, coach computing device 114, administrator computing device 116, and/or expert computing device 118). Live mode via user interface 220 utilizes the connection between the user device (e.g. player computing device 112, coach computing device 114, administrator computing device 116, and/or expert computing device 118) and the ball delivery machine (e.g. basketball training machine 10) to allow for customized workouts in real-time. For example, a drill is a preprogrammed drill with a plurality of preprogrammed ball delivery locations, wherein the basketball delivery machine is configured to deliver a basketball to a different ball delivery location that is different than the preprogrammed ball delivery location during the drill in response to receiving the user inputs at the user interface 220 in real time during the drill. The basketball delivery machine can be configured to change the preprogrammed drill during the drill in response to receiving the user inputs at the user interface 220 in real time during the drill.

User interface 220 can present a preview area 222 that includes representation of a portion of a basketball court 224 and a representative ball delivery machine 226. Animated delivery machine 226 includes a pass direction zone 230 that extends from a throwing end of the animated delivery machine 226 to illustrate the direction a pass would be thrown by the animated delivery machine 226 based on the direction the animated delivery machine 226 is facing. Pass direction zone 230 can share the features of pass direction zone 130 described above.

User interface 220 includes a user-moveable control element 225 positioned within control bar 227 that extends across the user interface 220, the control bar 227 defines the area that the moveable control element 225 can move and/or slide within responsive to user input or other data. User inputs (e.g. user placing their finger on the screen and sliding across the surface of the screen with that finger) to moveable control element 225 move and/or slide the moveable control element 225 within the control bar 227, the position of the moveable control element 225 controls both rotational position of the representative ball delivery machine 226 and the ball delivery machine (e.g. basketball training machine 10). That is, user interface 220 updates preview area 222 to indicate the direction the representative ball delivery machine 226 is facing based on the position of the moveable control element 225 and the basketball training machine 10 also moves and/or rotates to the rotational positon selected by the moveable control element 225. Live mode therefore maps the rotational position of both the representative ball delivery machine 226 and the basketball training machine 10 in real time based on user inputs at the moveable control element 225. User interface 220 can also receive user inputs in the preview area 222 where the user can select the court and choose where the machine will rotate to in real time. For example, the user my select various pass locations on the court in real time. Each of FIGS. 16-23 shows the rotational alignment between moveable control element 225 and representative ball delivery machine 226.

Figure 17:
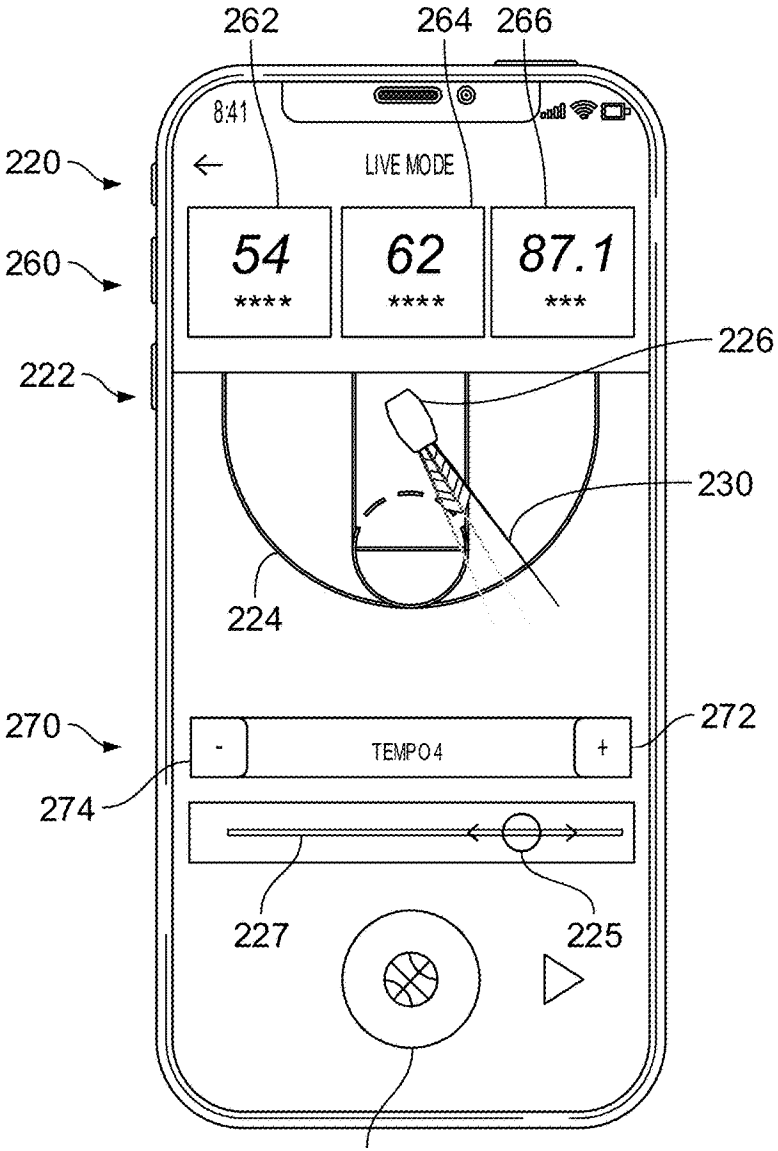
Figure 16:
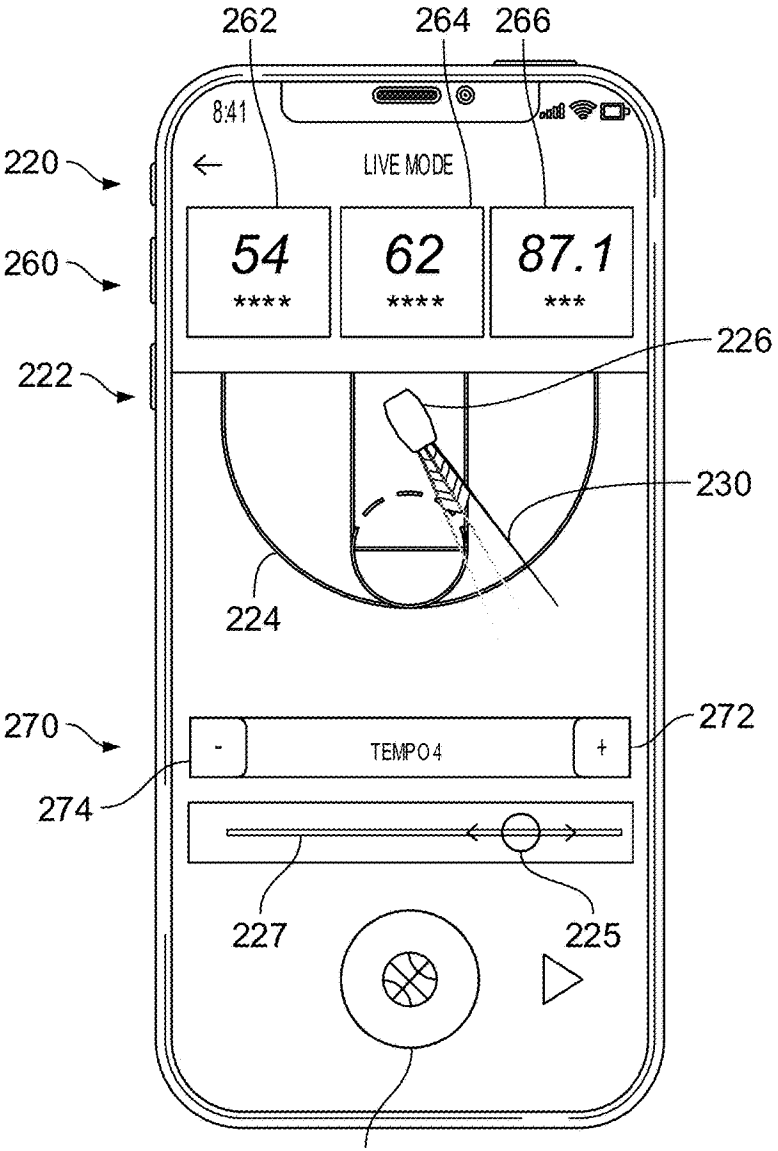
Figure 19:
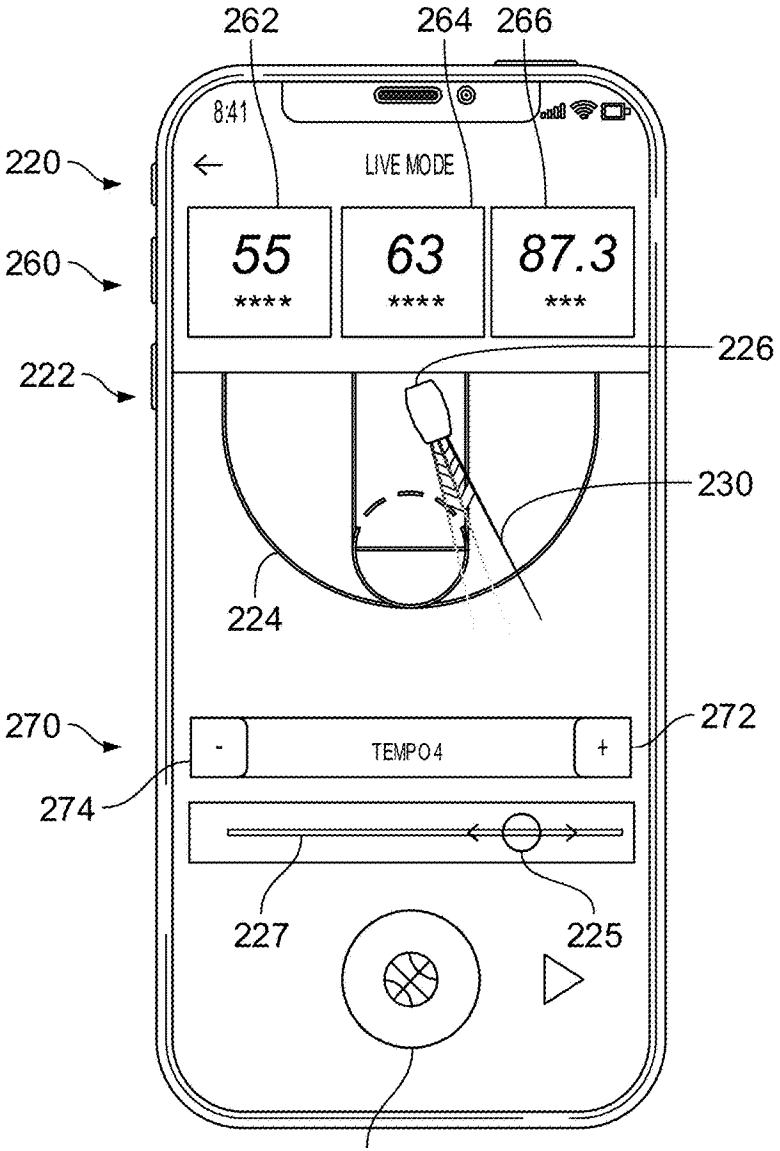
Figure 22:
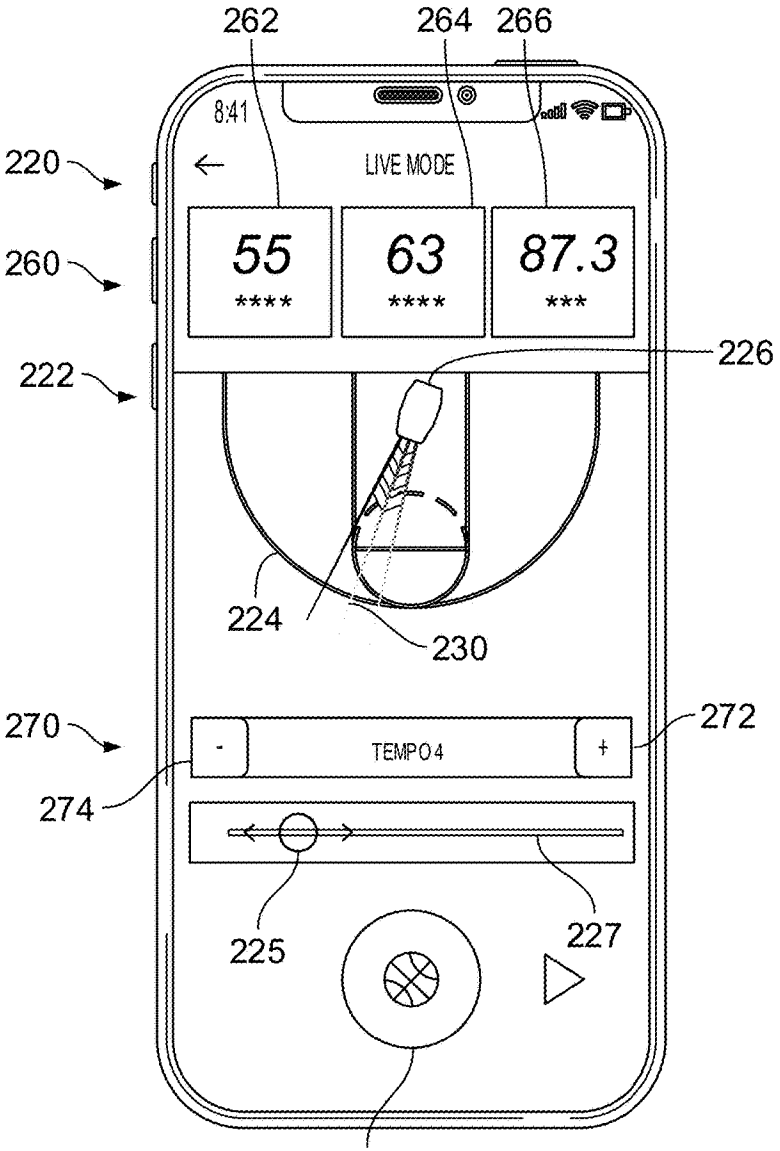

User interface 220 includes a pass button 246 that is user-selectable (e.g., a user placing their finger over the button, removing their finger, holding their finger for a threshold period of time) to cause the basketball training machine 10 to throw a pass in the rotational direction determined by the moveable control element 225. The pass button 246 can use a visual indication that the pass button 246 has been selected by blinking, lighting up, fill in, or otherwise animating to indicate that a pass will be or is being delivered by basketball training machine 10. For example, FIGS. 17 and 22 illustrate embodiments of user interface 220 where the pass button 246 has been pressed and a pass is being thrown by basketball training machine 10. FIGS. 16, 18-21, and 23 illustrate example user interfaces 220 where the pass button 246 has not been selected.

Figure 18:
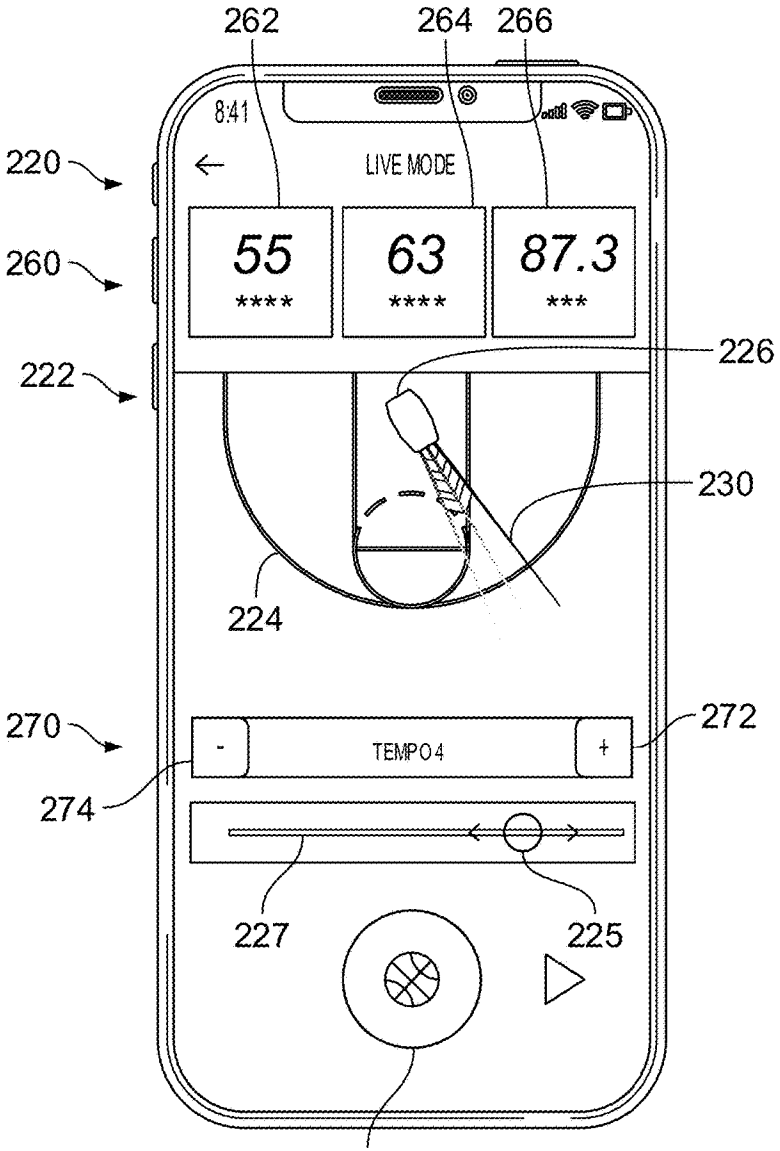
Figure 21:
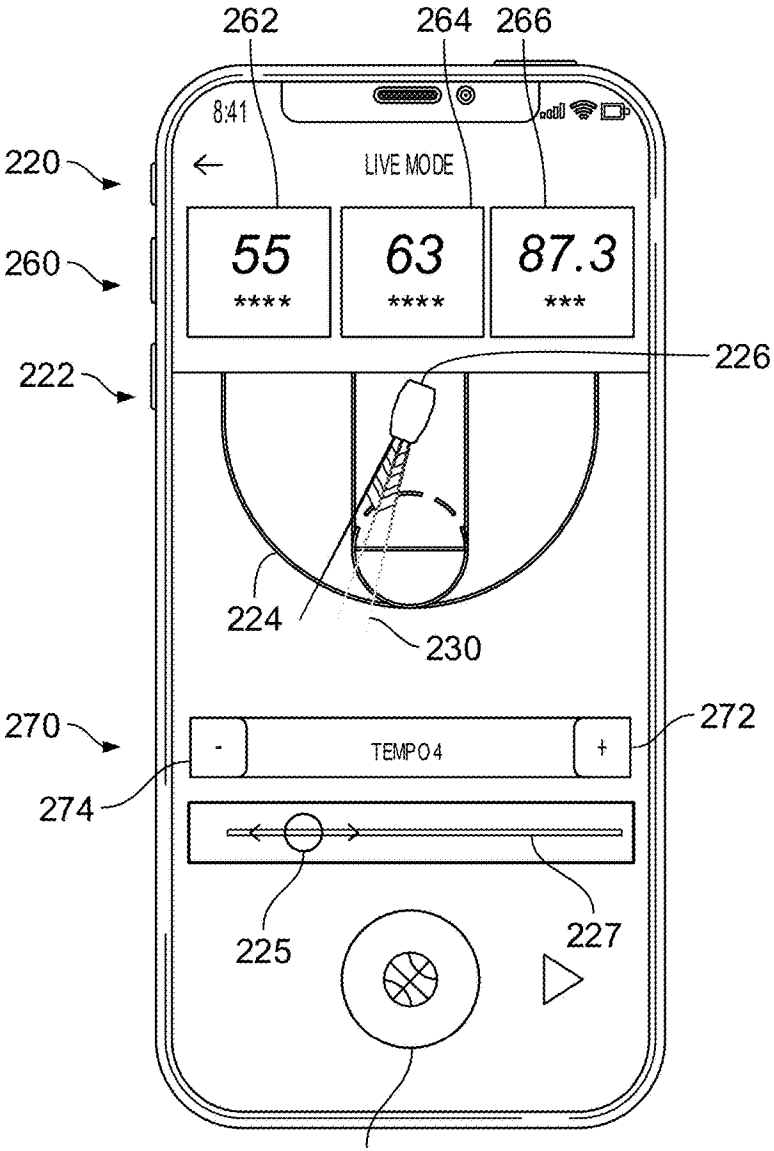
Figure 20:
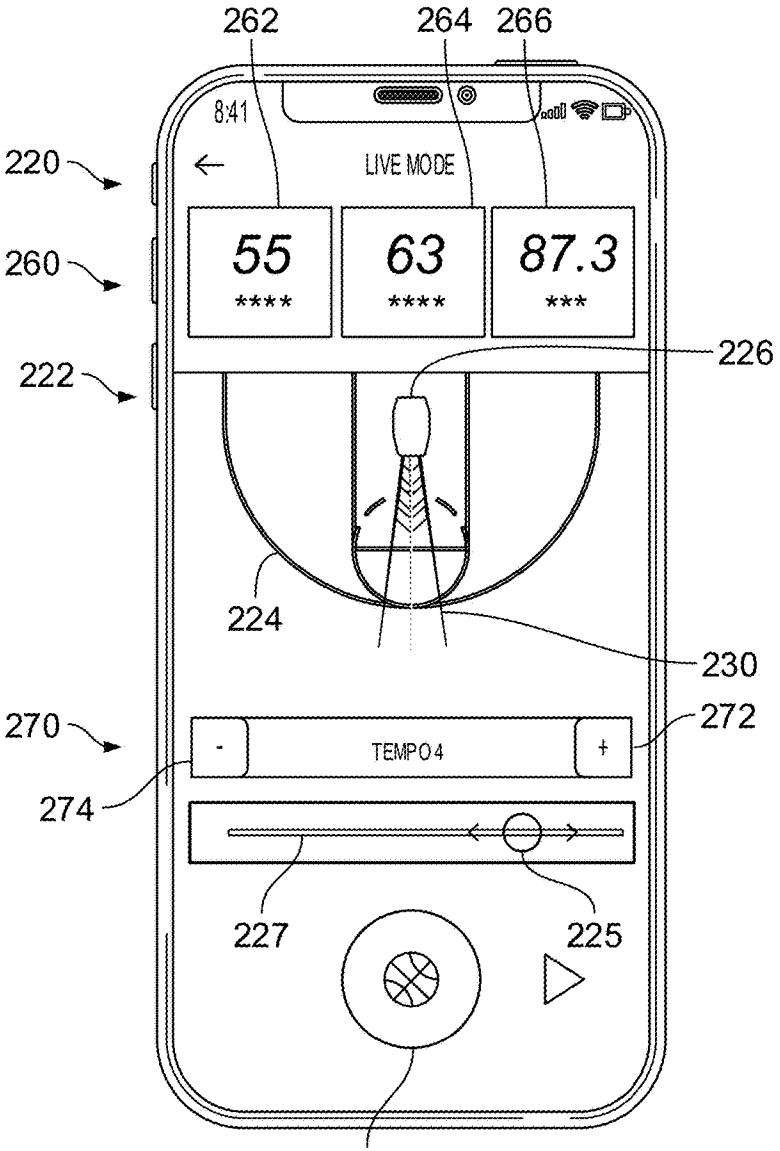
Figure 23:
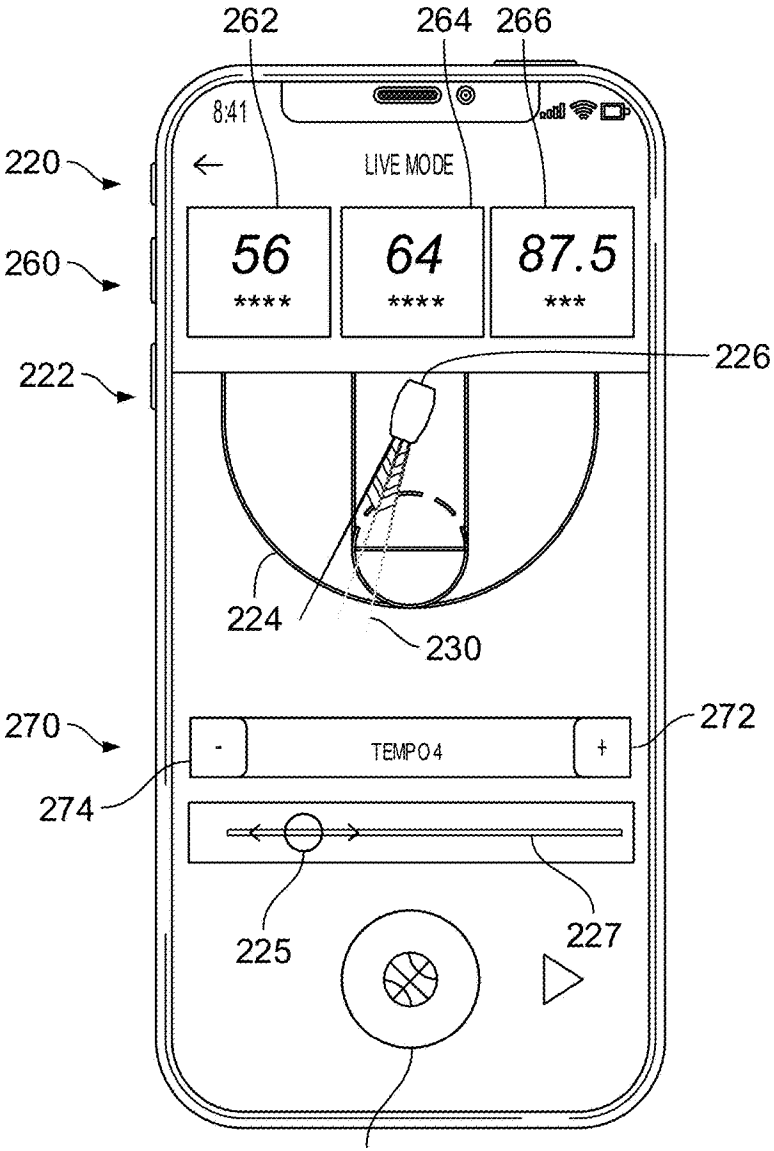

User interface 220 includes a statistics tracking area 260 that tracks and displays the results of the user's performance (e.g., success in making shots, number of attempts) during the live mode session. Statistics tracking area 260 includes a number of shots made 262, a number of shots taken 264, and a field goal percentage 266. Statistics tracking area 260 can be in communication with shots made counter 22 described above. FIGS. 16-23 illustrate the user interface 220 updates the statistics tracking area 260 with each shot taken. For example, after the pass is thrown in FIG. 17, FIG. 18 illustrates the number of made shots increased from 54 to 55 and the number of taken shots increased from 62 to 63. The field goal percentage increased from 87.1% to 87.3% as a result of the made shot. After the pass is thrown in FIG. 22, FIG. 23 illustrates the number of made shots increased from 55 to 56 and the number of taken shots increased from 63 to 64. The field goal percentage increased from 87.3% to 87.5% as a result of the made shot.

User interface 220 includes a tempo selection area 270 that includes selectable buttons to set the tempo or pace at which the basketball training system 96 operates. The tempo selection area 270 includes a tempo increase button 272 that increases the tempo of the basketball training system 96 response to a user input, and a tempo decrease button 274 that decreases the tempo of the basketball training system 96 in response to a user input.

In the future this real time control could be done by a trainer not located in the same physical space. Imagine a picture in picture on the display of a trainer giving feedback to the player based on a video feed coming from the machine to the trainer. The trainer could tell the player to take shots from the wing now and they could move the machine for them.

In some aspects, the user interface 220 may be used while the basketball delivery machine is executing a drill. While the basketball delivery machine is executing the drill, a user can modify the drill based upon user inputs and executing a modified version of the drill. In some aspects, the real time control of the system can pause a drill in progress while changes are being made to the drill, or the drill can continue while modifications are being made to the drill. The drill can be a preprogrammed drill with a plurality of preprogrammed ball delivery locations, and the basketball delivery machine is configured to deliver a basketball to a different ball delivery location that is different than the preprogrammed ball delivery location during the drill in response to receiving the user inputs in real time during the drill. The drill can be a preprogrammed drill and the basketball delivery machine is configured to change the preprogrammed drill during the drill in response to receiving the user inputs in real time during the drill.

In some configurations, a user's phone may be used to display these interfaces described in this document, along with other user interfaces for other input and output. Matching a user's device to a corresponding machine can be accomplished with a variety of techniques.

In some cases, the user may download and install an application on their phone. This application includes authentication features such as a username and password system, biometric sensing, $3^{rd}$ party identity service, etc., to identify and authenticate a user. This application can be used with data stored in a user profile such as described elsewhere in this document and to store user information such as settings, history, etc. As part of this, the authenticated user can use the application to send input and receive output related to one or more ball delivery machines associated with the user (e.g., because the user purchased the machine, because the user has been granted access by the machine's owner).

Some or all of the interface controls associated with the ball delivery machine may be presented to the user on the user's phone via the application. In addition to those interfaces described elsewhere, other types of interfaces may be provided. Some such interfaces can include 'lower level' control of the ball-throwing machine. For example, the application can provide interface elements that, when interacted with by the user, cause the ball delivery machine to turn on or off, to rotate so as to aim ball delivery at a different point of the court, to deliver a single ball, or to otherwise engage or initiate any of the mechanical or electrical operations of the ball delivery machine. In addition to this low-level control, the application can also permit 'higher level' control of the ball-throwing machine. For example, the application can provide interface elements that, when interacted with by the user, cause the ball delivery machine to engage routines made up of multiple or sequential low-level activities. Such routines include, but are not limited to, running one or more drill programs. In such a way, the technology allows a user to provide the same or substantially similar control directives to a ball delivery device from a remote location. This provides for a technical advantage over other machines which require a user to be close enough to touch the machine to access some of the control inputs. For example, a trainer can turn on a machine without having to cross a court that is being used by a player for warm-ups, thus allowing the trainer to avoid interrupting a player preparing to go through drills with the ball delivery machine. In another example, user safety is improved, as a trainer can modify a drill or otherwise control the ball delivery machine without standing near the machine—which could otherwise put the trainer at risk of being struck by a delivered ball, errant pass, or player going in for a rebound or layup. In another example, users with limited physical abilities (e.g., manual dexterity deficit, a prosthetic limb that is not trackable with conventional touchscreens) can use whatever accessibilities are built into their client device and access this technology on an equal footing with typically-abled users that are able to use the default touchscreen of the ball delivery machine or their typical phone.

Communication between a client device such as a phone and the ball delivery machine uses one or more links in a data network. For example, the client device and the ball delivery machine may directly communicate (e.g., over BLUETOOTH) via a network that allows for direct end-to-end communications. In some examples, the client device and the ball delivery machine may communicate indirectly (e.g., over the internet) via a network that allows for intermediary routing and/or heterogeneous subnetworks.

Virtual Group Training

The technology described in this document can be used to allow a single remote trainer to train a variety of players that are geographically separated. For example, a trainer working in a gym in Minnesota, USA, can run a live or recorded virtual, group training class for students in other parts of Minnesota, other states in the USA, and in other countries. In another example, the trainer may be in one location, and a team of players may all be located another location in a training facility with a series of bays that each have a ball delivery machine and hoop. In this way, a single trainer can reach the general public anywhere in the world or a geographically remote team without the players or the trainers having to take the time and expense of travel.

The trainer can be provided with a trainer-dashboard interface allowing the trainer to run a live and ad-hoc training class. For example, the trainer can control a queue of drills to be performed. The drill at the head of the queue can be performed generally simultaneously (e.g., after accounting for network lag and other technical limitations) by each ball delivery machine enrolled in the class. As the drill is completed, the drill can be removed from the queue and the next drill can be promoted to the head of the queue, at which point the ball delivery machines can transition to the new drill. This dashboard can include interface elements to control the queue, the active drill, and other drills that are queued up. This can include queue controls to add and remove drills, reorder drills, etc. in the queue. Drill controls can be provided to modify one or more parameters of a drill—either the live drill currently being run or other drills queued up for the future. These parameters can include tempo, number of shots to be made, early termination of a drill, repeating portions of a drill, etc.

The dashboard can be provided to the trainer. In some cases, the trainer may be using a computing device and the dashboard is rendered for trainer to see. In some cases, the trainer may be on a court, going through the class with the players, and may be using a producer to listen for the trainer's instructions and interact with the dashboard. The use of the producer while the trainer completes the drills can allow, for example, a trainer to in some cases act as a class leader, with their machine acting as an imitator and each player's machine acting as a follower that mimics or replicates the actions of the trainer's machine. This can advantageously allow the player to 'play along' with the trainer and make a personal connection with the trainer, even though the player and trainer are far apart. The use of the trainer interacting directly with the dashboard can also allow, for example, a trainer that is mentally expert but not as physically fit or gifted as the players (e.g., an older coach working with world-class athletes of prime age) to push the players at the appropriate level regardless of the coaches physical abilities.

The trainer (e.g., in any setup) can be recorded with a camera having audio and video recording capabilities to be transmitted to the players that are taking part of the class. For example, one or more video cameras can be incorporated into the trainer's ball delivery machine or around the trainer. Data from those cameras can then be streamed to the players for display on a screen on or near their basketball delivery machine.

While the class is in progress, information from the players can be provided to the trainer leading the class. For example, a display for the trainer can show a running set of statistics for each player, including shots taken, made, field goal percentage, etc. In addition or in the alternative, aggregated statistics can be displayed for the trainer. For example, a count or percentage of players that are behind in a drill (e.g., due to pausing to collect and errant ball or take a water break) can be shown to the trainer. In addition or in the alternative, outlier players can be identified for the trainer. For example, if one player is on a hot-streak of made shots, cold-streak of missed shots, or is leading or lagging the class in field goal percentage by a predetermined threshold, that player can be uniquely identified in the display. With this information, the trainer is able to advantageously control the class using player feedback, even though the trainer is not able to completely monitor each player all at the same time due to geography and complexity of doing so. For example, the trainer can observe the running statistics for each player to see if the class is generally able to complete the drills at a satisfactory rate or if the difficulty should be adjusted on-the-fly. In another example, the trainer can use the aggregated statistics to see if a sufficient portion of the class if behind and call a pause to let every player catch up before starting a next drill. In another example, the trainer can use the outlier display to acknowledge a well-performing player or note a lagging player that may need additional support.

In some aspects, virtual group training can be achieved by providing a system that includes a plurality of basketball delivery machines, one or more processors, and a computer-readable storage medium coupled to the one or more processors having instructions stored thereon which, when executed by the one or more processors, cause the one or more processors to perform operations. The operations include controlling operation of each of the plurality of basketball delivery machines in real time. The operations can include controlling each of the plurality of basketball delivery machines to perform the same drill at the same time. Each of the plurality of basketball delivery machines are controlled to throw basketballs to a plurality of locations.

The operations can include delivering audio and video to each of the plurality of basketball delivery machines in real time.

In some aspects, the plurality of basketball delivery machines are incapable of executing drills without control from a master controller. The master controller comprises the one or more processors and the computer-readable storage medium. Each of the plurality of basketball delivery machines includes a controller capable of controlling an individual one of the basketball delivery machines in response to a master controller and also controlling the individual one of the basketball delivery machines independent of control from the master controller.

In some aspects, virtual group training can be achieved by providing a first basketball delivery machine having a user interface, a plurality of basketball delivery machines, one or more processors, and a computer-readable storage medium coupled to the one or more processors having instructions stored thereon which, when executed by the one or more processors, cause the one or more processors to perform operations. The operations include controlling operation of the plurality of basketball delivery machines as a function of inputs received on the user interface of the first basketball delivery machine. The first basketball delivery machine is configured to operate in an instructor mode while the plurality of the other delivery machines operate in a participant mode, wherein the instructor mode includes operations to send, to basketball delivery machines operating in participant mode, instructions to perform actions to mimic actions of the first basketball delivery machine.

In some aspects, virtual group training can be achieved by providing a system that has a first basketball delivery machine having a user interface, a plurality of basketball delivery machines, one or more processors, and a computer-readable storage medium coupled to the one or more processors having instructions stored thereon which, when executed by the one or more processors, cause the one or more processors to perform operations. The operations include receiving, at the first basketball delivery machine, statistics sensed by each the plurality of basketball delivery machines performing drills, and displaying, on the user interface of the first basketball delivery machine, the statistics, wherein the statistics are displayed on the user interface of the first basketball delivery machine during the drills.

In some aspects, virtual group training can be achieved by controlling operation of each of a plurality of basketball delivery machines in real time. The operations can include controlling each of the plurality of basketball delivery machines to perform the same drill at the same time. Each of the plurality of basketball delivery machines are controlled to throw basketballs to a plurality of locations. The operations can include delivering audio and video to each of the plurality of basketball delivery machines in real time. The plurality of basketball delivery machines are incapable of executing drills without control from a master controller. The master controller comprises the one or more processors and the computer-readable storage medium. Each of the plurality of basketball delivery machines includes a controller capable of controlling an individual one of the basketball delivery machines in response to a master controller and also controlling the individual one of the basketball delivery machines independent of control from the master controller.

Drill Templates

Figure 24:
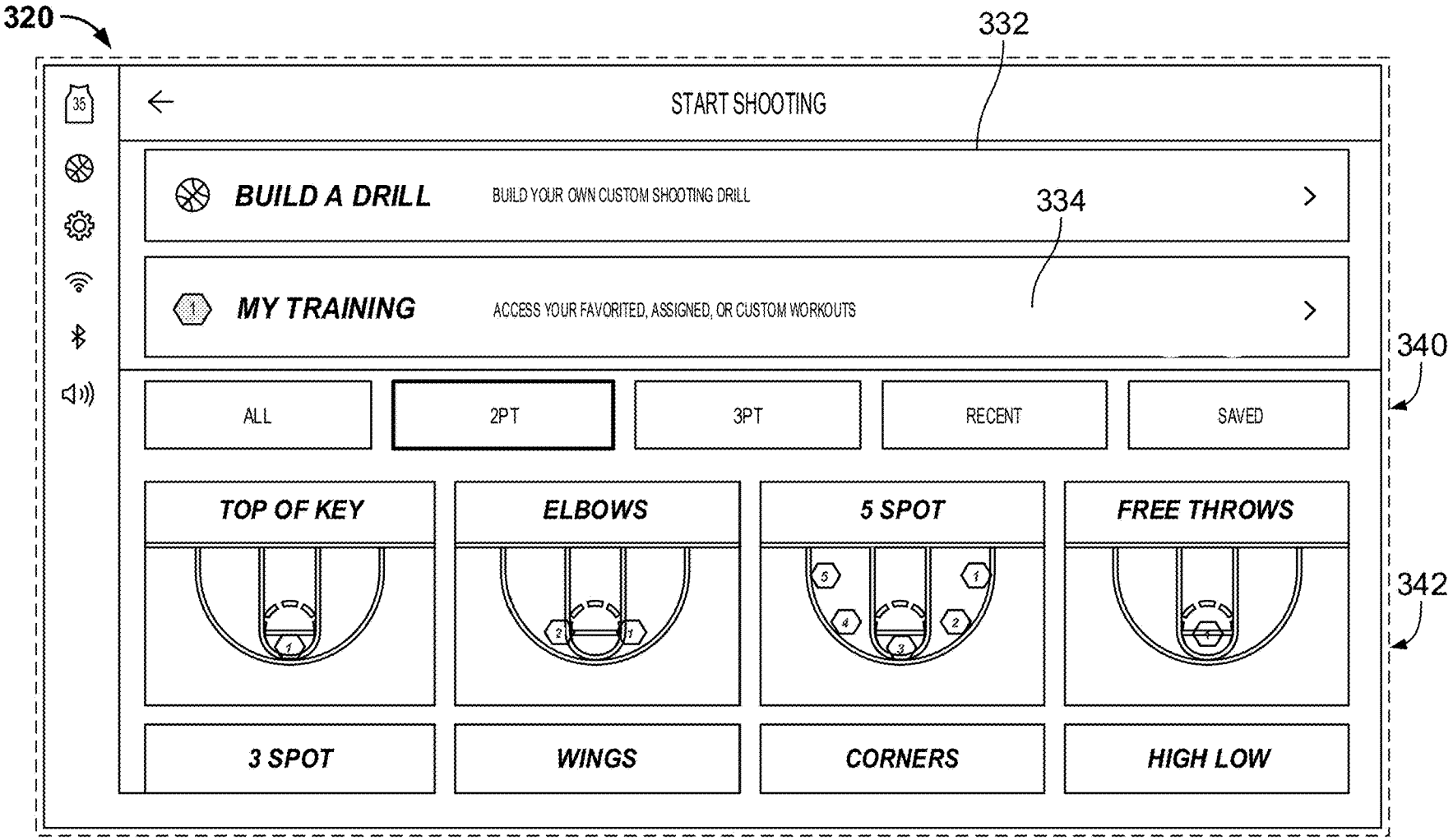

FIG. 24 is a screenshot of graphical user interface 320 presented by, e.g., website 102 and managed by workout module 100. For purposes of clarity and ease of discussion, screenshots of FIG. 24 is described below within the context of basketball training system 96 of FIGS. 5-10. The user interfaces described herein can be implemented into the basketball training system 96 using at least one or more processors and a computer-readable storage medium coupled to the one or more processors having instructions that, when executed by the one or more processors, cause the one or more processors to perform operations. The operations can manage the user interfaces described herein, which can include receiving user inputs, generating drills, outputting drills, and controlling the basketball delivery machine according to the drill and user inputs. For example, the operations can include presenting a drill template on a user interface (e.g. user interface 330), receiving user inputs for customizing the drill template, generating a drill based on the drill template and the user inputs for customizing the drill template, and outputting the drill to the basketball delivery machine to execute the drill.

User interface 330 includes a build a drill area 332 that can include a bar that extends across user interface 330. The build a drill area 332 is user-selectable, and selection of the build a drill area 332 opens a drill builder interface that can be free of indicia and allows a user to build a custom drill without suggested locations from a template. In some aspects, the drill builder interface can include one or more of the interfaces described herein in reference to FIGS. 25-32, and the drill builder interface is not limited to FIGS. 25-32. In some aspects, the drill builder interface includes a heat map for the user associated with the account logged into the basketball training machine, and the heat map for the user can be overlayed on top of the build a drill screen. The heat map may guide a user to make decisions in real time of where they should shoot based on past data. For example, the heat map for a user may include a high field goal percentage at a free throw line location, but a low field goal percentage at a baseline location. The field goal percentages used in the heat map are user-specific and the user will see that they shoot a high field goal percentage at the free-throw line and a low field goal percentage at the baseline location and would opt to build a drill that practices the baseline location shots to improve the user's performance.

User interface 330 includes a "my training" area 334 that can include a bar that extends across user interface 330. The "my training" area 334 is user-selectable, and selection of the "my training" area 334 opens a personalized interface for the user logged into the ball delivery machine. The personalized interface can include favorited workouts, assigned/recommended workouts, and custom workouts built by the user or selected by the user and saved to the personalized interface. The personalized interface can include locations available to the user based on the user's court layout. For example, in a training facility, baseline shots may not available due to limited space. In a driveway of a user, a house or other structure may block certain shooting locations. The personalized interface can track the limitations of the user's court and can store, recommend, and/or recommend drills that the user can perform at their court.

This technology can be used to prompt a user to design or use drills based on the personal needs and skills of a particular user. That is, the technology can record information about a user, determine the strengths and weaknesses of that user, and provide recommendations unique and specific to the skills of the user and/or as a function of the historical performance of the user. The historical performance of the user can include a sensed shooting percentage and/or one or more drills that have been previously performed.

In one example, the technology can index users based on one or more parameters of their demonstrated skills and/or fitness level. This can include ranking players in order and/or based on their position in a series of players (e.g., first, second, third), assigning a metric to each player (e.g., free-throw percentage, shooting accuracy), categorizing each player into one of a plurality of possible categories (e.g., beginner, novice, intermediate, expert). Then, based on the indexing, one or more drills may be recommended and/or customized. For example, the system may maintain a collection of drills each tagged with one or more category (e.g., beginner, novice . . . ). A player classified into a category can then be presented with a prompt to try one of these drills. In some cases, the drill may be modified based on the strengths and weaknesses compared to other players in the same category. For example, an intermediate player that has shown better-than-typical accuracy at three-point shots for an intermediate may be prompted with a drill with extra short-range shooting, while a different intermediate player with poor long-range accuracy may be prompted with the same drill with extra long-range shooting.

In some cases, actual game data may be used by the system to create the personalized drill prompts. For example, video recording, motion capture, and/or play-by-play data for a player may be supplied by the system. The system can parse this data to extract one or more measures of player performance. For example, video recording can be subject to image recognition to identify a player and their actions in a game. Motion capture data can be compared to ideal shot form data to identify shots where the player is exhibiting more or less ideal form. Play-by-play data can be parsed to identify shooting percentage or other measures of performance. With this information, drills may be prompted or modified as described.

Data from peripheral sensors may also be used. For example, one or more sensors may be used that measure player or ball movement when a player is using the ball return device or when the player is in a game or practice environment without the ball return device. These sensors can include, but are not limited to, computer vision (e.g., video camera, stereoscopic cameras, depth-sensors such as LIDAR or radar), accelerometers in the ball, and body worn sensors (e.g., on a wrist or arm-sleeve). These sensors can be used to generate parameters of player motion or ball motion such as player acceleration, balance, top-end speed, form (shooting, running, etc.) and jump information (height, hang time) as well as ball motion such as arc, rotation, speed, spin axis, impacts on the hoop before passing through the hoop, etc. With this data, the system can identify strengths and weaknesses for a player to prompt and/or modify drills.

User interface 330 includes selectable categories 340 that are user-selectable and control the drills displayed in the drill template area 342. Selectable categories 340 group drill templates based on drill type, the categories can include all drills, 2 point drills, 3 point drills, recent drills, and saved drills. The selectable categories control the templates shown and the categories can, once selected, be scrollable, to show additional templates within selected category. FIG. 24 illustrates the 2 point category selected, so templates within that category will appear in the drill template area 342 e.g. top of key, elbows, 5-spot, free throws. Selecting a different category will illustrate different templates that correspond to the selected category. Categories and templates can include non-shooting drills (e.g. conditioning drills, passing drills, dribbling drills, ball handling drills, and defense drills).

The drill template area 342 can be dynamically updated based on serval variables including what users of various basketball delivery machines are doing, drills the user has been performing recently. The drill template area 342 may present templates that are available by and recommended for the ability level of the user, and templates that are recommended by trainers, coaches, and professional players. The drill template area 342 can include a template marketplace where users can create and publish drills and drill templates, and the published templates can be voted up and down by other users. Drill template area 342 can include drill templates that involve exercises beyond shooting, for example, shooting with ball handling, ball handling, conditioning, shooting with conditioning, etc.

In some aspects, drill templates may be combined to build another drill. For example, a second drill template may be presented on the user interface, and user inputs can be received that customize the second drill template. A second drill can be created based on the second template and user inputs. The second drill and the first drill (e.g. a drill that has already been created) can be combined and saved as a new drill that includes the parameters of both drills. The parameters of both drills can be combined to create a workout, which can be a collection of drills. They may be all shooting drills or some may be non-shooting drills.

Selection of one or more of the drill templates opens a template interface where a user can make changes to the template and customize a drill program based off of the template. The drill template may be customized by changing the ball delivery locations, the shot locations, the number of shots, the number of delivery locations, the order of the delivery locations, the tempo of the ball delivery machine (e.g. the tempo could be slower at first as a warm up and then increase at the middle during the peak of the program, and decrease towards the end as a cool down), player movement, drill goals, and game-like scenarios (including additional "passers", obstacles, marks, etc.). Users may share a template with other users (e.g. within the application, outside of the application). Users may annotate templates (e.g. labeling based on shot locations, pass locations, obstacles, etc.). In some aspects, the basketball delivery machine may import a playbook from a coach or a trainer, and convert the playbook into templates (e.g. a dribble drive play). The system may highlight drill templates based on the time of year (e.g. pre-season, in season, post season, off season) or based on the progress a user has made through a workout regimen (e.g. finished a beginner regimen, finished an age regiment, advanced to a better team, etc.).

Build a Drill

FIGS. 25-32 are screenshots of a graphical user interfaces presented by, e.g., website 102 and managed by workout module 100, the graphical user interface 220 operating in a live mode. In some aspects, FIGS. 25-32 illustrate a customizable build a drill interface (e.g. user interface 420 that can be presented in response to user selection of the build a drill area 332. In some aspects, the build a drill interface 420 may be illustrated without selection of the build a drill area 332. For purposes of clarity and ease of discussion, the screenshots of FIGS. 25-32 are described below within the context of basketball training system 96 of FIGS. 5-10, though they may be used in other contexts. The user interfaces described herein can be implemented into the basketball training system 96 using at least one or more processors and a computer-readable storage medium coupled to the one or more processors having instructions that, when executed by the one or more processors, cause the one or more processors to perform operations. The operations can manage the user interfaces described herein, which can include receiving user inputs, generating drills, outputting drills, and controlling the basketball delivery machine according to the drill and user inputs.

Figure 25:
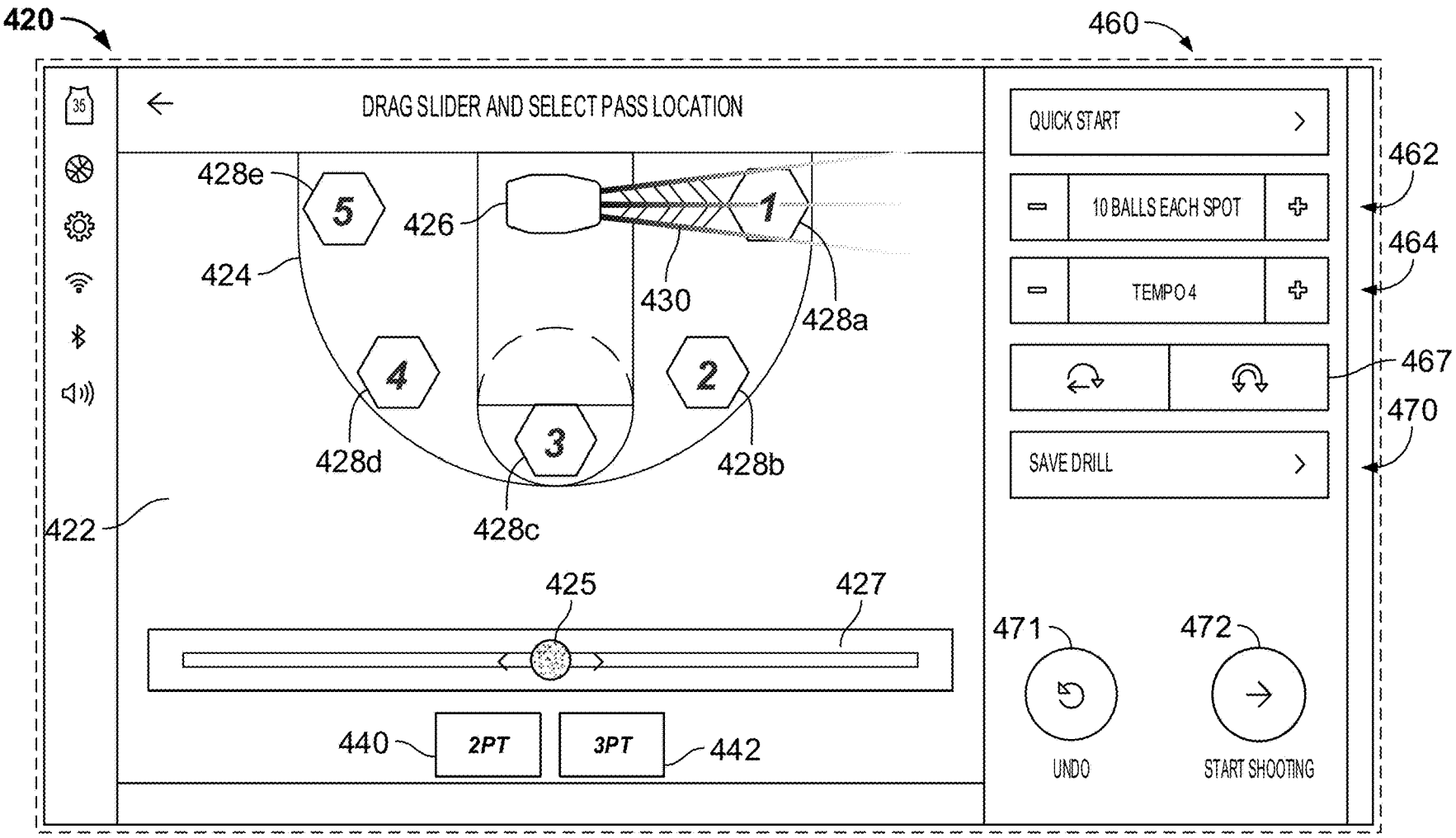

FIG. 25 illustrates a user interface 420 that presents a preview area 422 that includes representation of a portion of a basketball court 424 and a representative ball delivery machine 426. Animated delivery machine 426 includes a pass direction zone 430 that extends from a throwing end of the animated delivery machine 426 to illustrate the direction a pass would be thrown by the animated delivery machine 426 based on the direction the animated delivery machine 426 is facing. Pass direction zone 430 can share the features of pass direction zones 130, 230 described above.

Each of the graphical user interfaces described herein may implement a heat map of the user's statistics to guide the user to create a drill that will optimize their performance. The heat map can be implemented by presenting a user interface having statistics presented on a portion of an image of a basketball court, generating a drill based on user inputs received while presenting the user interface having statistics presented on the portion of the image of the basketball court, and controlling the basketball delivery machine to execute the drill.

Graphical user interface 420 includes one or more ball delivery locations 428 (e.g. ball delivery locations 428*a*, 428*b*, 428*c*, 428*d*, 428*e*) positioned at locations on the representative basketball court 424. Ball delivery locations 428*a*, 428*b* graphically represent candidate ball delivery locations to which ball delivery machine 10 will deliver basketballs during execution of the workout program. Each of ball delivery locations 428*a*, 428*b*, 428*c*, 428*d*, 428*e* include a number corresponding a sequential order of ball delivery to the ball delivery locations. That is, ball delivery location 128*a* illustrates the numeral 1 corresponding to a first order of ball delivery, and ball delivery location 128*b* illustrates the numeral 2 corresponding to a second order of ball delivery. While the order of ball delivery locations 1 through 5 and/or 482*a* through 428*e* may be employed, a custom order of ball delivery locations may be implemented where the user can choose any order of ball delivery locations (e.g. left to right, right to left, or a custom order as chosen by the user selecting the order of locations).

User interface 420 that includes a moveable control element 425 positioned within control bar 427 that extends across the user interface 420, the control bar 427 defines the area that the moveable control element 425 can move and/or slide within. User inputs (e.g. user placing their finger on the screen and sliding across the surface of the screen with that finger) to moveable control element 425 move and/or slide the moveable control element 425 within the control bar 427, the position of the moveable control element 425 controls the rotational position of representative ball delivery machine 426. That is, user interface 420 updates preview area 422 to indicate the direction the representative ball delivery machine 226 is facing based on the position of the moveable control element 225.

User interface 420 includes a two point value button 440 and a three point value button 442, the two point value button 440 and the three point value button 442 are user-selectable (e.g. by a user touching one of the buttons 440, 442), and selection of one of the buttons 440, 442 indicates a distance for the ball delivery machine to throw the pass. For example, if the two point value button 440 is selected at pass location 428*a*, ball delivery machine will deliver the pass within the three-point arc so the user can shoot a two-point shot. If the three point value button 442 is selected at pass location 428*a*, ball delivery machine will deliver the pass outside of the three-point arc so the user can shoot a three-point shot.

User interface 420 includes a drill variables area 460 that is separate from the drill preview area 422. The drill variables area 460 includes selectable variables that the user can attribute to the custom drill program. The drill variables area 460 includes a number of balls per location area 462 that allows a user to select the number of balls that will be delivered to each selected pass location. The balls per location area 462 can include increase and decrease buttons that are user-selectable to add or subtract the number of passes that are delivered to each location. The drill variables area 460 includes a tempo area 464 that allows a user to select the tempo at which the ball delivery machine will deliver balls to each selected pass location. The tempo area 464 can include increase and decrease buttons that are user-selectable to speed up or slow down the tempo of passes that are delivered to each location.

Drill variables area 460 includes user-selectable rotation direction buttons that include an around the arc and across the baseline button 466 and an around the arc and back button 467. The around the arc and across the baseline button 466 can be selected to choose a player movement option where the player progresses through the drill around the arc and runs across the baseline once the player reaches the end of the arc. The around the arc and back button 467 can be selected to choose a player movement option where the player progresses through the drill around the arc and retraces the arc on the way back to the beginning of the drill.

Drill variables area 460 includes a save drill area 470, an undo button 471, and a start shooting button 472. The save drill area 470 is user-selectable and allows a user to save a drill created on the user interface 420, the drill can be saved to a user account, to the ball delivery machine, to a drill database, and can be shared with other users. The undo button 471 can undo a most recent selection or action at user interface 420. For example, a user may select the undo button 471 to remove a selection of a ball delivery location. The user may select the undo button consecutively, and the most recent action will be removed with each selection of the undo button 471. The start shooting button 472 sends the drill instructions to the basketball delivery machine to begin the custom drill.

Figure 26:
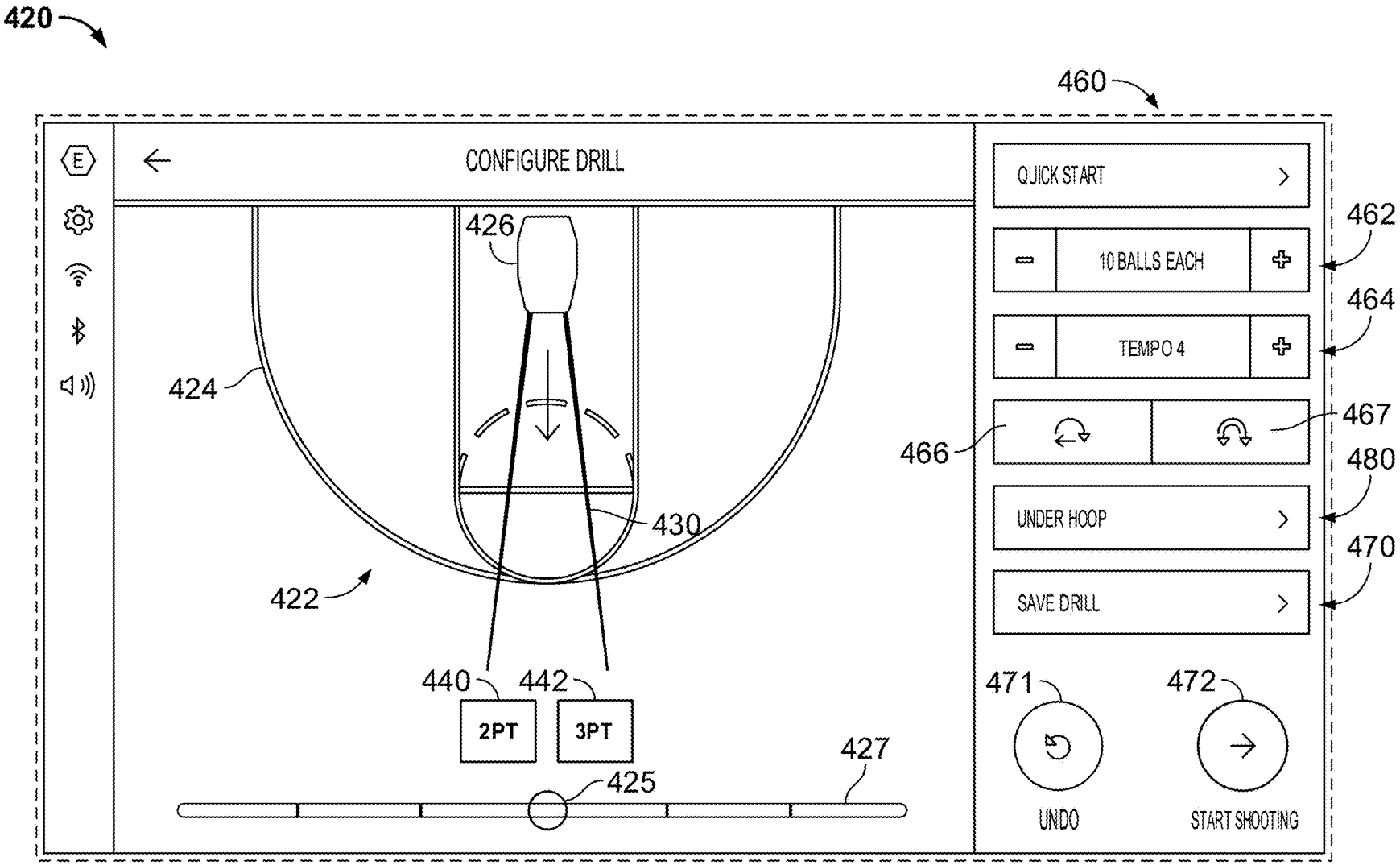

FIG. 26 illustrates user interface 420 that shares features of the user interface of FIG. 25, where the user interface is free of indicia such that ball delivery locations (e.g. ball delivery locations 428*a*, 428*b*, 428*c*, 428*d*, 428*e* shown in FIG. 25) are not shown in preview area 422. Instead, moveable control element 425 can be moved to unlimited positions along control bar 427 to rotate animated ball delivery machine 426 to unlimited positions within preview area 422.

User interface can include an under hoop selection area 480 that is user-selectable and allows a user to select options for what objects or actions the player can take under the hoop. The under hoop selection area 480 allows the user to position the machine under the basket or away from the basket. The under hoop selection area 480 can also allow the user to change the court layout and what pass locations a user can choose.

Figure 27:
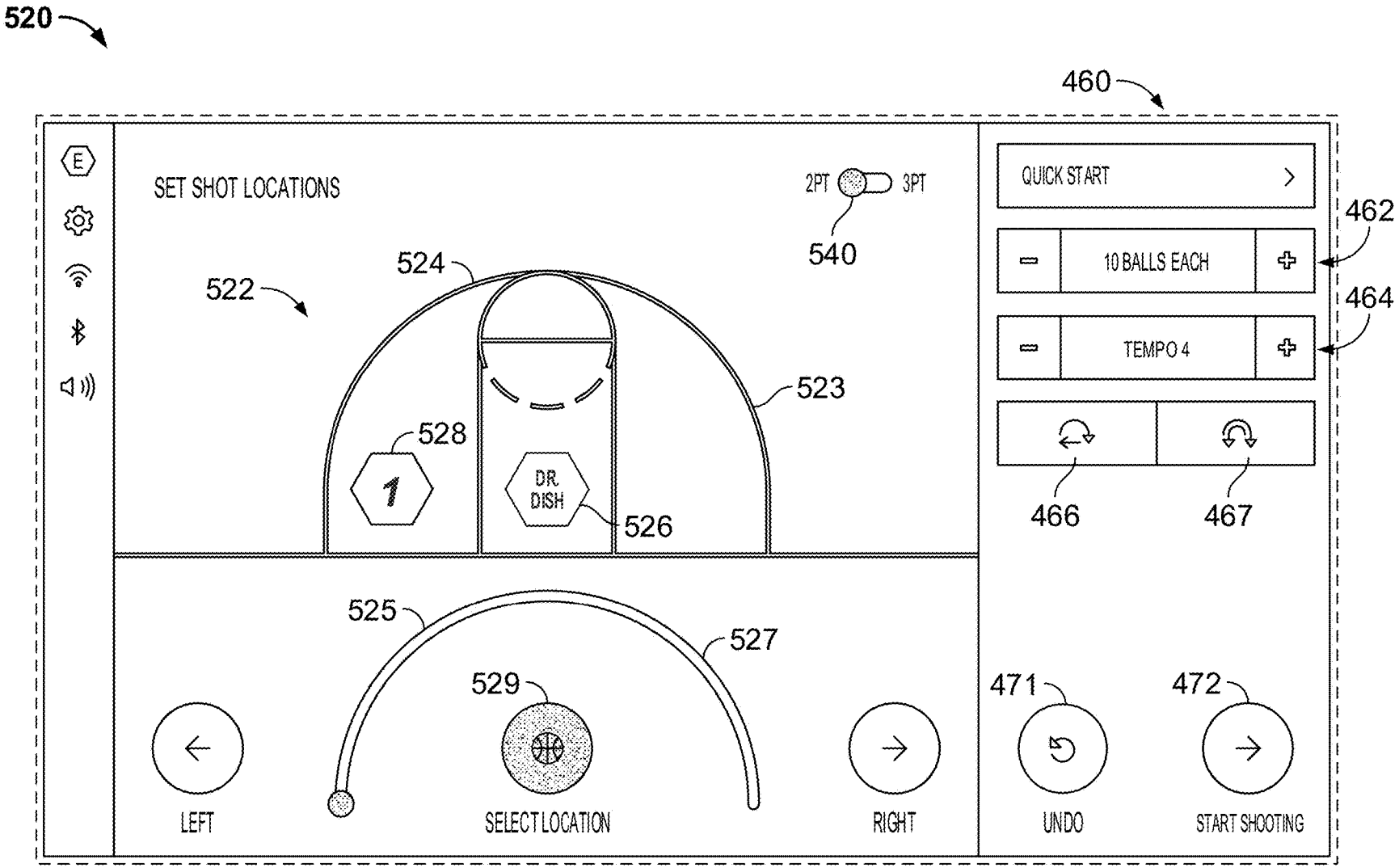

FIG. 27 illustrates a user interface 520 that shares the drill variables area 460 of user interface 420, and differs from the user interface 420 in the following ways. User interface can include a preview area 522 that includes representation of a portion of a basketball court 524 and a representation of a location of a ball delivery machine 526.

User interface 520 includes a moveable control element 525 positioned within control arc 527 that reflects ball delivery positions along an arc 523 of preview area 522. The control arc 527 defines the area that the moveable control element 525 can move and/or slide within. User inputs (e.g. user placing their finger on the screen and sliding across the surface of the screen with that finger) to moveable control element 525 move and/or slide the moveable control element 525 within the control arc 527. Moveable control element 525 controls the position of the selectable ball delivery location via select location button 529. For example, moveable control element 525 can be positioned in the left corner as shown in FIG. 27 and the select location button 529 can be pressed to add ball delivery location 528 to the preview area in the left corner.

User interface 520 includes a point value button 540, the point value button 540 is user-selectable (e.g. by a user touching the button 540, and selection of the button 540 selects a distance for the ball delivery machine to throw the pass. For example, if the point value button 540 is selected in a two point position and a user selects the select location button 529, the ball delivery position (e.g. 528) will be positioned as a two-point shot, and ball delivery machine will deliver the pass within the three-point arc so the user can shoot a two-point shot. If the point value button 542 is selected in a three-point position at pass location 528, ball delivery machine will deliver the pass outside of the three-point arc so the user can shoot a three-point shot.

Figure 28:
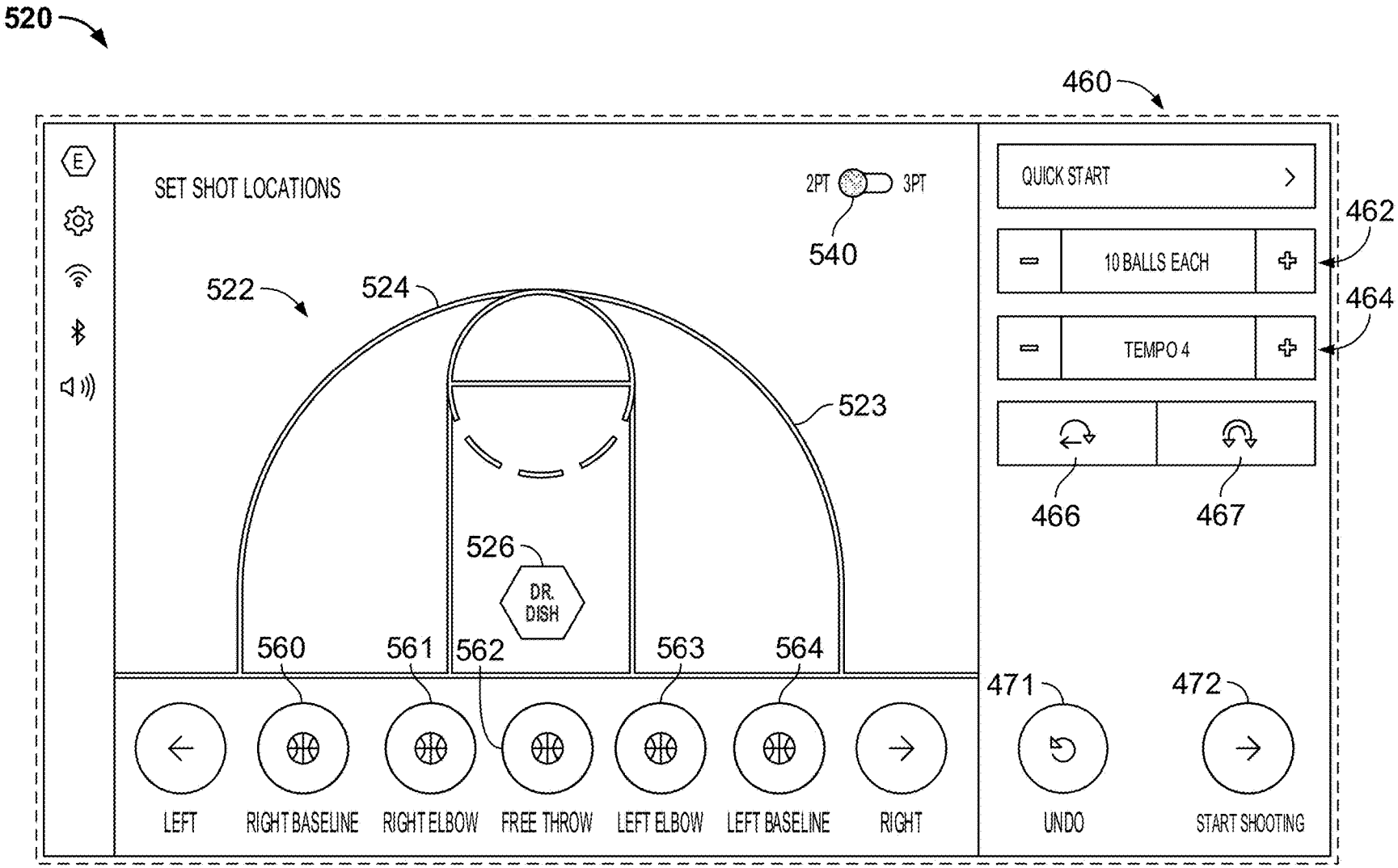

FIG. 28 illustrates user interface 520 that includes drill preview area 522, point value button 540, and the drill variables area 460. User interface 520 shown in FIG. 28 differs from FIG. 27 because FIG. 28 includes ball delivery location buttons instead of the moveable control element 525. The delivery location buttons include a right baseline 560, right elbow 561, free throw 562, left elbow 563, left baseline 564, and selection of the delivery location buttons by a user will add a ball delivery location to the preview area 522 that corresponds to the selected delivery button and the selected point value at point value button 540.

Figure 29:
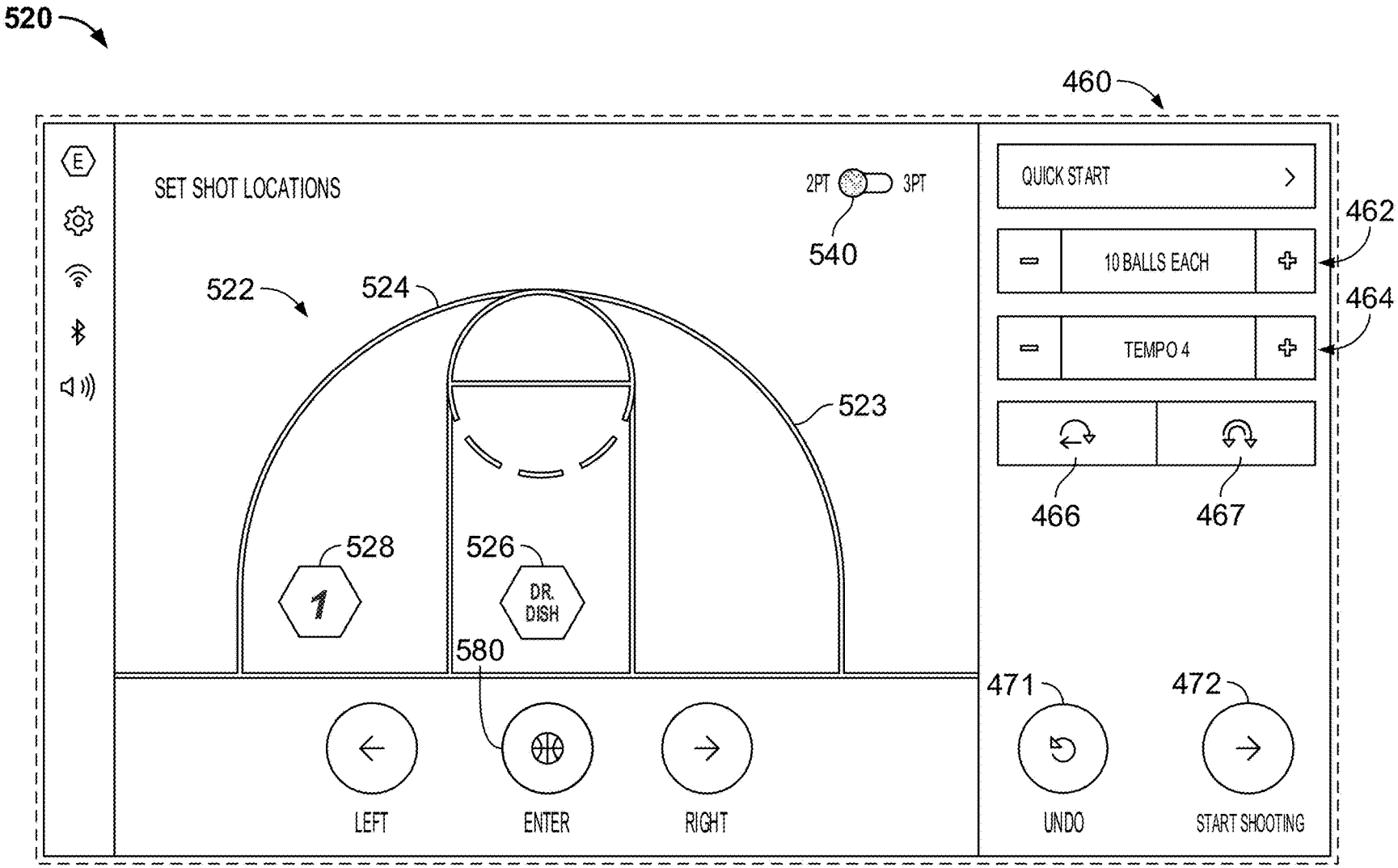

FIG. 29 illustrates user interface 520 that includes drill preview area 522, point value button 540, and the drill variables area 460. User interface 520 shown in FIG. 29 differs from FIG. 28 because FIG. 29 does not include ball delivery location buttons, and instead includes an enter button 580 that can be selected when a user selects a location within preview area (e.g. pass location 528). User may select pass location 528 by inputting (e.g. by a click, a finger tap) the pass location within the preview area 522. When the pass location 528 has been positioned within preview area, the user may select the enter button 580 to attribute the location (e.g. location 528) with the drill. This allows the user to select additional locations after location 528 has been positioned.

Figure 30:
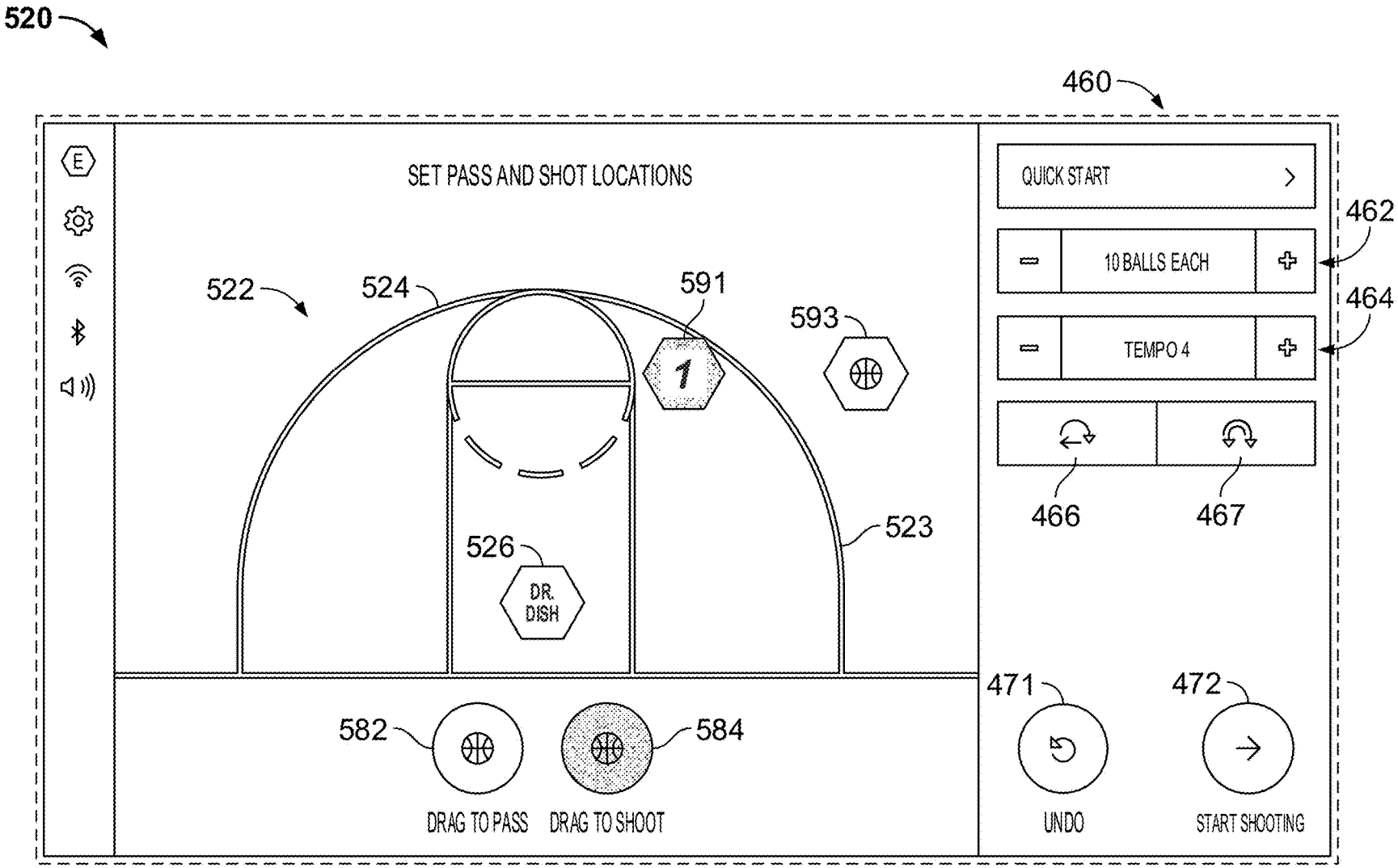

FIG. 30 illustrates user interface 520 that includes drill preview area 522 and the drill variables area 460. User interface 520 shown in FIG. 30 differs from FIG. 29 because FIG. 30 does not include the enter button 580, and instead includes a drag to pass button 582 and a drag to shoot button 584. The drag to pass button 582 and the drag to shoot button 584 are selectable such that a user can click, hold, and drag the drag to pass button 582 and the drag to shoot button 584 to the desired positions of ball delivery locations and shot locations. For example, a user can click, hold, and drag the drag to pass button 582 to pass location 593 and click, hold, and drag the drag to shoot button 584 to shot location 591, thereby defining a sequence of the workout program that includes a pass from the ball delivery machine to pass location 593 where a player will subsequently move to shot location 591 and shoot the ball.

Figure 31:
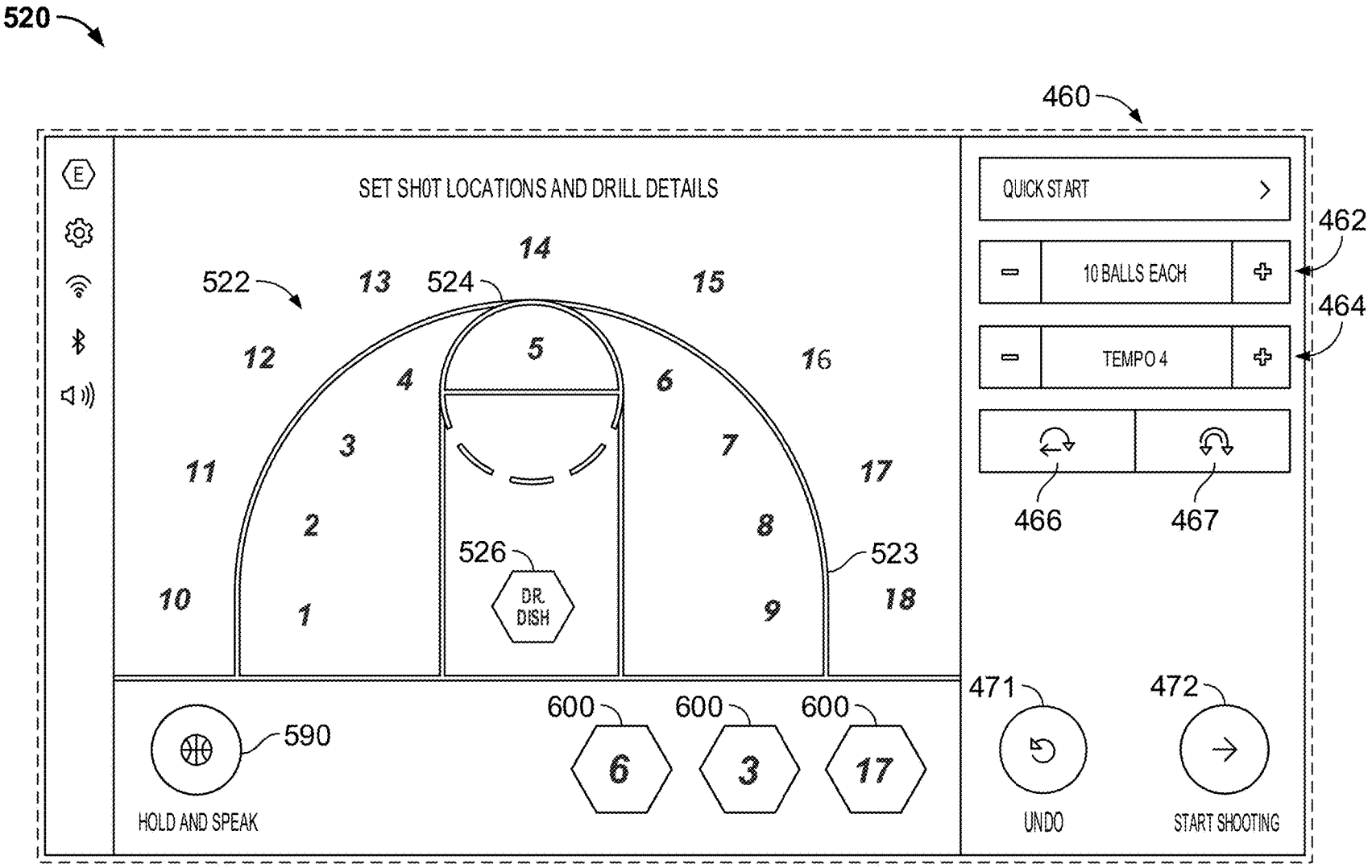

FIG. 31 illustrates user interface 520 that includes drill preview area 522 and the drill variables area 460. User interface 520 shown in FIG. 31 differs from FIG. 30 because FIG. 31 does not include drag to pass button 582 or drag to shoot button 584, and instead includes a hold and speak button 594 along with numbered locations throughout the preview area 522. The numbered locations are shown as numbers 1 through 18, and are positioned both within arc 523 and outside of arc 523. A user may select and hold the hold and speak button 590 and the ball delivery machine and/or an associated computing device such as a client device can capture voice input from the user (e.g. via a microphone), where the user can say the numbers associated with the desired shot locations. In the example of FIG. 31, a user has held the hold and speak button 590 and said the locations "six", "three", and "seventeen", which are displayed as selected locations 600. The user can say the numbers consecutively while holding the hold and speak button 590, or can say the numbers in separate instances of selecting the hold and speak button 590.

Recomdations and Assessments

The basketball training machines, user interfaces, and data processing described in this document can be used to analyze and assess the performance of players and to utilize the analyzed performance to recommend training programs, workout programs, drills, and schedules to players to improve their performance. A user can input metrics to determine an appropriate assessment, the metrics can include a player's age, height, weight, position, and/or team level. A player assessment can be given to establish a current performance level of a player, and additional assessments can be planned or scheduled based on the time the first assessment was given and performed. For example, assessments could be given at the beginning and end of each practice, once a week, at the beginning and end of each season, throughout the course of a season, throughout the course of a training camp, etc. After each assessment, the performance of the player is evaluated to determine their current performance level, and to determine a practice plan and training regimen to improve the player's performance. The current performance of the player can be compared to thresholds or benchmarks for players of similar age, similar skill level, on the same team, or benchmarks of the current player's previous performance.

The assessment can be performed using a sensor system that tracks several parameters including the player's movement, the ball position throughout the drill, the ball delivery location, the shot location, the trajectory of the shot, a make and/or miss, and the number of shots taken. The sensor system can include one or more cameras, shots made sensors, shot location sensors, Doppler sensors, wearable sensors (e.g. shoe sensor, wrist sensor, arm sensor, heart rate sensor), potentiometers, ball sensors, and combinations thereof. The parameters tracked by the sensor system can be analyzed to complete the assessment and provide the player, a coach, a trainer, or a parent feedback regarding the player's performance. For example, the feedback can include information such as a number of shots made, a number of shots missed, a number of shots missed left, a number of shots missed right, a number of shots missed long, a number of shots missed short, shot trajectory feedback, distance traveled, average heart rate, and video and audio feedback to illustrate proper form vs. their form.

In response to a completed and analyzed assessment, the system can recommend workouts including tailored drills, conditioning, and form review exercises to the player based on the analysis of the assessment. The player can complete the recommended workouts and return for another assessment. The assessment can be a part of the recommended workouts, and can re-assess the skills addressed in the previous assessment, or may assess different skills than the previous assessment. This process may be repeated so that the player is consistently challenged and improves with each practice session.

Data processing described in this document can be performed in a variety of configurations. For example, processing operations can be performed on a ball return device, on a user's phone, on a user's computer (e.g., desktop or laptop device), on a cloud server (e.g., a physical server, virtual server, or hosted application). Various configurations can be used to realize various advantages. For example, by performing processing operations on a ball return device, the ball return device can have access to the resulting data products no matter what kind of network access is or is not available. This may be advantageous, for example, when a user is generating a new drill and the system begins creating a new animation to show the drill to the user. If the rendering or animation is performed by the ball return device, the rendered animation can be accessible even if the ball return device is not connected to a data network at that time.

However, some configurations of a ball return device may not have sufficient computational resources (e.g., processing power, memory) to perform some of the operations needed for this or other use cases. In such scenarios, some or all of various processing operations may take place on other devices. For example, a cloud service-which will often have cheaper computational resources than a manufactured consumer device—can be used to perform operations that the ball delivery device is not capable of or not programed to perform. In addition to potential lower costs, this can allow for ease of upgradability. For example, if an algorithm processed by a cloud service is updated, one central implementation of the algorithm can be pushed to the cloud service instead of pushing an update to the thousands or millions of ball return devices in the network.

In some cases, user devices (e.g., phones, laptops, desktops, tablets) may be used to perform some of the operations described in this document. In some cases, this configuration may advantageously allow for reduced network traffic compared to other configurations. For example, in the case where a user records video with their phone, the video may be processed by the phone to reduce file size (e.g., lower bitrate or framerate) before the video is transmitted. Similarly, this can move processing operations 'to the edge' of the network—that is, in the client devices instead of cloud services. As will be appreciated, each new user can introduce additional computational requirements on the system as a whole. By moving computations to the user's device, the system can scale to large numbers of users because while each user brings computational demands, they would also bring computational resources to balance out those demands.

In some aspects, a basketball training system is provided that includes a computing device comprising one or more processors and computer memory storing instructions that, when executed by the processors, cause the processors to perform operations. The operations include storing performance measures for each of a plurality of users, receiving a request for a requested drill for a particular user, generating a drill for the particular user based on the user based on performance metrics for the user, the drill specifying at least an activity and at least a first parameter that defines a property of the activity. The system includes a basketball delivery machine configured to execute the drill for the particular user according to the first parameter, including delivering the basketball for the user in accordance with the drill and measuring the performance of the particular user.

The operations can include receiving a report of the performance of the particular user, modifying the performance metrics for the user based on the received report, receiving a second request for a requested drill for the particular user after the performance metrics for the user have been modified, generating a second drill for the particular user based on the modified performance metrics for the user, the drill specifying at least the one activity and at least a second parameter that differs from the first parameter in relation to the difference between the performance metrics and the modified performance metrics. The basketball delivery machine can be configured to execute the second drill for the particular user according to the second parameter such that the second drill has been modified by use of the second parameter to account for change in the skill level of the particular user.

The operations can include classifying each of the plurality of users into one of a plurality of skill groups, generating the first parameter based on the particular user being classified into a first skill group, modifying the performance metrics for the user based on the received report by reclassifying the particular user into a second skill group, and generating the second parameter based on the particular user being classified into the second skill group.

In some aspects, the first parameter is a shot percentage, and the measuring of the performance of the particular user is a record that records a record of the user meeting or failing to meet the shot percentage in the drill. In some aspects, the first parameter is a number of shots to be taken in the drill and the second parameter is a second number of shots to be taken in the drill that is different than the first number of shots. The ball delivery machine is configured to deliver the ball a number of times in the drill according based on the parameter used when executing the drill.

Drill Review

The basketball training machines, user interfaces, and data processing described in this document can be used to review a completed workout program or drill after a player completes the drill. The drill review can be performed using a sensor system that tracks several parameters including the player's movement, the ball position throughout the drill, the ball delivery location, the shot location, the trajectory of the shot, a make and/or miss, and the number of shots taken. The sensor system can include one or more cameras, shots made sensors, shot location sensors, Doppler sensors, wearable sensors (e.g. shoe sensor, wrist sensor, arm sensor, heart rate sensor), potentiometers, ball sensors, and combinations thereof. The parameters tracked by the sensor system can be analyzed to complete the assessment and provide the player, a coach, a trainer, or a parent feedback regarding the player's performance. For example, the feedback can include information such as a number of shots made, a number of shots missed, a number of shots missed left, a number of shots missed right, a number of shots missed long, a number of shots missed short, shot trajectory feedback, distance traveled, average heart rate, and video and audio feedback to illustrate proper form vs. their form.

The drill review can include a time series of the workout program can be shown to the player, coach, or trainer after the workout program is completed, the time series can be a video (e.g. sped up video), picture, graphical chart, or an animation that illustrates the player's performance during the workout program. The drill review can incorporate biometric data from the wearable sensor(s) and/or the camera system to provide feedback on the player's form and shot outcomes. For example, the drill review can provide an illustration of a player's form for each or all of the made shots vs. an illustration of the player's form for each or all of the missed shots. This feedback from the drill review can illustrate the differences in form when a user makes a shot and misses a shot, and can provide feedback about the player's consistency.

Remote Screen

Figure 32:
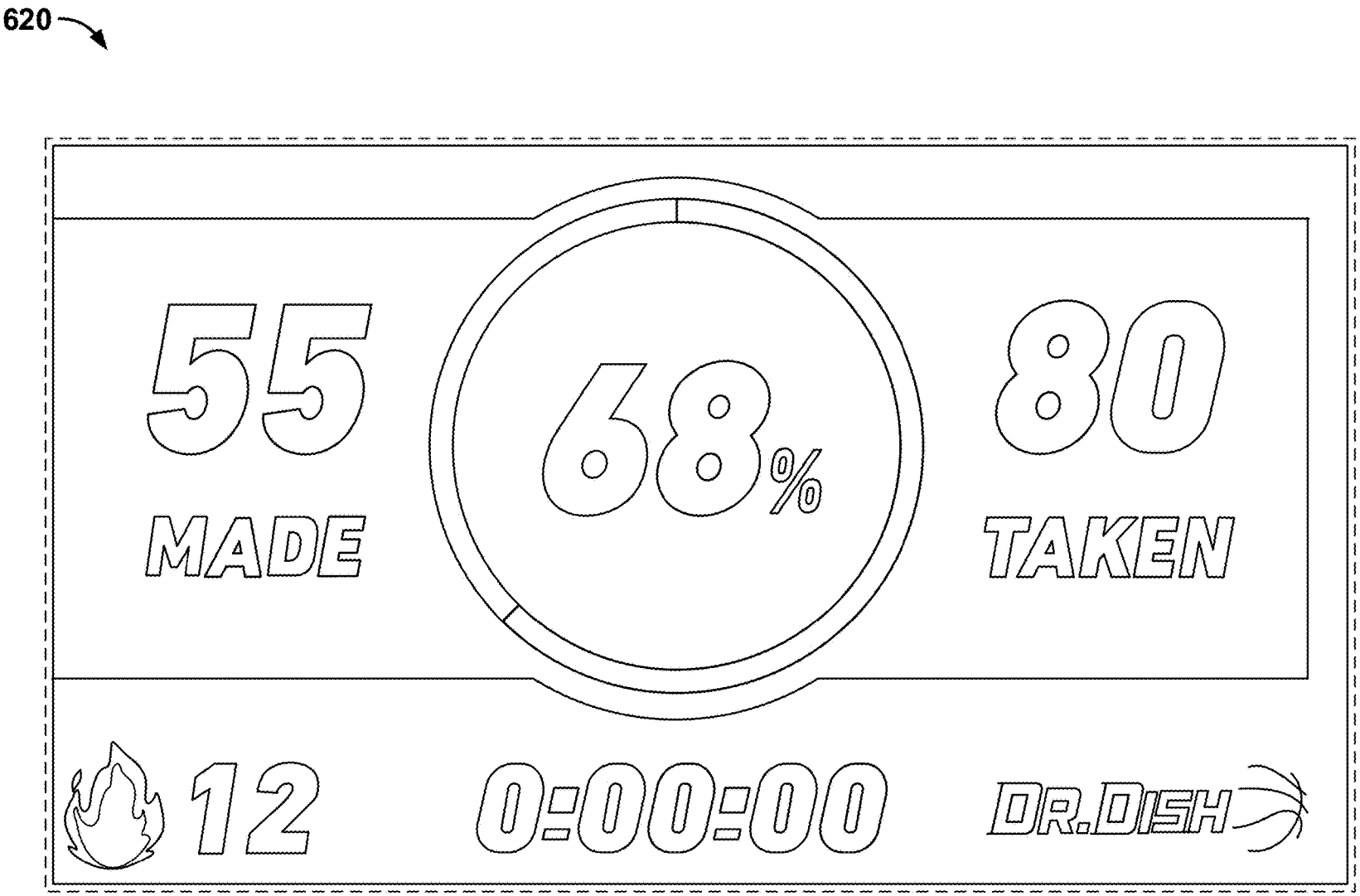

FIG. 32 illustrates a user interface 620 that displays data of what is happening real time on a basketball shooting machine. The user interface 620 can be a separate screen, and can be separated from the basketball shooting machine. The basketball shooting machine can be connected to a network (e.g. via the internet), and can stream data about its current state (e.g. shots made, shots taken, field goal percentage, current streaks such as made in a row, time remaining, player name, and/or team name) and/or videos of the current state (e.g. videos of the player's shooting form, videos of shots taken, videos of shots made and shots missed, video analysis of the player's shooting form in made shots and missed shots) to the cloud.

One or more cameras can be in communication with, connected to, and/or incorporated within the basketball shooting machine to record a video of a user performing the drill. The video can capture the shooting form of the user for each shot the user takes during the drill. Shooting form can refer to the mechanics of the user while the user shoots the ball. The mechanics of the user can include the grip, the stance, the release, the jump height, the timing, the angles of the arms, legs, elbow, wrist, fingers, the release height, the velocity of the ball, the arc of the ball, the apex of the ball, and combinations thereof.

Another network connected device can connect to the cloud where the data and/or videos are stored, and the network connected device can stream the data on the internet connected device in real time and/or in near real time such that the network connected device is actively displaying the updated data and videos sent from the basketball shooting machine, cameras, and sensors that communicate data and videos to the user interface 620 (e.g. via a network and/or the cloud). In real time can refer to the ability of the network connected device to display the statistics and video of a user performing a drill while the user is performing the same drill. For example, the statistics of number of shots made, number of shots missed, number of shots taken, number of shots made in a row can be illustrated to the user while the user is performing the drill. Similarly, video of the user performing the drill can be displayed to the user while the user is performing the drill. For example, the user can take a plurality of consecutive shots during a drill, and there are recorded videos of each shot taken. The system can display videos of every shot the user has taken and illustrate if each shot was made or missed, along with analysis of the user's shooting form including their mechanics. The system can also display individual feedback for each shot taken. For example, a user could take a shot during a drill and could watch the video of their shot along with the analysis of their form before taking another shot.

The network connected device can be a computer, a TV, a phone, a tablet, or a scoreboard. User interface 620 can be used to show multiple streams of data from multiple ball delivery machines. This information can be displayed to the user to allow them to compete against each other or better understand how they rank real time against another player forcing pressure situations to be more game like.

The techniques described herein enable a user (e.g., player, coach, administrator, training expert, or other user) to select desired ball delivery locations relative to a visual representation of a basketball court that are not limited by indications of predetermined ball delivery locations. Basketball training machine 10 can adjust a ball delivery speed and/or trajectory of delivered balls to automatically adjust for varying distances between basketball training machine 10 and selected ball delivery locations, as well as differing types and/or elevations of passes at any one or more of the ball delivery locations. Moreover, the ability to position basketball training machine 10 away from the basketball goal and to easily select ball delivery locations (and, in some instances, separate user shot locations), specify player movement, player maneuvers, and identify goals associated with such locations can enable the user to better simulate game-like conditions where passes are most frequently received from a location other than beneath the basketball goal. This ability to better simulate game-like player movement as well as pass delivery and receipt locations at varying locations and distances from the basketball goal without limiting such locations via predefined indicia can increase an effectiveness of the time spent training to prepare the user to effectively respond to game-like conditions.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A computer-implemented method comprising:

obtaining, by one or more radar sensors that are associated with a basketball delivery machine, radar sensor data indicating one or more parameters of a player's movement while the player is performing a drill using the basketball delivery machine, the radar sensor data indicating one or more impacts of a basketball on a rim before the basketball passes through the rim;

obtaining, by a basketball delivery machine, predefined ball delivery location data or predefined shot location data that is associated with the drill that is performed using the basketball delivery machine;

analyzing, by the basketball delivery machine, (i) the predefined ball delivery location data or the predefined shot location data that is associated with the drill that is performed using the basketball delivery machine, and (ii) the radar sensor data indicating the one or more parameters of the player's movement while the player is performing the drill using the basketball delivery machine;

generating, by the basketball delivery machine and based at least on analyzing both (i) the predefined ball delivery location data or the predefined shot location data that is associated with the drill that is performed using the basketball delivery machine, and (ii) the radar sensor data indicating the one or more parameters of the player's movement, feedback data that compares the player's movement to an idealized movement; and providing, by the basketball delivery machine, a representation of the feedback data for output to the player, the feedback data comprising a wire-frame representation of waypoints that are associated with an idealized shooting form.

2. The method of claim 1, comprising:

obtaining, by one or more cameras of the basketball delivery machine, image data indicating the one or more parameters of the player's movement while the player is performing the drill using the basketball delivery machine, the image data also indicating one or more of the impacts of the basketball on the rim before the basketball passes through the rim; and analyzing, by the basketball delivery machine, the image data indicating the one or more parameters of the player's movement while the player is performing the drill using the basketball delivery machine, wherein the feedback data is generated based at least on analyzing the radar sensor data and analyzing the image data.

3. The method of claim 1, comprising:

obtaining, by one or more LIDAR sensors of the basketball delivery machine, LIDAR data indicating the one or more parameters of the player's movement while the player is performing the drill using the basketball delivery machine, the LIDAR data indicating one or more of the impacts of the basketball on a rim before the basketball passes through the rim; and analyzing, by the basketball delivery machine, the LIDAR data indicating the one or more parameters of the player's movement while the player is performing the drill using the basketball delivery machine, wherein the feedback data is generated based at least on analyzing the radar sensor data and analyzing the LIDAR data.

4. The method of claim 1, comprising generating an assessment of the player based on the feedback data, the assessment including one or more recommended workout programs that are available to the basketball delivery machine.

5. The method of claim 1, comprising controlling collection of sensor data by sensors that are associated with the basketball delivery machine based on the feedback data.

6. The method of claim 1, wherein the sensor data indicates the one or more parameters of the player's movement at different shot locations throughout the drill.

7. The method of claim 1, further comprising:

receiving, by the basketball delivery machine, profile data entered by the player into the basketball delivery machine, and generating animated top-down renderings of the drill based on the profile data, wherein the feedback data is generated further based on the profile data that is entered by the player into the basketball delivery machine.

8. The method of claim 1, wherein the feedback data is generated further based on one or more benchmarks of the player's previous performance in comparison with other players on a same team.

9. The method of claim 1, wherein the feedback data pertains to an apex of the basketball ball.

10. The method of claim 1, wherein the one or more radar sensors are not incorporated into the basketball delivery machine.

11. The method of claim 1, wherein the feedback data comprises a visual rendering of the player's movement along with a video rendering of the idealized movement, as well as shot make or miss information associated with the player's movement.

12. The method of claim 1, wherein the feedback data is generated on the basketball delivery machine without transmitting the sensor data over an internet connection.

13. The method of claim 1, comprising:

obtaining, by the basketball delivery machine, accelerometer data from a smart basketball, the accelerometer data indicating one or more impacts of the smart basketball on the rim before the smart basketball passes through the rim; and analyzing, by the basketball delivery machine, the accelerometer data, wherein the feedback data is generated based at least on analyzing the radar sensor data and analyzing the accelerometer data.

14. One or more non-transitory computer-readable media storing instructions that, when executed by one or more processors, cause the one or more processors to perform operations comprising:

obtaining, by one or more radar sensors that are associated with a basketball delivery machine, radar sensor data indicating one or more parameters of a player's movement while the player is performing a drill using the basketball delivery machine, the radar sensor data indicating one or more impacts of a basketball on a rim before the basketball passes through the rim;

obtaining, by a basketball delivery machine, predefined ball delivery location data or predefined shot location data that is associated with the drill that is performed using the basketball delivery machine;

analyzing, by the basketball delivery machine, (i) the predefined ball delivery location data or the predefined shot location data that is associated with the drill that is performed using the basketball delivery machine, and (ii) the radar sensor data indicating the one or more parameters of the player's movement while the player is performing the drill using the basketball delivery machine;

generating, by the basketball delivery machine and based at least on analyzing both (i) the predefined ball delivery location data or the predefined shot location data that is associated with the drill that is performed using the basketball delivery machine, and (ii) the radar sensor data indicating the one or more parameters of the player's movement, feedback data that compares the player's movement to an idealized movement; and providing, by the basketball delivery machine, a representation of the feedback data for output to the player, the feedback data comprising a wire-frame representation of waypoints that are associated with an idealized shooting form.

15. A basketball delivery machine comprising:

one or more processors; and one or more non-transitory computer-readable media storing instructions that, when executed by the one or more processors, cause the one or more processors to perform operations comprising:

obtaining, by one or more radar sensors that are associated with a basketball delivery machine, radar sensor data indicating one or more parameters of a player's movement while the player is performing a drill using the basketball delivery machine, the radar sensor data indicating one or more impacts of a basketball on a rim before the basketball passes through the rim;

obtaining, by a basketball delivery machine, predefined ball delivery location data or predefined shot location data that is associated with the drill that is performed using the basketball delivery machine;

analyzing, by the basketball delivery machine, (i) the predefined ball delivery location data or the predefined shot location data that is associated with the drill that is performed using the basketball delivery machine, and (ii) the radar sensor data indicating the one or more parameters of the player's movement while the player is performing the drill using the basketball delivery machine;

generating, by the basketball delivery machine and based at least on analyzing both (i) the predefined ball delivery location data or the predefined shot location data that is associated with the drill that is performed using the basketball delivery machine, and (ii) the radar sensor data indicating the one or more parameters of the player's movement, feedback data that compares the player's movement to an idealized movement; and providing, by the basketball delivery machine, a representation of the feedback data for output to the player, the feedback data comprising a wire-frame representation of waypoints that are associated with an idealized shooting form.

* * * * *